United States Patent [19]

Iba et al.

[11] Patent Number: 5,025,703

[45] Date of Patent: Jun. 25, 1991

[54] ELECTRONIC STRINGED INSTRUMENT

[75] Inventors: Akio Iba, Tokorozawa; Yoshiyuki Murata, Tachikawa; Hajime Manabe, Higashiyamato, all of Japan

[73] Assignee: Casio Computer Co., Ltd., Tokyo, Japan

[21] Appl. No.: 256,398

[22] Filed: Oct. 7, 1988

[30] Foreign Application Priority Data

| | | | |
|---|---|---|---|
| Oct. 7, 1987 | [JP] | Japan | 62-253230 |
| Oct. 7, 1987 | [JP] | Japan | 62-253231 |
| Oct. 7, 1987 | [JP] | Japan | 62-253235 |
| Oct. 9, 1987 | [JP] | Japan | 62-256024 |
| Oct. 14, 1987 | [JP] | Japan | 62-259243 |
| Oct. 14, 1987 | [JP] | Japan | 62-259292 |
| Oct. 16, 1987 | [JP] | Japan | 62-259786 |
| Sep. 5, 1988 | [JP] | Japan | 63-220558 |

[51] Int. Cl.[5] ..... G10H 1/32; G10H 5/00; G10H 1/02; G10H 1/18

[52] U.S. Cl. ..... 84/718; 84/678; 84/681; 84/701; 84/702; 84/722

[58] Field of Search ..... 84/1.16, 1.01, 1.15, 84/1.14, DIG. 27, DIG. 26, DIG. 4, DIG. 1, DIG. 30, 1.13, 1.19, 1.22, 1.23, 1.24–1.27, 615–617, 622, 624–627, 629–631, 633, 646, 653–654, 658–660, 662–663, 665, 678, 681–682, 687, 692, 694, 697, 701–703, 705–708, 718, 711, 720, 722, 723; 84/725–727

[56] References Cited

U.S. PATENT DOCUMENTS

| | | | |
|---|---|---|---|
| 3,948,138 | 4/1976 | Gunn et al. | 84/1.16 X |
| 4,235,141 | 11/1980 | Eventoff | 84/1.16 X |
| 4,321,852 | 3/1982 | Young, Jr. | 84/646 X |
| 4,351,216 | 9/1982 | Hamm | 84/1.15 |
| 4,357,852 | 11/1982 | Svenaga | 84/1.16 |
| 4,372,187 | 2/1983 | Berg | 84/1.16 |
| 4,468,997 | 9/1984 | Young, Jr. | 84/722 |
| 4,572,048 | 2/1986 | Franz et al. | 84/1.19 |
| 4,630,520 | 12/1986 | Bonanno | 84/1.16 |
| 4,653,376 | 3/1987 | Allured et al. | 84/1.16 |
| 4,658,690 | 4/1987 | Aitken | 84/1.16 X |
| 4,702,141 | 10/1987 | Bonanno | 84/1.16 |
| 4,723,468 | 2/1988 | Takabayashi et al. | 84/1.16 |
| 4,748,887 | 6/1988 | Marshall | 84/646 |
| 4,760,767 | 8/1988 | Tsurubuchi | 84/646 |
| 4,817,484 | 4/1989 | Iba et al. | 84/731 X |

FOREIGN PATENT DOCUMENTS

| | | | |
|---|---|---|---|
| 49-58332 | 5/1974 | Japan . | |
| 51-153630 | 12/1976 | Japan . | |
| 57-52596 | 11/1982 | Japan . | |
| 63-51395 | 4/1988 | Japan . | |
| 63-51396 | 4/1988 | Japan . | |
| 63-92397 | 6/1988 | Japan . | |
| WO87/00331 | 1/1977 | World Int. Prop. O. | 84/1.16 |

*Primary Examiner*—A. T. Grimley
*Assistant Examiner*—Matthew S. Smith
*Attorney, Agent, or Firm*—Frishauf, Holtz, Goodman & Woodward

[57] ABSTRACT

An electronic stringed instrument employs a plurality of sensors or monitors for instrument performance. Preferred sensors or monitors include a detector for detecting that a string of the instrument is vibrated, an apparatus for evaluating a string-vibration strength or a string touch, an apparatus for discriminating a fret operation position on a fingerboard or a fundamental frequency of a vibration of the vibrated string, a tremolo arm sensor, and a string-bending sensor. These performance input parameters are assigned to various control functions for musical tones generated by a sound source and/or various control functions for effects added to these musical tones by an effector. The function assignment is preferably programmable. In an operation, a music control apparatus control the sound source and/or effector in response to a performance monitor so that musical tones for the strings can be distinguished from each other or effects for the musical tones can be distinguished from each other. Therefore, a performance with the stringed instrument by a player can be fully expressed.

26 Claims, 58 Drawing Sheets

(d) TUNING OF STRING VIBRATION PERIOD (FRET POSITION)

☐ NORMAL

☐ PIANO TUNING (e) TONE COLOR MIXING RATIO CONTROL BY STRING VIBRATION PERIOD

☐ STRING COMMON

☐ STRING DEPENDENT (f) STRING DEPENDENT TONE COLOR MIXING RATIO CONTROL BY STRING VIBRATION PERIOD

STRING NUMBER ☐

TONE COLOR MIXING RATIO FUNCTION ☐

1: 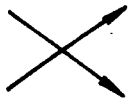

2: 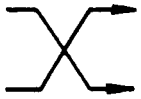

3: 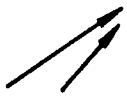

4: 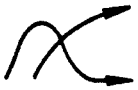

(g) ENVELOPE CONTROL BY STRING VIBRATION PERIOD

☐ ENVELOPE RATE CHANGE : SENSITIVITY ☐

☐ ENVELOPE LEVEL CHANGE : SENSITIVITY ☐

FIG. 38B (a) ENVELOPE

☐ STRING COMMON

☐ STRING DEPENDENT (b) ENVELOPE IN UNITS OF STRINGS

STRING NUMBER ☐

TOTAL NUMBER OF STEPS ☐

STEP ☐

RATE ☐ LEVEL ☐

☐ SUSTAIN

RATE CHANGE FACTOR : { DATA SET IN FUNCTION ASSIGNMENT MODE (IF SET) }

LEVEL CHANGE FACTOR : { DATA SET IN FUNCTION ASSIGNMENT MODE (IF SET) }

FIG. 40

(a) EFFECTOR

☐ TREMOLO ☐ CHORUS

☐ DELAY ☐ REVERBERATION (b) TREMOLO EFFECTOR

☐ STRING COMMON

☐ STRING DEPENDENT (c) STRING DEPENDENT TREMOLO EFFECTOR

STRING NUMBER ☐

TREMOLO SPEED (TMSPED) ☐

TREMOLO DEPTH (TMDPTH) ☐

TREMOLO SPEED CHANGE FACTOR : { DATA SET IN FUNCTION ASSIGNMENT MODE (IF SET) }

TREMOLO DEPTH CHANGE FACTOR : { DATA SET IN FUNCTION ASSIGNMENT MODE (IF SET) }

FIG. 41

FIG.48A
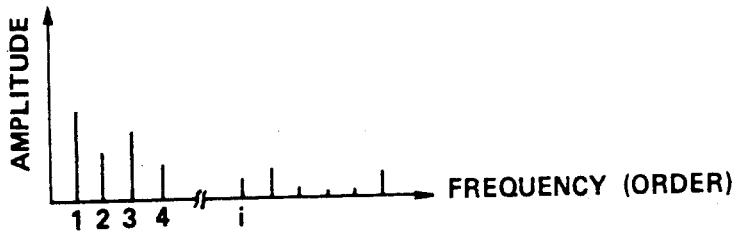
FIG.48B
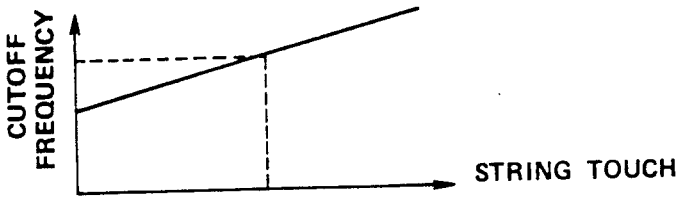
FIG.48C
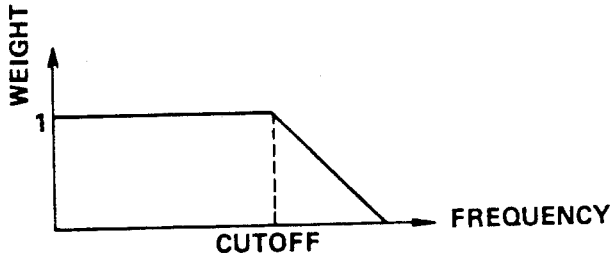
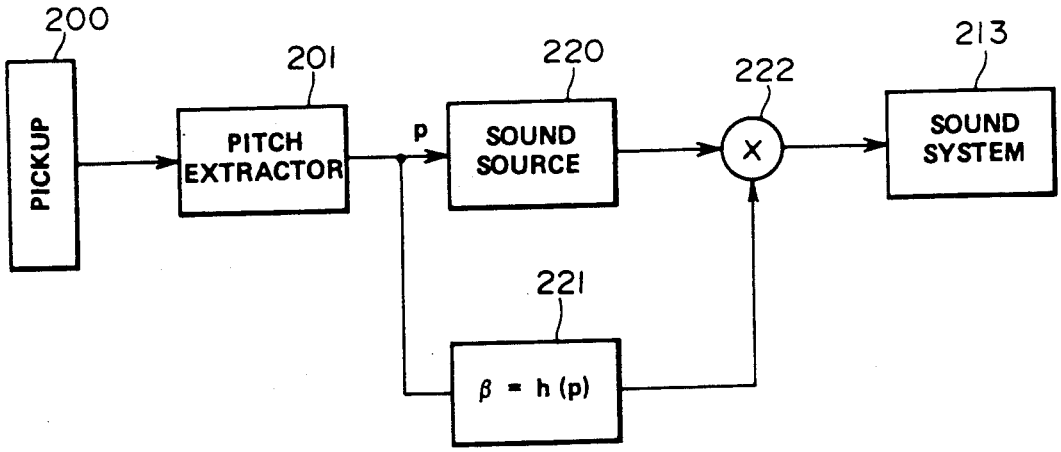
FIG.49

ELECTRONIC STRINGED INSTRUMENT

BACKGROUND OF THE INVENTION

1. Field of the Invention

The present invention relates to a plucked instrument type (e.g., a guitar) or a bowed instrument type (violin) electronic stringed instrument and, more particularly, to wide-range musical tone control in various electronic stringed instruments.

2. Description of the Related Art

A variety of conventional electronic stringed instruments have been proposed, and some of them are commercially available.

Pending U.S. patent application Ser. Nos. 69,612 and 171,883 by the same assignee as that of the present invention disclose electronic guitars each adopting switches which are carried by corresponding strings and are operated in response to the plucking operation, and pressure-response type switches embedded in a fingerboard in a matrix fashion. The former switches are used for controlling the start of generation of musical tones from a sound source, and the latter switches are used for determining pitches of musical tones.

Pending Japanese Utility Model Disclosure (Kokai) Nos. 63-51395 and 63-51396 by the same assignee as that of the present invention disclose electronic guitars each adopting a converter for picking up vibrations of strings, an envelope detector for detecting an envelope of the pickup signal, and an evaluation device for measuring a peak value of the envelope. The peak value of the envelope represents a plucking strength, and is used for controlling a tone volume of a musical tone internally generated. Each disclosed electronic guitar has a tremolo arm and a tremolo arm sensor. An output from the tremolo arm sensor is used for modulating the frequency of a musical tone.

U.S. Pat. No. 4,723,468 discloses an electronic guitar which identifies an operation position corresponding to a fret on a fingerboard which is in contact with a string of a musical instrument by utilizing an ultrasonic wave. The detected fret position is used for specifying a pitch of the musical tone generated by a sound source.

Pending U.S. patent application Ser. No. 112,780 by the same assignee as that of the present invention discloses an electronic guitar using a pitch extractor for picking up a vibration of each string, and extracting a string vibration period data (pitch data) from the picked up signal, and a pitch setter for designating a pitch corresponding to the extracted pitch data.

However, the above related arts do not take wide-range musical tone control in an electronic guitar into consideration. Only limited, fixed musical tone control functions are provided for performance inputs.

SUMMARY OF THE INVENTION

It is, therefore, an object of the present invention to provide a electronic stringed instrument which fully utilizes performance inputs used, and performs control of abundant tones.

It is another object of the present invention to provide an electronic stringed instrument which can generate tones in units of strings of the instrument.

It is still another object of the present invention to provide an electronic stringed instrument which has high flexibility for tone control.

It is still another object of the present invention to provide an electronic stringed instrument which fully utilizes performance inputs to an instrument and gives abundant tone effects.

It is still another object of the present invention to provide an electronic stringed instrument which is particularly suitable for a stereophonic sound system.

It is still another object of the present invention to provide an electronic stringed instrument which can be easily tuned with an instrument which employs another tuning system.

It is still another object of the present invention to provide an electronic stringed instrument with which a player can easily change a pitch of a musical tone without using a tremolo arm.

According to the present invention, there is provided an electronic stringed instrument comprising: a fingerboard; a plurality of extended strings; string-vibration detection means for detecting that each string is vibrated; operation position detection means for detecting an operation position on the fingerboard; and tone control mean including tone start instruction means for, when the string-vibration detection means detects that one of the strings is vibrated, instructing start of generation of a musical tone to sound source means for generating musical tones corresponding to the strings, and pitch instruction means for instructing the sound source means to cause the pitch of the musical tone generated by the sound source means to correspond to an operation position on the fingerboard detected by the operation position detection means, wherein the tone control means controls such that characteristics of musical tones generated by the sound source means and corresponding to the strings are different from each other.

Therefore, this arrangement can provide musical tone control inherent to each string of the electronic stringed instrument.

Meanings of "a plurality of extended strings", "detecting that each string is vibrated", and "an operation position on the fingerboard" in the above description and appended claims should be interpreted in a broad sense. Typically, the "plurality of extended strings"are kept taut along a fingerboard. The "strings to be vibrated" are kept taut on a body, and are vibrated by fingers or a pick. The "plurality of extended strings" and the "strings to be vibrated" are the same as each other in physical and mechanical senses. However, depending on types of operation position detection means, the "plurality of extended strings" are kept taut on only the body, and need not be kept taut along the fingerboard. Alternatively, the "plurality of extended strings" may be physically separately arranged on both the body and the fingerboard. In an extreme case, strings which are pressed and operated can be imaginary strings which are not present in a physical sense. For example, assuming that the fingerboard consists of a plurality of (e.g., 6 columns of) tracks equal corresponding in number to the strings to be vibrated, the tracks correspond to the strings to be vibrated. Therefore, these tracks are imaginary strings, and the pressed position on each track is nothing less than the operation position of the string. The strings may also be vibrated by using a bow like a bowed instrument other than the vibration made by a finger or a pick.

The "sound source means" described in the appended claims can be provided in a stringed instrument body having a fingerboard or outside it. Similarly, all the "means" excluding the "strings", "string-vibration detection means", and "operation position detection means" can be arranged outside the stringed instrument body.

One type of operation position detection means is constituted by pressure-sensitive switches arranged in the fingerboard in a matrix, and a means for monitoring the states of these switches. Another type of operation position detection means is constituted by an ultrasonic wave transmission means for generating and transmitting an ultrasonic wave to each string, an ultrasonic reception means for receiving an ultrasonic wave echo reflected by a fret on the fingerboard which is in contact with the strings, and a means for measuring a time difference between transmission and reception times of the ultrasonic wave. Other types of operation position detection means may be employed.

The string-vibration detection means can be realized by various means. For example, a simple string-vibration detection means employs switches which are carried on the corresponding strings, and are operated in response to the plucking operation. Another type of string-vibration detection means is constituted by a converter (e.g., an electromagnetic type or piezoelectric type) for picking up vibrations of strings, and a means for monitoring a leading edge of the pickup signal. For example, if the magnitude of the pickup signal exceeds a predetermined threshold value, this represents that the corresponding string is vibrated.

In place of the operation position detection means, a period measuring means for measuring fundamental periods of vibrations of the strings may be adopted. In this case, a pitch of a musical tone generated by the sound source means is basically determined by the measuring result of the period measuring means. The period measuring means is constituted by a converter for picking up vibrations of the strings (which can be used commonly in the plucking operation detection means), and pitch extraction means for extracting a fundamental frequency of the pickup signal.

The meaning of "when the string-vibration detection means detects that one of the strings is vibrated, instructing the sound source means to start generation of a musical tone corresponding to the string" describe in the above description and the appended claims should be interpreted in a broad sense. More specifically, detection of the string-vibration is a precondition for generating a musical tone in the sound source means. For example, in the case of an electronic stringed instrument using the period measuring means, when a first period is determined, generation of a musical tone is preferably started.

The tone control means controls at least one of tone volume characteristics, pitch characteristics, tone color characteristics, and envelope characteristics of musical tones corresponding to the strings generated by the sound source means in units of strings.

According to another aspect of the present invention, there is provided an electronic stringed instrument comprising: a fingerboard; a plurality of extended strings; string-vibration monitoring means for monitoring a vibrating operation of each string; operation position monitoring means for monitoring an operation position on the fingerboard; effect addition means, interlocked with sound source means for generating musical tones corresponding to the strings, for adding an effect to the musical tone corresponding to each string and supplied from the sound source means; musical tone control means for controlling the sound source means in response to monitor results from the string-vibration monitoring means and the operation position monitoring means; and effect control means for controlling the effect addition means, wherein the effect control means controls the effect addition means so that effects added to the musical tones corresponding to the strings are different from each other.

Therefore, this arrangement can provide effect control inherent to each string.

The effect addition means can be constituted by a plurality of discrete effectors which are interlocked with corresponding channel outputs from the sound source means or can be constituted by a polyphonic effector which is time-divisionally operated. The effect addition means is constituted by an arbitrary one or an arbitrary combination of a tremolo effector, chorus effector, a depth effector, a reverberation effector, a phaser effector, and the like. In correspondence with these effectors, the effect control means can control the arbitrary one or arbitrary combination of a tremolo effect, a chorus effect, and the like in units of strings.

The tone control means can control the sound source means so that characteristics of musical tones generated in correspondence with the strings are different from each other.

Instead of the operation position monitoring means, a period monitoring means for monitoring a fundamental period of a vibration of each string may be used.

For example, tone envelope control inherent to each string can be realized by an envelope setting means for independently setting a tone envelope corresponding to each string, and a means for controlling the envelope generated by the sound source means and corresponding to each string in accordance with the data set by the envelope setting means.

For example, effect control inherent to each string can be realized by an effect parameter setting means for independently setting an effect parameter corresponding to each string, and a means for controlling the effect addition means using the set effect parameter.

The electronic stringed instrument of the present invention can include another performance detection means or performance monitoring means in addition to the above-mentioned string-vibration detection means and the operation position detection means (or period measuring means instead thereof). One of these means is a string-vibration strength measuring means for measuring a strength of a vibrating of each string. The string-vibration strength measuring means can be constituted by a converter for picking up a vibration of each string (which is preferably commonly used with the string-vibration detection means or the period detection means), and a means for extracting data associated with the plucking strength from the pickup signal. The string-vibration strength can be evaluated by a maximum amplitude or energy (power) of the pickup signal. Another performance detection means is a string-bending detection means for detecting a string-bending operation (operation for bending a string inwardly or outwardly) of each string. The string-bending detection means can be of a type of measuring a tension of each string. In addition, a manually operable performance operation element, and an operation element monitoring means for monitoring an operation of this operation element can be used. A typical manually operable performance operation element is a tremolo arm.

In this invention, an arbitrary one or arbitrary combination of these performance detection means (including the operation position detection means and the period measuring means) can be utilized for controlling musical tones or controlling modulation and/or effects.

In one arrangement, the sound source means has a first sound source module means for generating a first musical tone having a first tone color, a second sound source module means for generating a second musical tone having a second tone color, and a tone mixing means for mixing the first and second musical tones for the strings. In this application, a mixing ratio of the two musical tones can be controlled based on at least one of a vibration period (or operation position on the fingerboard), a string-vibration strength, a string-bending amount of a string, an operation amount of a tremolo arm, and a string number, according to the present invention.

In another arrangement, musical tones of the strings generated by the sound source means can be distributed to at least two audio circuit means for stereophonic reproduction. According to the present invention, a relative magnitude of a musical tone signal supplied to each audio circuit means can be controlled as a function of a vibration period (or operation position on the fingerboard), a string-vibration strength, a string-bending amount of a string, an operation amount or operation angular position of a tremolo arm, and/or a string number.

According to another characteristic feature of the present invention, there is provided an electronic stringed instrument comprising a fingerboard; a plurality of extended strings; string-vibration monitoring means for monitoring a vibrating operation of each string; string-vibration strength monitoring means for monitoring means of a vibrating strength of each string; operation position monitoring means for monitoring an operation position on the fingerboard (or period monitoring means for monitoring a fundamental period of vibration of each string); a manually operable performance operation element; operation element monitoring means, interlocked with the performance operation element, for monitoring the operation of the performance operation element; and tone control means for controlling sound source means for generating musical tones corresponding to the strings, wherein the instrument further comprises function assigning means for variably assigning a tone control function to each operation of the performance operation element, and the tone control means controls the sound source means in accordance with the tone control function assigned by the function assigning means in response to the monitoring results from the string-vibration monitoring means, the string-vibration strength monitoring means, the operation position monitoring means (or period monitoring means), and the operation element monitoring means.

In a broad sense, the function assigning means can variably assign a specific one of the above-mentioned stringed instrument performance detection means as a tone control function for the tone control means, an effect control function for the effect addition means, and/or control functions for other musical tone signal processing means.

According to another feature of the present invention, there is provided an electronic stringed instrument comprising a fingerboard; a plurality of extended strings; string-vibration detection means for detecting that each string is vibrated; operation position detecting means for detecting an operation position on the fingerboard (or period measuring means for measuring a fundamental period of a vibration of each string); and tone control means including tone generation start instruction means for, when the string-vibration detection means detects that one of the strings is vibrated, instructing sound source means for generating a musical tone corresponding to each string to start generation of a musical tone corresponding to the vibrated string, wherein the apparatus further comprises pitch data generating means, interlocked with the operation position detection means, for generating pitch data in accordance with the operation position on the fingerboard with respect to each string detected by the operation position detection means (or period detected by the period measuring means), pitch data correcting means for correcting the pitch data generated by the pitch data generating means into another tuned pitch data, and pitch control means for controlling a pitch of a musical tone corresponding to each string and generated by the sound source means, using the pitch data corrected by the pitch data correcting means.

With this arrangement, conversion from one tuning system to another one can be easily made.

According to still another aspect of the present invention, there is provided an electronic stringed instrument comprising: a fingerboard; a plurality of extended strings; string-vibration detection means for detecting that each string is vibrated; operation position detection means for detecting an operation position on the fingerboard (or period measuring means for measuring a fundamental period of a vibration of each string); and tone control means including tone generation start instruction means for, when the string-vibration detection means detects that one of the strings is vibrated, instructing sound source means for generating a musical tone corresponding to each string to start generation of a musical tone corresponding to the vibrated string, and pitch instruction means for instructing the sound source means to cause the pitch of the musical tone generated by the sound source means to correspond to the operation position on the fingerboard detected by the operation position detection means, wherein the apparatus further comprises one or a plurality of manually rotatable or slidable pitch modulation operation elements, and pitch modulation control means for controlling to modulate a pitch of a musical tone generated by the sound source means in response to a pitch modulation output from the pitch modulation operation elements.

The pitch modulation operation element can be of a type of automatically returning to an original position after it is rotated or of a type which is kept at an angular position after rotation.

The pitch modulation operation element can include a plurality of operation elements whose functions are assigned to pitch modulation of the strings. The pitch modulation operation element may include a common operation element having a pitch modulation function for musical tones of all the strings.

The present invention is particularly suitable for a guitar type electronic stringed instrument. The present invention can also be applied to violin type electronic rubbed string instruments and electronic stringed instruments having a fretless fingerboard.

BRIEF DESCRIPTION OF THE DRAWINGS

The above and other objects, features and advantages of the invention will become apparent from the following description taken in conjunction with the accompanying drawings, in which:

FIG. 38B is a view showing some other screens in the function assignment mode;

FIG. 40 is a view showing some screens appearing on the display panel in an envelope setting mode;

FIG. 41 is a view showing some screens appearing on the display panel in an effect setting mode;

FIGS. 48A, 48B and 48C are graphs showing characteristics used in respective sections of the system shown in FIG. 47;

FIG. 49 is a functional block diagram of an electronic guitar for controlling a tone volume based on a vibration period of a string according to the present invention;

DETAILED DESCRIPTION OF THE PREFERRED EMBODIMENTS

Pitch Extraction Type Electronic Guitar

Figure 1:
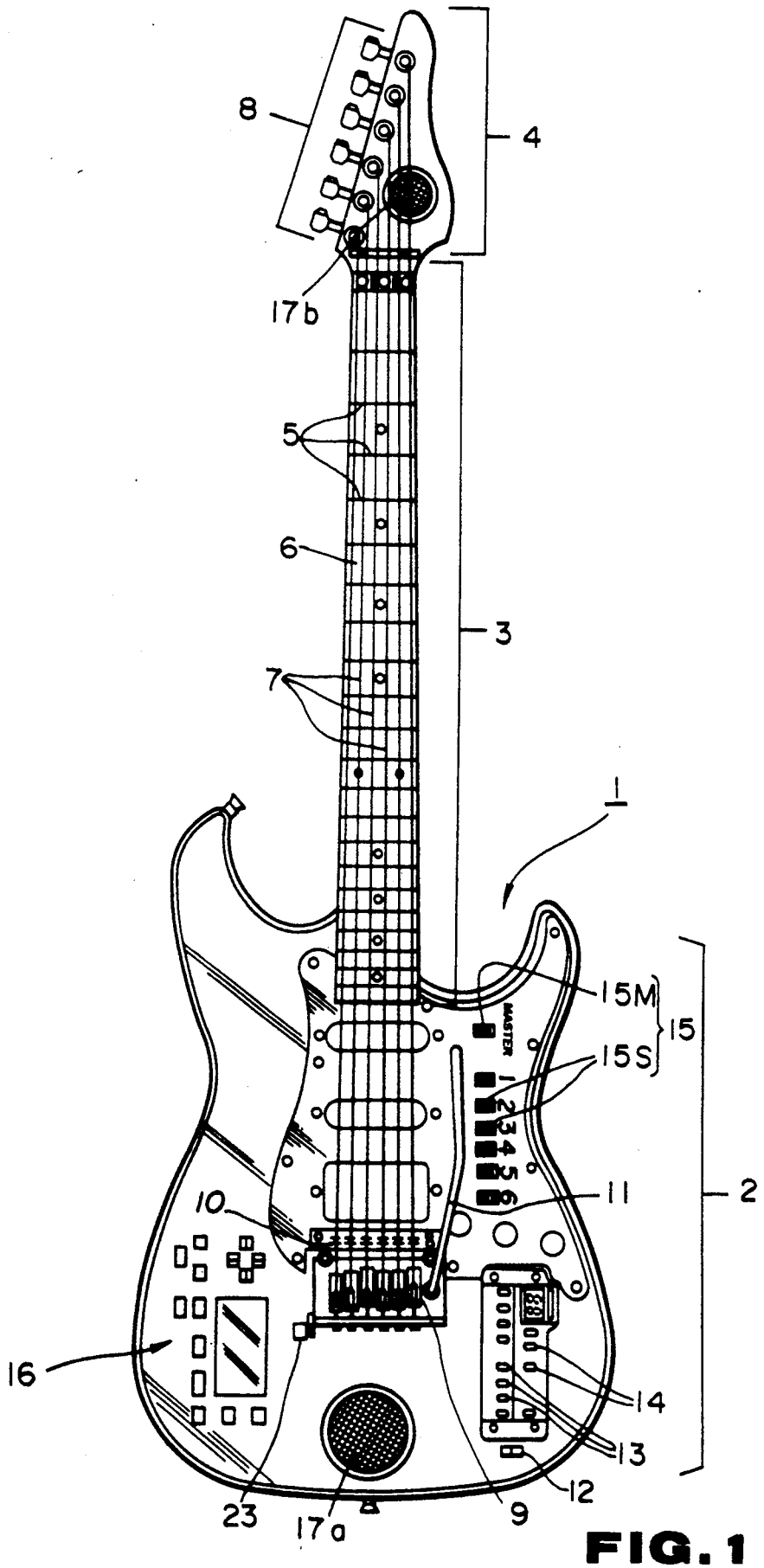
FIG. 1 is a view showing an outer appearance of a pitch extraction type electronic guitar to which the characteristic feature of the present invention is applied.

FIG. 1 shows pitch extraction type electronic guitar 1 to which the characteristic feature of the present invention is applied. The pitch extraction type electronic guitar is named after its pitch extraction means for extracting a fundamental frequency from a pickup signal of a string vibration for detecting a pressed fret position of a string. Like an acoustic guitar, electronic guitar 1 has body 2, neck 3 extending from body 2, and headstock 4 mounted at the distal end of neck 3. Fingerboard 6 on which frets 5 project is formed on the upper surface of neck 3. Six strings 7 are kept taut on the fingerboard, and one end of each string 7 is adjustably supported by corresponding peg 8 mounted on headstock 4, and the other end thereof is supported by bridge 9 attached to body 2. Magnetic or piezoelectric pickups 10 are arranged at positions on body 2 facing strings 7, thereby detecting vibrations of the strings. As will be described later, a vibration period (pitch) and string touch data indicating a plucking strength of a string are extracted from a picked up string vibration signal. Tremolo arm 11 is coupled to bridge 9, thereby increasing/decreasing the tension of strings 7, so that a pitch is changed according to vibrations of strings. The mechanism of tremolo arm 11 will be described in detail later.

Switches and the like are arranged on body 2. FIG. 1 illustrates power switch 12, tone color selection switches 13, effect mode selection switches 14, tuning operation elements 15, and tone setting panel 16. Effect mode selection switches 14 consist of a chorus switch, a delay switch tremolo switch, and a reverberation switch, and are used for selecting effects of a musical tone during performance. Tuning operation elements 15 consist of master operation element 15M for uniformly changing a pitch of musical tones of all the strings 7, and six tuning operation elements 15S for changing pitches of musical tones in units of strings Tuning operation elements 15 are not elements for influencing vibrations of strings 7 in a physical sense, but have a function of changing a pitch of an electronically generated musical tone with respect to strings 7. Tone parameter setting panel 14 is used for setting an effect parameter, an envelope parameter, and assigning a variable tone control function to performance operation elements (strings 7, tuning operation elements 15, tremolo arm 11, and the like) or performance sensors (pickups 10, tremolo arm sensor 23, and the like).

Two loudspeakers 17*a* and 17*b* respectively mounted on body 2 and headstock 4 convert an electronically generated musical tone signal into an acoustic signal, and produce an actual tone.

Tremolo Arm

Figure 2:
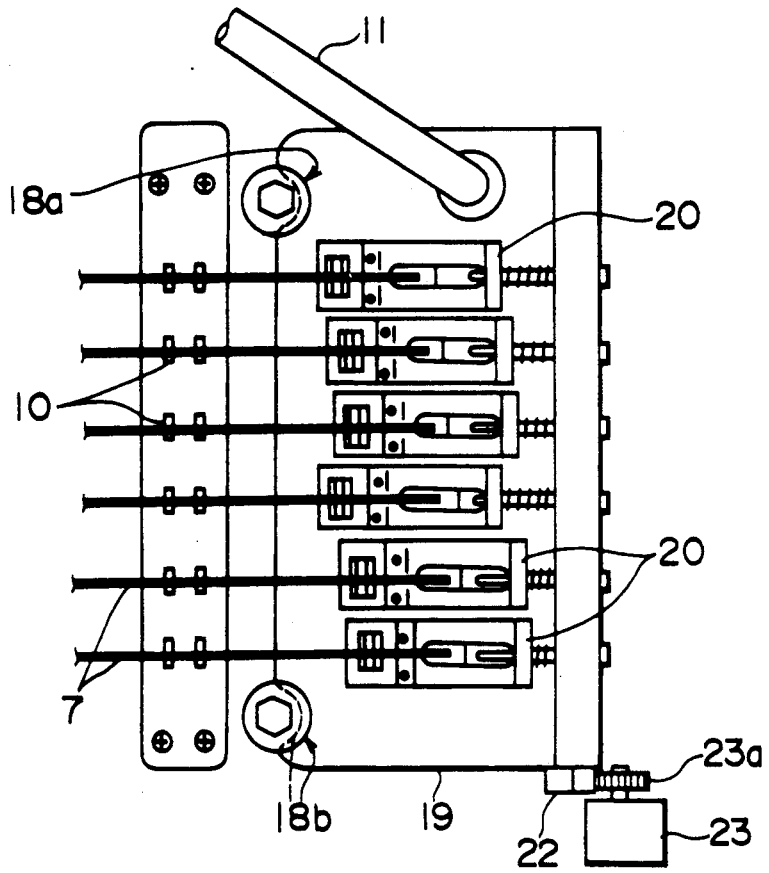
FIG. 2 is a plan view of a tremolo arm and a mechanism therearound.
Figure 3:
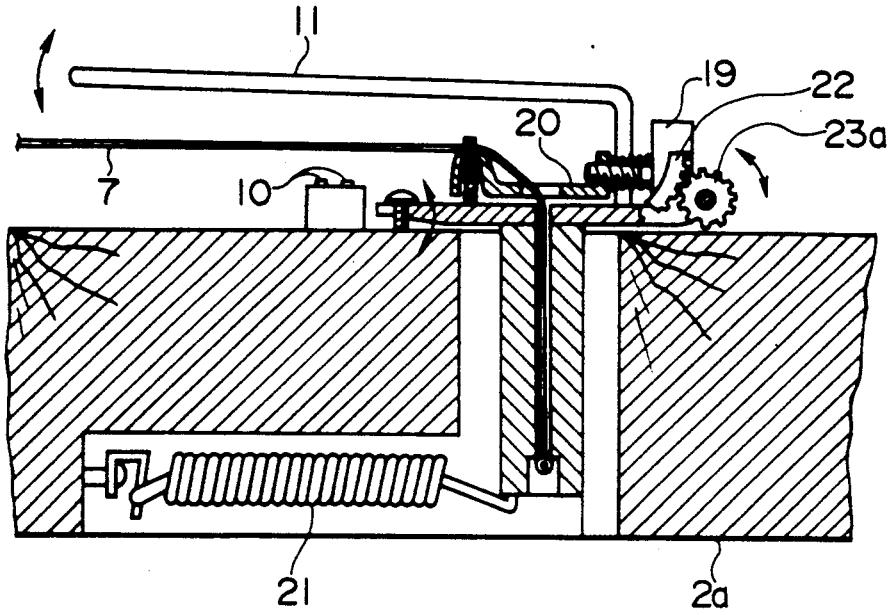
FIG. 3 is a partially cutaway side view of the tremolo arm mechanism.

FIGS. 2 and 3 show the arrangement of the tremolo arm mechanism. As shown in FIGS. 2 and 3, tremolo arm 11 is coupled to bridge base 19 which is pivotal about two fulcrums 18*a* and 18*b* provided to housing 2*a* of body 2. Bridge saddles 20 for supporting corresponding strings 7 are mounted on bridge base 19. In a normal state, bridge base 19 is balanced with the force of spring 21 provided between itself and the lower portion of the body housing, and the tension of strings 7. When tremolo arm 11 is operated, bridge base 19 is vertically pivoted about fulcrums 18*a* and 18*b*. Thus, the tensions of strings 7 are changed, and vibration frequencies of strings 7 are changed.

As will be described later, the vibration frequencies of strings 7 are extracted from the output signals of pickups 10. However, since the vibration frequencies of strings 7 can be changed without operating tremolo arm 11 (e.g., by changing a pressing position of string 7 or bending string 7), an operation amount of tremolo arm 11 itself cannot be detected from the output signal from each pickup 10. Therefore, a tremolo arm sensor for detecting an operation amount of tremolo arm 11 itself is preferably arranged. In the illustrated embodiment, rack 22 is mounted on the side surface of bridge base 19, which is separated far from fulcrums 18*a* and 18*b*, and variable-resistor type tremolo arm sensor 23 having gear 23*a* which can be engaged with rack 22 is provided at a position of body housing 2*a* opposing rack 22. Rack 22 is moved upon operation of tremolo arm 11, so that an output voltage from tremolo arm sensor 23 is changed.

Tuning Operation Element

Figure 5:
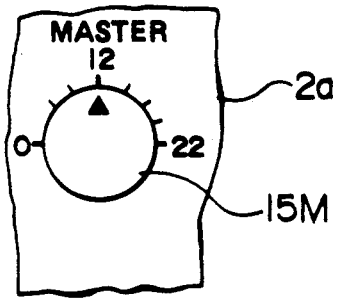
FIG. 5 is a view showing an outer appearance of another tuning operation element.
Figure 4:
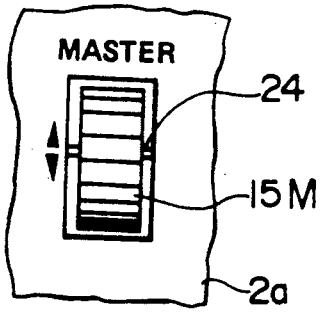
FIG. 4 is a view showing an outer appearance of a tuning operation element.

FIG. 4 shows an arrangement of tuning operation elements 15. Tuning operation element 15M is rotatable about shaft 24 provided to housing 2*a*, and is automatically returned to a home position by the biasing force of a spring (not shown) after operation. FIG. 5 shows another arrangement of tuning operation elements 15. Tuning operation element 15M is rotatably supported on housing 2*a*, so that it is left in position after it is turned to an appropriate position. Tuning operation element 15M may be of a slider type.

Tone Parameter Setting Panel

Figure 6:
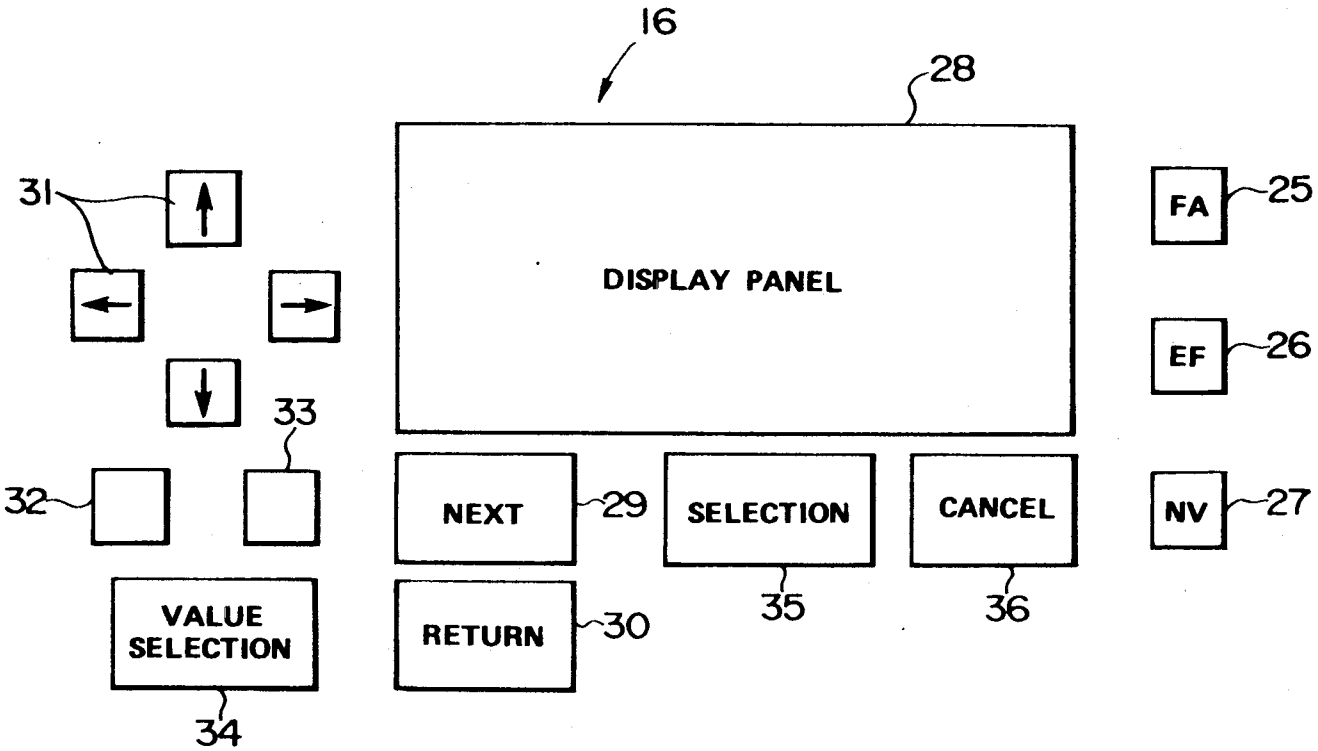
FIG. 6 is a view showing an outer appearance of a tone parameter setting panel.

FIG. 6 illustrates an arrangement of the tone parameter setting panel. As described above, the tone parameter setting operation includes three modes, i.e., a function assignment mode for assigning a tone control function to each type of performance input (e.g., vibration period, plucking strength of a string, an operation amount of the tremolo arm), an effect setting mode for setting an effect parameter, and an envelope setting mode for setting an envelope parameter. These modes can be selected by function assignment mode key (FA) 25, effect setting key (EF) 26, and envelope setting key (NV) 27. Display panel 28 displays screens for setting tone parameters. Screens are updated by next key 29, and are returned by return key 30. The position of a screen cursor is controlled by cursor key 31. Up key 32 is used for incrementing a data value and down key 33 is used for decrementing a data value. A desired data value is selected by numerical value selection key 34. A desired function is selected by selection key 35. Set parameters are canceled by cancel key 36.

Overall Circuit Arrangement

Figure 7:
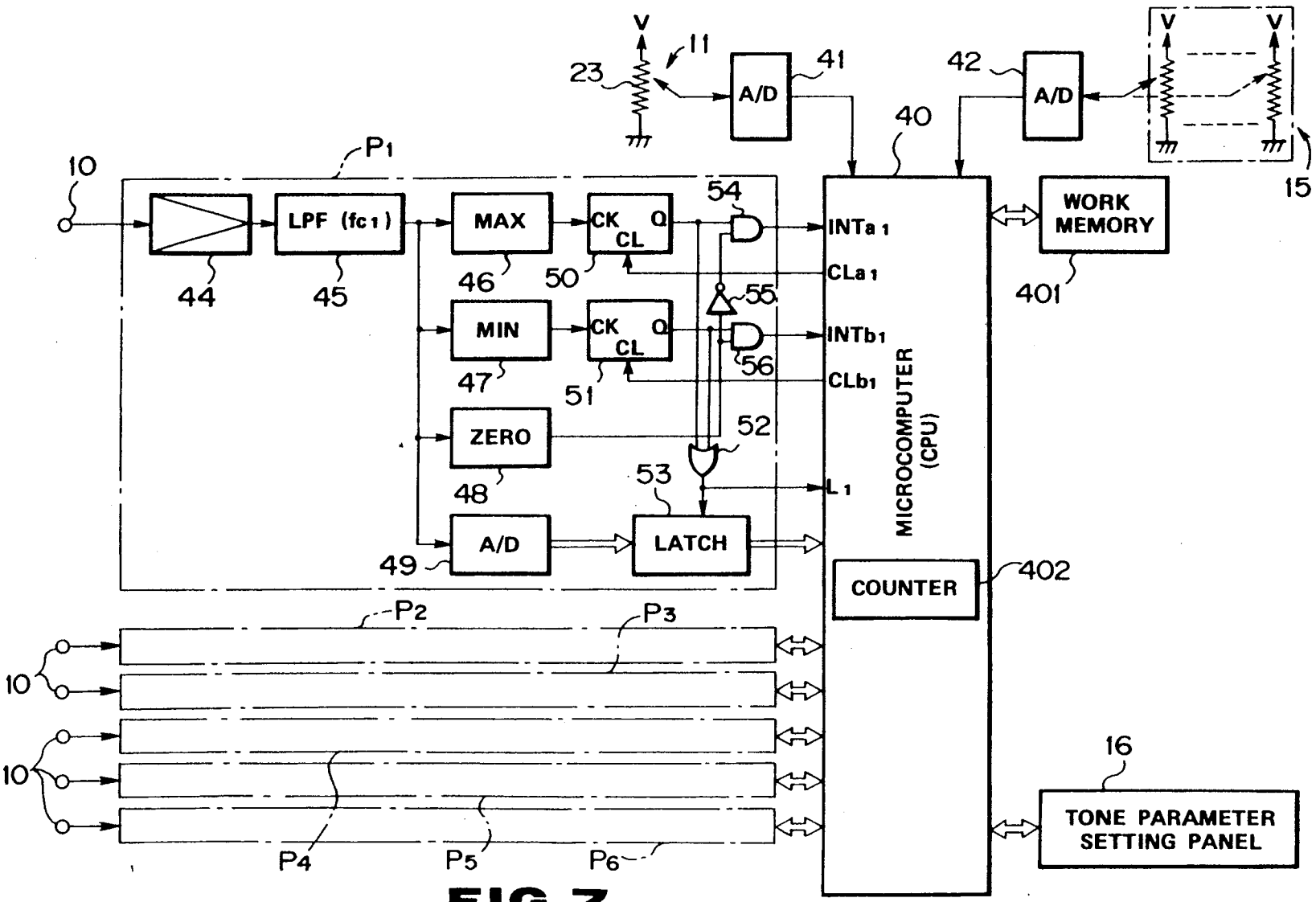
FIG. 7 is a view showing a part of the overall circuit arrangement of the pitch extraction type electronic guitar.
Figure 8:
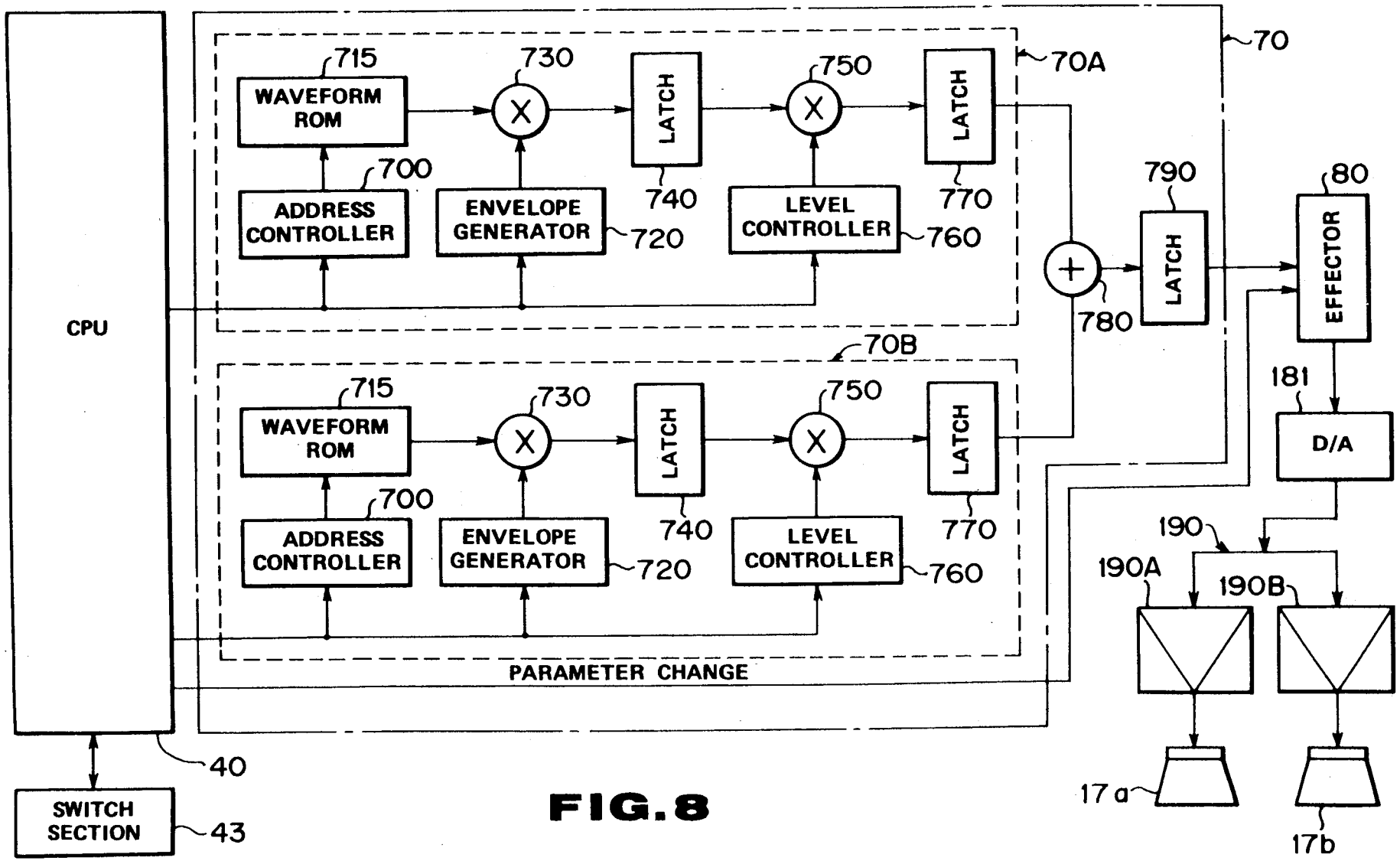
FIG. 8 is a view showing a remaining part of the overall circuit arrangement of the pitch extraction type electronic guitar.

FIGS. 7 and 8 show the overall circuit arrangement of the pitch extraction type electronic guitar shown in FIG. 1. As shown in FIGS. 7 and 8, the performance operation elements, and input devices are coupled to microcomputer (CPU) 40 through appropriate interfaces. More specifically, a signal from sensor 23 for tremolo arm 11 is converted to a digital signal by A/D converter 41, and is input to CPU 40. A signal from tuning operation element 15 is converted to digital signal by A/D converter 42, and is input to CPU 40. Tone parameter setting panel 16 is also connected to CPU 40, and a set tone parameter is stored in a memory of CPU 40. Block 43 inclusively expresses other switches (tone color selection switches 13, effect mode selection switches 14, and the like) arranged on the body of the guitar. The switch state of switch section 43 is also monitored by CPU 40. A string vibration signal from each pickup 10 is pre-processed by pitch extraction circuit P1 (to be described in detail later), and is then input to CPU 40. CPU 40 extracts a vibration period of each string 7 from the pre-processed pickup signal, and also extracts a plucking strength (string touch data) of each string 7.

CPU 40 controls sound source 70 and effect addition section (effector) 80 based on the data set by tone parameter setting panel 16 and performance inputs from these performance operation elements Sound source 70 is a polyphonic PCM (PULSE CODE MODULATION) sound source (to be described later in detail), and can generate one musical tone by mixing two tone colors. The output from sound source 70 is supplied to effector 80, thus giving an effect to the musical tone. As will be described later in detail, effector 80 is also a polyphonic digital effector which is time-divisionally operated, and can give an independent effect in units of tone channels. The output from effector 80 is converted to an analog signal by D/A converter 181, and is supplied to left and right audio circuits 190A and 190B of stereophonic sound system 190. As a result, an actual musical tone is generated through loudspeakers 17*a* and 17*b*.

Pitch Extraction Circuit

Pitch extraction circuits P1 to P6 will be described below in detail.

Figure 9:
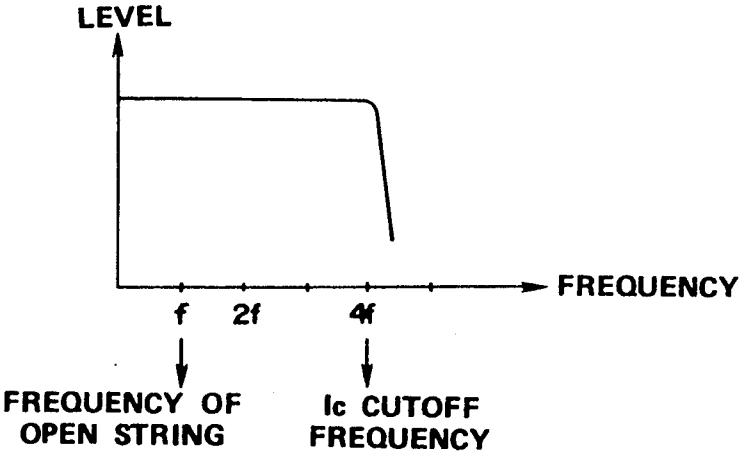
FIG. 9 is a graph showing characteristics of a low-pass filter used in a pickup signal processor.

As shown in FIG. 7, the string vibration signals from pickups 10 are input to pitch extraction circuits (pickup signal processors) P1 to P6. Pitch extraction circuits P1 to P6 are circuits for extracting fundamental periods of vibrations and plucking strengths of corresponding strings 7. First, a signal from each pickup 10 is amplified by amplifier 44. The amplified signal is input to low-pass filter (LPF) 45, and an unnecessary high-frequency component is removed thereby. As shown in FIG. 9, the characteristics of LPF 45 are set so that its cut-off frequency is about 4 times a fundamental vibration frequency in an open string state of each string. This is based on the fact that the tone range of each string corresponds to 2 octaves. The output from LPF 45 is supplied to maximum peak detection circuit (MAX) 46, negative minimum peak detection circuit (MIN) 47, zero-crossing detection circuit (Zero) 48, and A/D converter 49.

MAX 46 detects that the pickup signal has reached a maximum (positive) peak value, and sets flip-flop 50 by its detection signal. MIN 41 detects that the pickup signal has reached a minimum (negative) peak value, and sets flip-flop 51 by its detection signal. Zero 48 detects a zero-crossing of a pickup signal.

Figure 10:
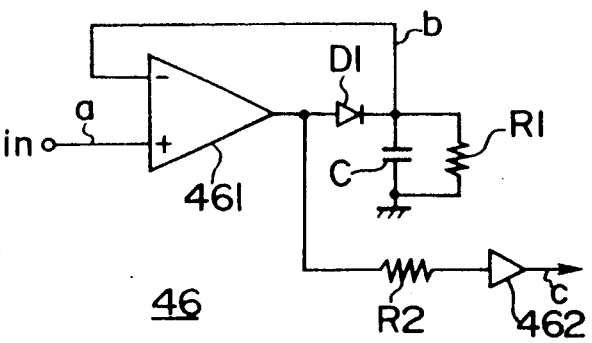
FIG. 10 is a circuit diagram of a positive peak detector used in the pickup signal processor.

FIG. 10 shows MAX 46 in detail. The signal from LPF 43 is input to the non-inverting input of operational amplifier 461. The output terminal of operational amplifier 461 is connected to the anode of diode D1, and the cathode of diode D1 is grounded through a parallel circuit of capacitor C and resistor R1, and is fed back to the inverting input of operational amplifier 461. The output from operational amplifier 461 is supplied to flip-flop 50 through resistor R2 and driver 462.

Figure 11:
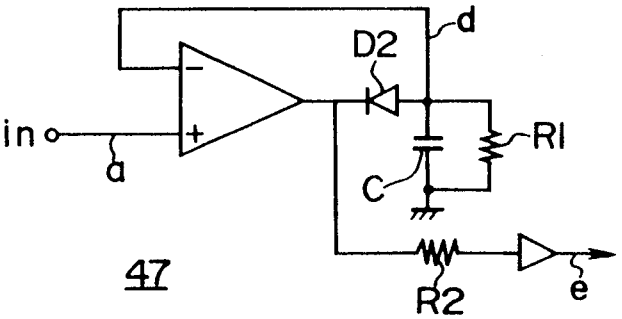
FIG. 11 is a circuit diagram of a negative peak detector used in the pickup signal processor.

FIG. 11 shows MIN 47 in detail. The arrangement of MIN 47 is substantially the same as that of MAX 46, except that a diode is connected in the reverse direction, as indicated by reference symbol D2.

Figure 12:
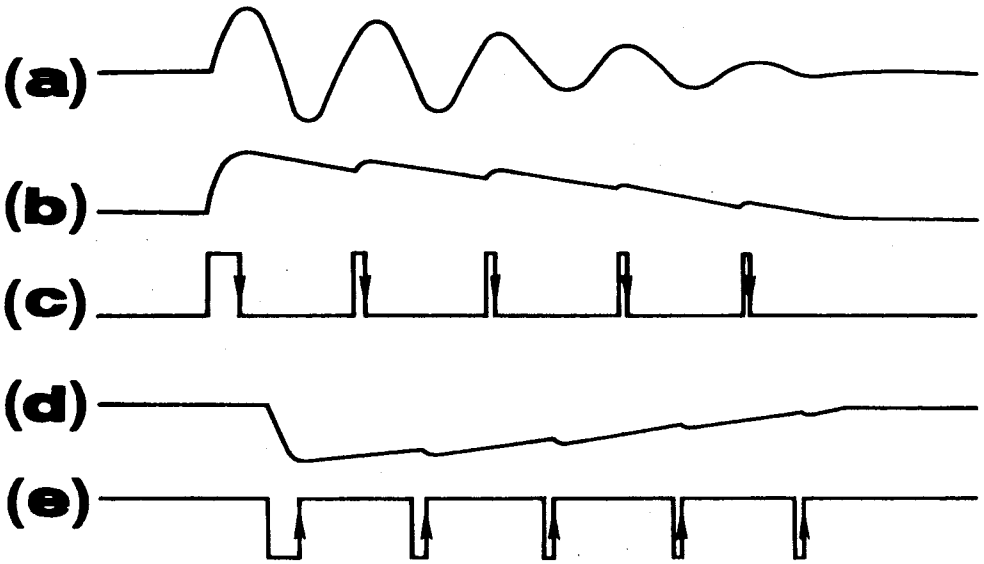
FIG. 12 is a timing chart of signals in the peak detector.

The operations of MAX 46 and MIN 47 can be easily understood from the timing chart shown in FIG. 12.

Figure 13:
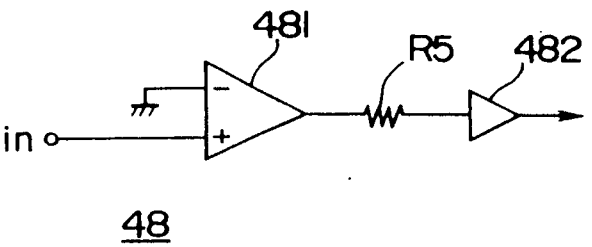
FIG. 13 is a circuit diagram of a zero-crossing detector used in the pickup signal processor.

FIG. 13 illustrates the arrangement of Zero 48. Operational amplifier 481 serves as a comparator, and receives the signal from LPF 45 at its non-inverting input and a zero-crossing at its inverting input. The output from operational amplifier 481 serves as a zero-crossing output through resistor R5 and driver 482.

Referring back to FIG. 7, the maximum peak timing signal of the pickup signal detected by MAX 46 sets flip-flop 50, and changes its output to "High" level. The "High"-level signal is supplied to latch 53 through OR gate 52. As a result, maximum peak data from A/D converter 49 is latched by latch 53. The output from OR gate 52 is supplied to CPU 40 as latch interrupt signal L1. In response to this, CPU 40 fetches data from latch 52. The "High"-level output from flip-flop 50 enables AND gate 54. When a signal zero-crosses negatively, AND gate 54 receives a signal supplied from Zero 48 and is completely enabled. Then, AND gate 54 supplies, to CPU 40, interrupt signal $INT_{a1}$ indicating that the signal zero-crosses after it passes a maximum peak. Upon reception of this signal, CPU 40 resets corresponding flip-flop 50, and executes interrupt processing (to be described later). Meanwhile, when a minimum peak of the pickup signal is detected by MIN 47, flip-flop 51 is reset by this detection signal, and its output provides latch interrupt signal L1 to CPU 40 through OR gate 52 and causes latch 53 to latch minimum peak data from A/D converter 49. In addition, AND gate 56 is enabled by the output from flip-flop 51. Thereafter, AND gate 56 is completely enabled by a signal supplied from Zero 48 when the pickup signal zero-crosses from negative to positive, and supplies interrupt signal $INT_{b1}$ indicating that the pickup signal zero-crosses after it passes the negative peak. In response to this, CPU 40 resets corresponding flip-flop 51, and executes interrupt processing (to be described later).

Pickup Processing

Pickup signal processing executed by CPU 40 will be described below.

Figure 14:
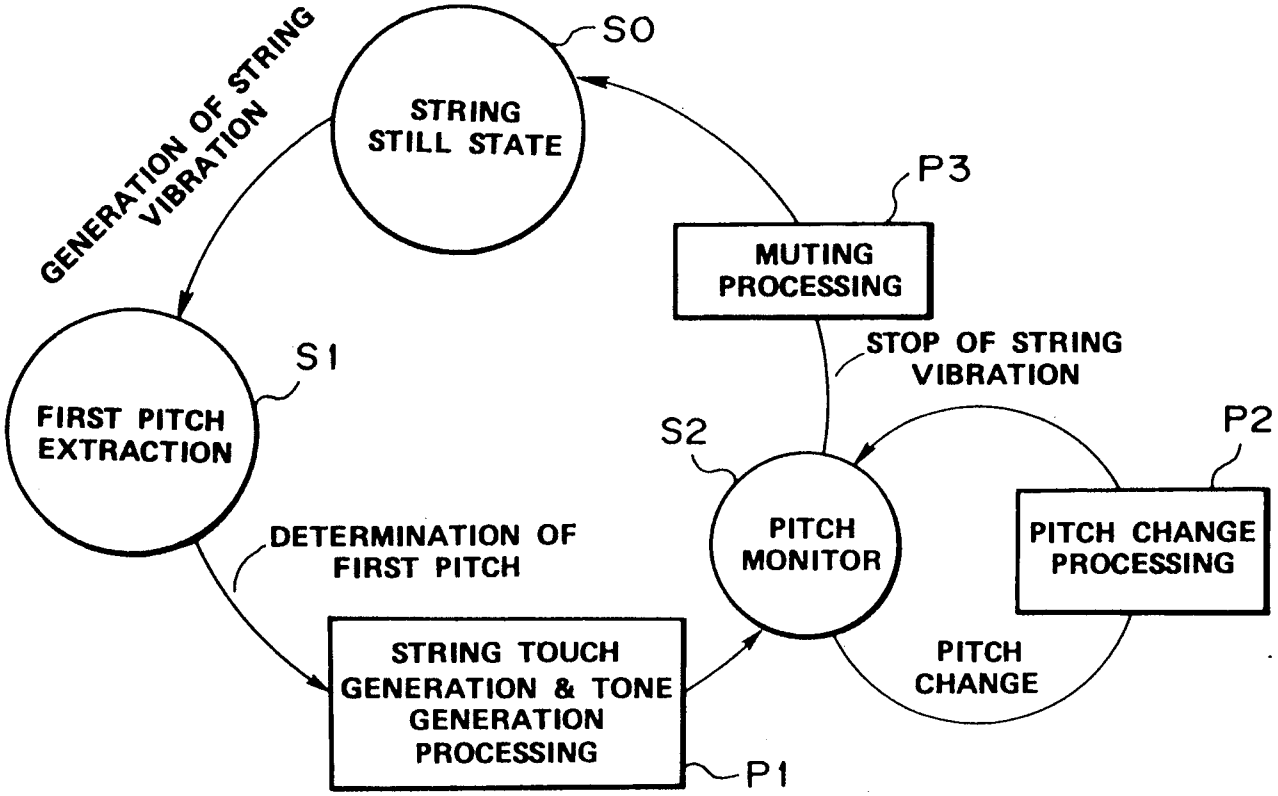
FIG. 14 is a transition chart of modes associated with a pickup operation.

FIG. 14 is a mode transition chart of CPU 40 associated with strings 7. State S0 is a mode corresponding to a still state of each string 7. When generation of a vibration of a string is detected, this mode is shifted to mode S1 of extracting a first string vibration period. When a period of a first string vibration is established, string touch data is generated, and tone generation processing (P1) is executed. Thereafter, the mode is shifted to mode S2 of monitoring a string vibration period. In monitor mode S2, when the vibration period of the string is changed, processing for changing a pitch of a musical tone is executed (P2). When the vibration of a string is stopped, CPU 40 executes muting processing (P3), and the mode returns to mode S0 corresponding to the still state of the string.

Figure 15:
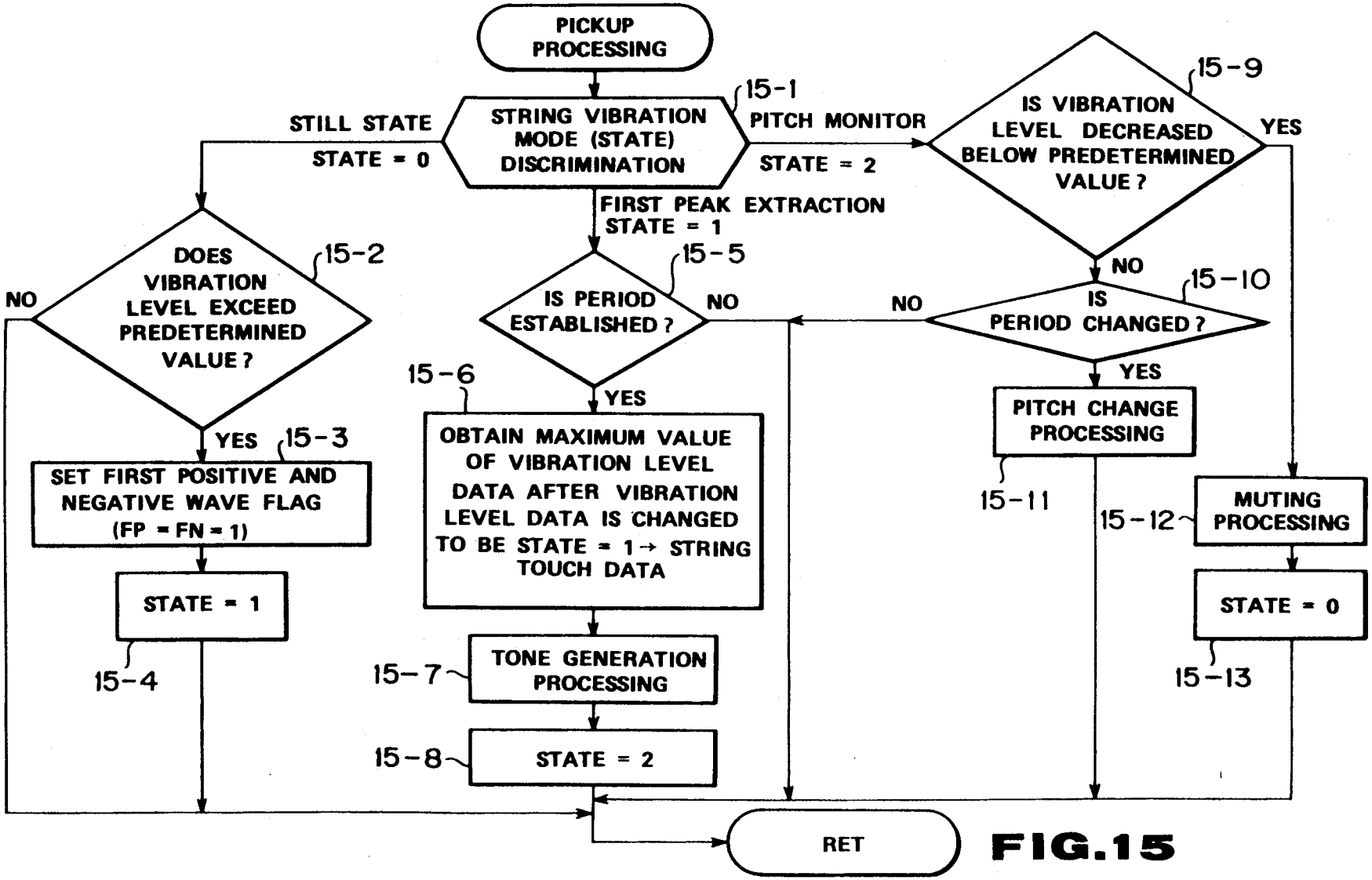
FIG. 15 is a flow chart of pickup processing.

FIG. 15 shows a pickup processing routine executed by CPU 40. In step 15-1, a string vibration mode is discriminated. Steps 15-2 to 15-4 correspond to processing in the still mode of the string; steps 15-5 to 15-8, processing in the extraction mode of the first vibration period of the string; and 15-9 to 15-13, processing in the monitor mode of the string vibration period. In this case, the start of vibration of each string 7 is detected when a vibration level exceeds a predetermined level (15-2), and the end of the string vibration is detected when the vibration level is decreased below the predetermined value. Vibration level data determined in steps 15-2 and 15-9 is a present peak (amplitude) of the pickup signal which is fetched from latch 53 by CPU 40 in response to latch interrupt signal L. In the latch interrupt processing, CPU 40 fetches the content of latch 53, and stores (pushes) it in a vibration level stack on work memory 401. The stored data is checked in step 15-2 and 15-9. First wave flags FP and FN in step 15-3 will be referred to in interrupt processing of period measurement to be described next. In step 15-6, the plucking strength of a string (string touch data) is given by a maximum amplitude value of the string vibration pickup signal which is sampled during an interval from when the string vibration starts to when the first vibration period is determined.

Figure 16:
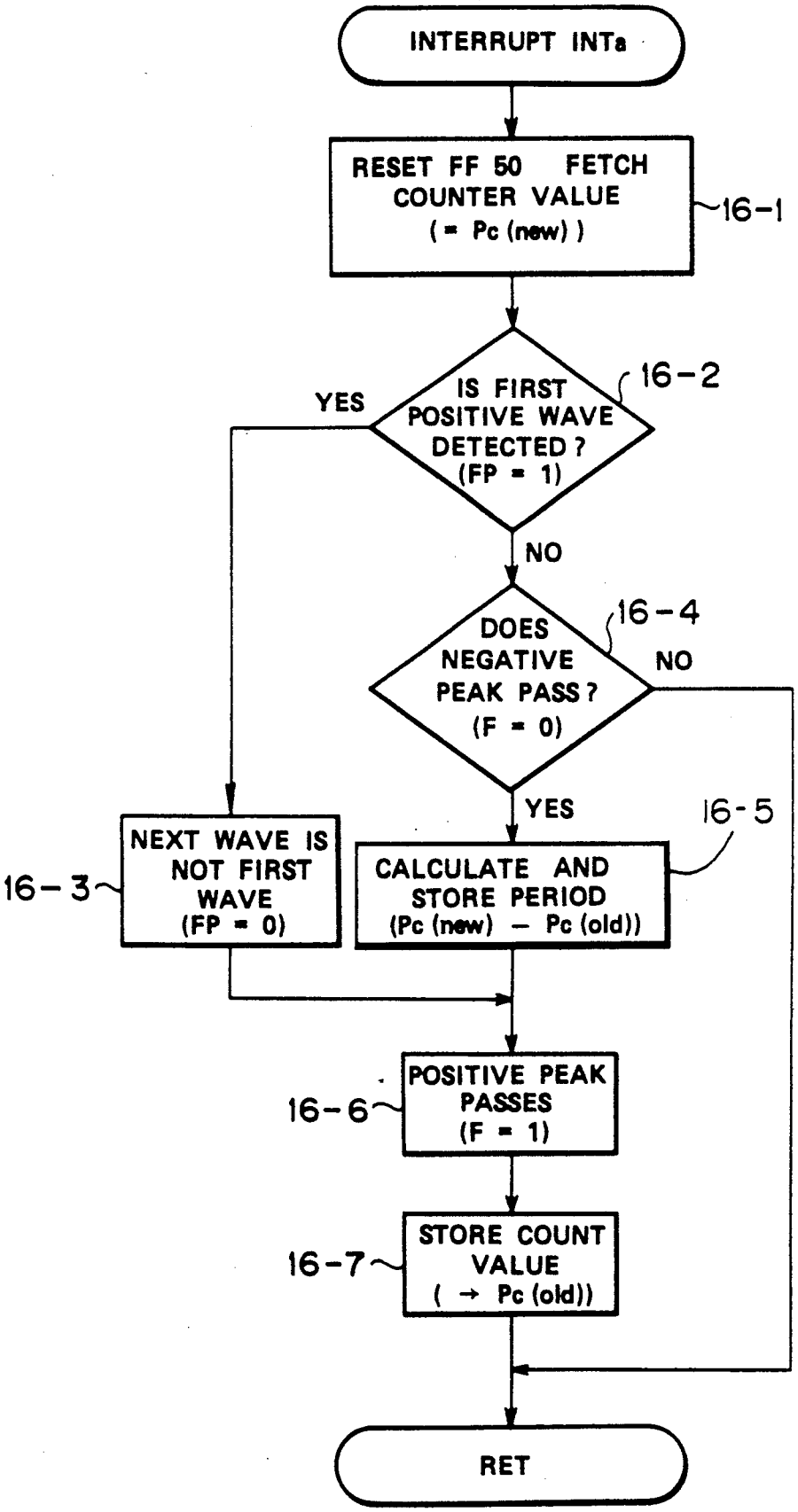
FIG. 16 is a flow chart of interrupt INTa.
Figure 17:
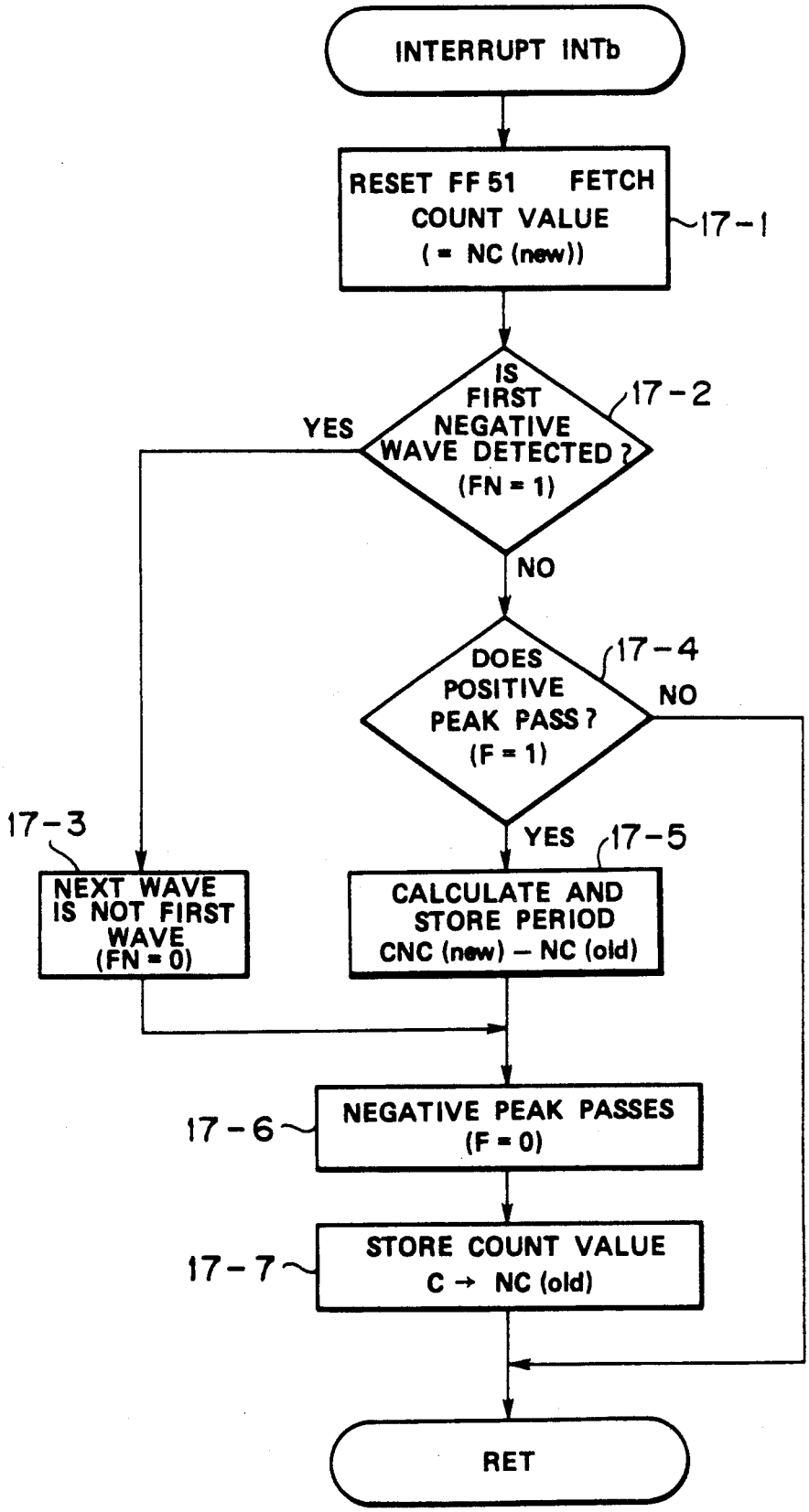
FIG. 17 is a flow chart of interrupt INTb.

FIGS. 16 and 17 show the flow of measurement of the vibration period of each string 7, executed in interrupt processing operations INTa and INTb. In this flow, under the condition in that a peak of an opposite polarity is present between a peak of a pickup signal and a next peak of the same polarity, a time from a first zero-crossing after the peak of the pickup signal to a first zero-crossing after the next peak of the same polarity is measured to obtain a period of a fundamental frequency of the string vibration. This method can effectively eliminate an influence of harmonics included in the string vibration.

Counter 402 shown in FIG. 7 is a free-running counter. A count value of counter 402 is read by CPU 40 when the pickup signal first zero-crosses after its peak (upon generation of interrupt signals INTa and INTb) (16-1 and 17-1), and is stored in work memory 401 (16-7 and 17-7) under the condition whether the pickup signal corresponds to a first wave or a peak of the opposite polarity has already passed after the preceding peak of the same polarity In the latter case, the preceding count value stored in work memory 401 is read out, and a difference between the preceding and present count values is calculated to generate vibration period data. The vibration period data is written in work memory 401 (16-5 and 17-5).

Figure 18:
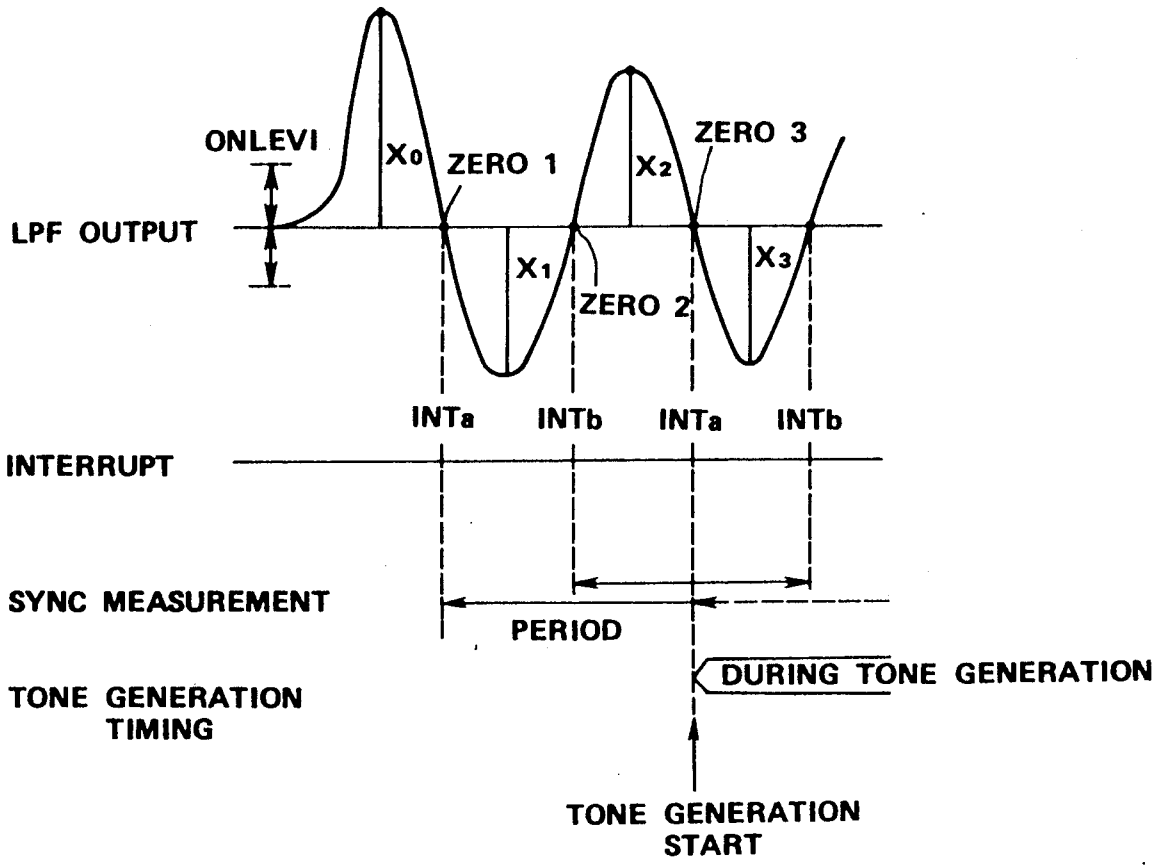
FIG. 18 is a timing chart of pitch extraction.

FIG. 18 shows a timing chart of pitch extraction for reference.

A measurement program of a vibration period shown in FIGS. 16 and 17 can be easily modified. In one program, a time between the peaks of the same polarity is measured without measuring a time between zero-crossings. In this case, Zero 48 and associated circuit elements can be omitted. In another program, a ratio of a positive peak to negative peak of the pickup signal is utilized for accurate vibration period measurement. For example, under the condition that a negative peak having passed between a positive peak and the next positive peak has a value larger than a predetermined ratio with respect to the positive peak, a time between the positive peaks is determined as a vibration period. A vibration period other than the first vibration period can be determined from measurement values of a plurality of vibration periods.

Sound Source

PCM sound source 70 will be described in detail below. FIG. 8 illustrates sound source 70 divided into first sound source 70A for generating a first tone color and second sound source 70B for generating a second tone color in order to show that sound source 70 can mix two tone colors to generate a musical tone of each string. In practice, sound source 70 is constituted by hardware which realizes a plurality of sound source modules by time-division (TOM), and the number of sound source modules (channels) is more than (the number of strings) x (the number of tone colors/the number of strings).

Address controller 700 of sound source 70A or 70B supplies a read address to waveform ROM (Read Only Memory) 715 based on control data transferred from CPU 40. Waveform ROM 715 stores waveforms of a plurality of musical tones. Of course, a musical tone waveform read out by address controller 700 of first sound source 70A from waveform ROM 715 is different from that read out b address controller 700 of second sound source 70B from waveform ROM 715. Waveform data read out from waveform ROM 715 is input to multiplier 730, and is multiplied with an envelope output from envelope generator 720. The product is supplied to latch 740. The output from latch 740 is multiplied with a level signal output from level controller 760, and the product is supplied to latch 770. Level controllers 760 of first and second sound sources 70A and 70B are independently controlled by CPU 40, so that a mixing ratio of the two tone colors is controlled. The outputs from latches 770 of first and second sound source modules 70A and 70B are mixed by adder 780, and the mixed output is supplied to effector 80 through latch 790.

Figure 19:
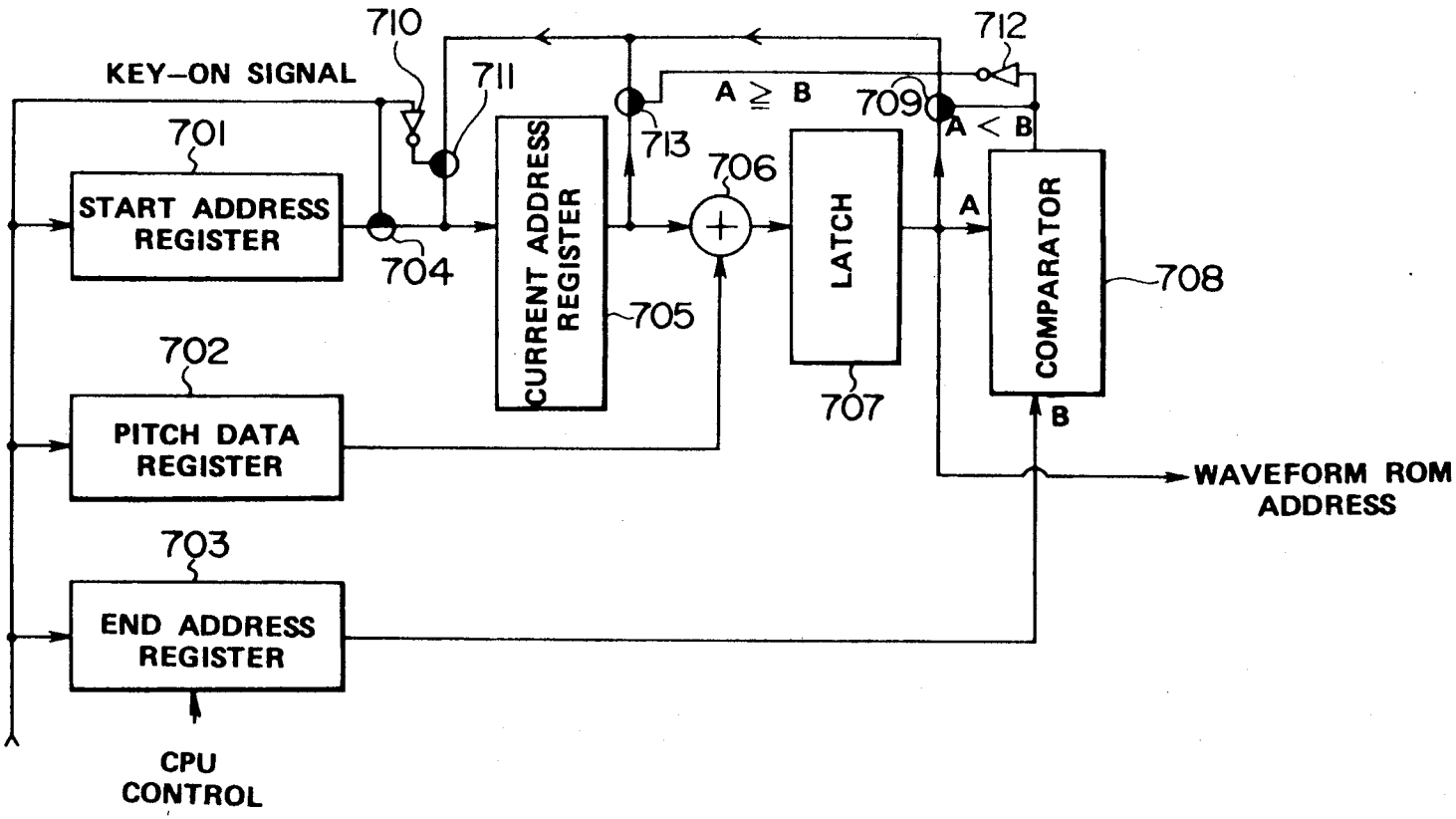
FIG. 19 is a block diagram of an address control unit of a sound source.

FIG. 19 shows an example of address controller 700 of sound source 70. In FIG. 19, start address register 701 is a register for storing a start address of musical tone waveform data stored in waveform ROM 715, pitch data register 702 is a register for storing pitch data for controlling a readout speed of a musical tone waveform, and end address register 703 is a register for storing an end address of musical tone waveform data. The contents of these registers are controlled by CPU 40. Address data in start address register 701 is stored in current address register 705 through gate 704 which is enabled in response to a key-on signal supplied from CPU 40. The data in current address register 705 is added to pitch data in pitch data register 70 by adder 706, and the sum data is supplied to latch 707. The pitch data is determined based on a frequency of an output tone, and the updating rate of addresses is determined by this value. The content of latch 707 is compared with end address data in end address register 703 by comparator 708, and is also supplied to waveform ROM 715 as a read address. The current address data in latch 707 is returned to current address register 705 through gate 709 which is controlled to be enabled when address data does not exceed the end address based on the comparison result from comparator 708 and through gate 711 which is controlled to be enabled in response to a signal obtained by inverting the key-on signal by inverter 710 When the current address coincides with or exceeds the end address, address data in current address register 705 is returned from gate 711 to current address register 705 through gate 713 which is controlled by a signal obtained by inverting the comparison result of comparator 708 by inverter 712. Therefore, address updating is interrupted.

Figure 20:
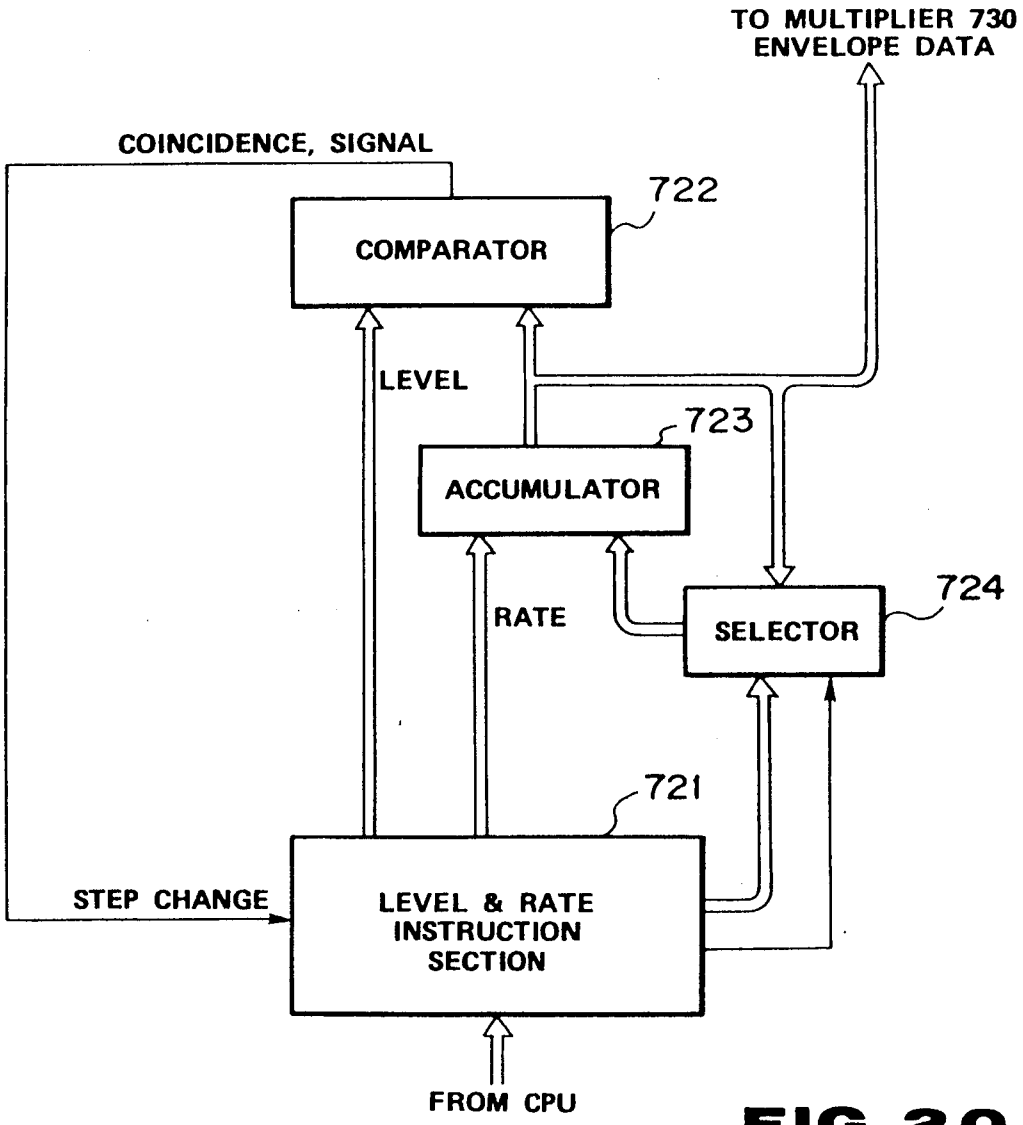
FIG. 20 is a block diagram of an envelope generator of a sound source.

FIG. 20 illustrates envelope generator 720 of sound source 70. A rate of each step (segment) of an envelope and a parameter representing a level or sustain is set in level & rate instruction section 721 by CPU 40. During operation, first, level & rate instruction section 721 sets an initial value of the envelope in accumulator 721 through selector 724, and supplies the level (target value) and rate of the first step to comparator 722 and accumulator 723. Accumulator 723 accumulates the rate from level & rate instruction section 721 to generate envelope data, and supplies the data to multiplier 730 of sound source 70. The output envelope from accumulator 723 is also supplied to comparator 722, and is compared with the target level of the current step from level & rate instruction section 721. When the envelope coincides with the target level, comparator 722 sends a step updating signal to level & rate instruction section 721. In response to this, level & rate instruction section 721 reads out rate and level data of the next step, and supplies them to accumulator 723 and comparator 722. In the sustain step, level & rate instruction section 721 supplies a "zero" rate to accumulator 723. Thus, the envelope is fixed. In a key-off state, CPU 40 supplies a control signal to level & rate instruction section 721. In response to this, section 721 outputs the rate and level data of the final step, and supplies them to accumulator 723 and comparator 722.

Effector

Effector 80 will be described below.

Figure 21:
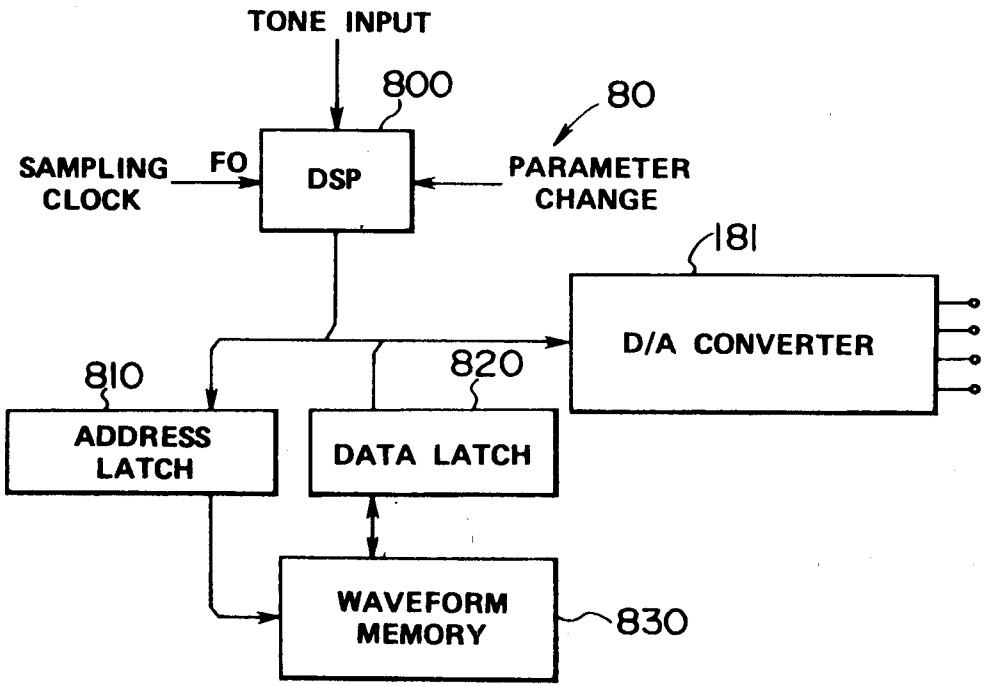
FIG. 21 is a diagram of an effector.

FIG. 21 is a block diagram of effector 80 for performing effect addition processing. In FIG. 21, DSP (digital sound processing hardware) 800 fetches a musical tone signal in units of channels supplied from sound source 70 based on a predetermined sampling clock, performs effect addition processing (to be described later), and outputs the signal to D/A converter 181. Waveform memory 830 is a memory for storing the input musical tone signal data under the control of DSP 800. Memory 830 receives write and read addresses from address latch 810, and data to be written therein or to be read out therefrom is stored in data latch 820. DSP 800 has a parameter memory (not shown) for storing various control parameters for effect addition to be described later.

Figure 22:
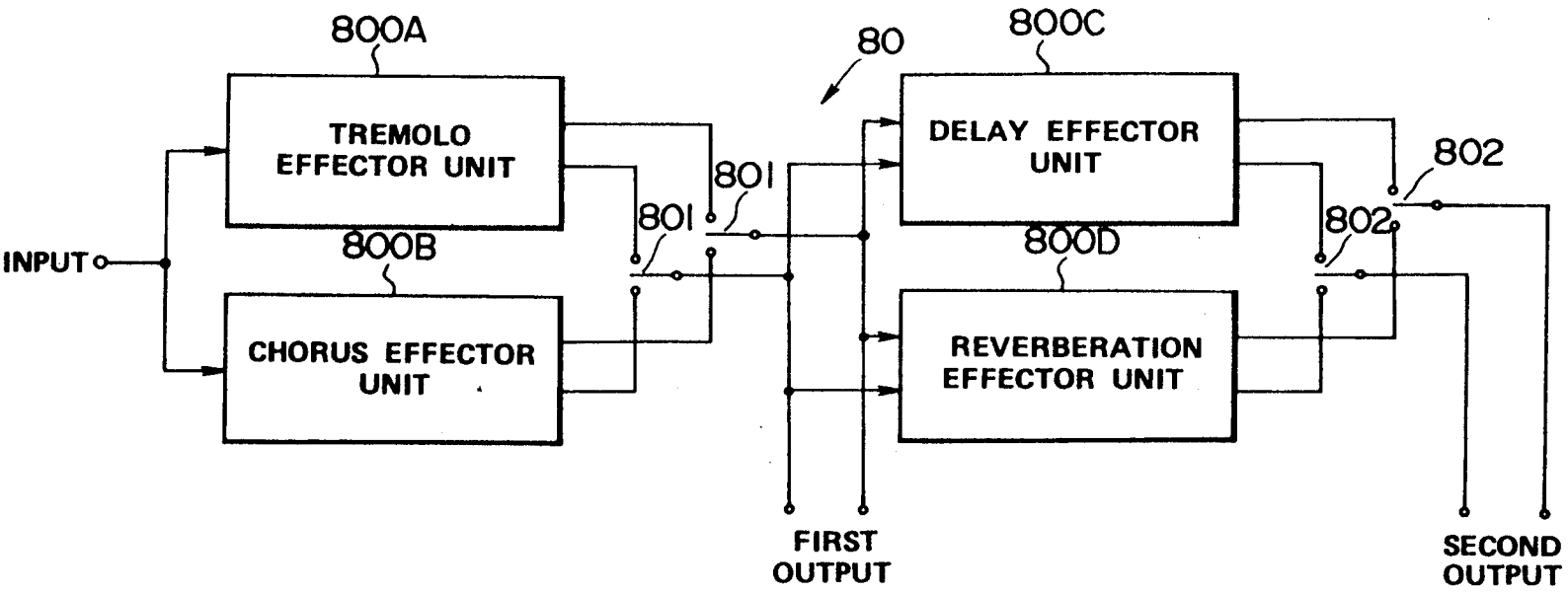
FIG. 22 is a functional block diagram of the effector.

FIG. 22 is a functional block diagram of effector 800. In FIG. 22, input signal data is subjected to corresponding processing in tremolo effector unit 800A and chorus effector unit 800B, thus obtaining two stereophonic outputs from each unit. The output terminals of tremolo and chorus effector units 800A and 800B are connected to switches 801 for switching the two outputs to the first output terminal side and 2-input delay effector unit 800C and reverberation effector unit 800D. Delay and reverberation effector units 800C and 800D perform corresponding processing to obtain two stereophonic outputs from each unit. The output terminals of delay and reverberation effector units 800C and 800D are connected to switches 802 for switching the two outputs to the second output terminal side. These switches 801 and 802 correspond to effect selection mode switches 14 (FIG. 1).

Figure 23:
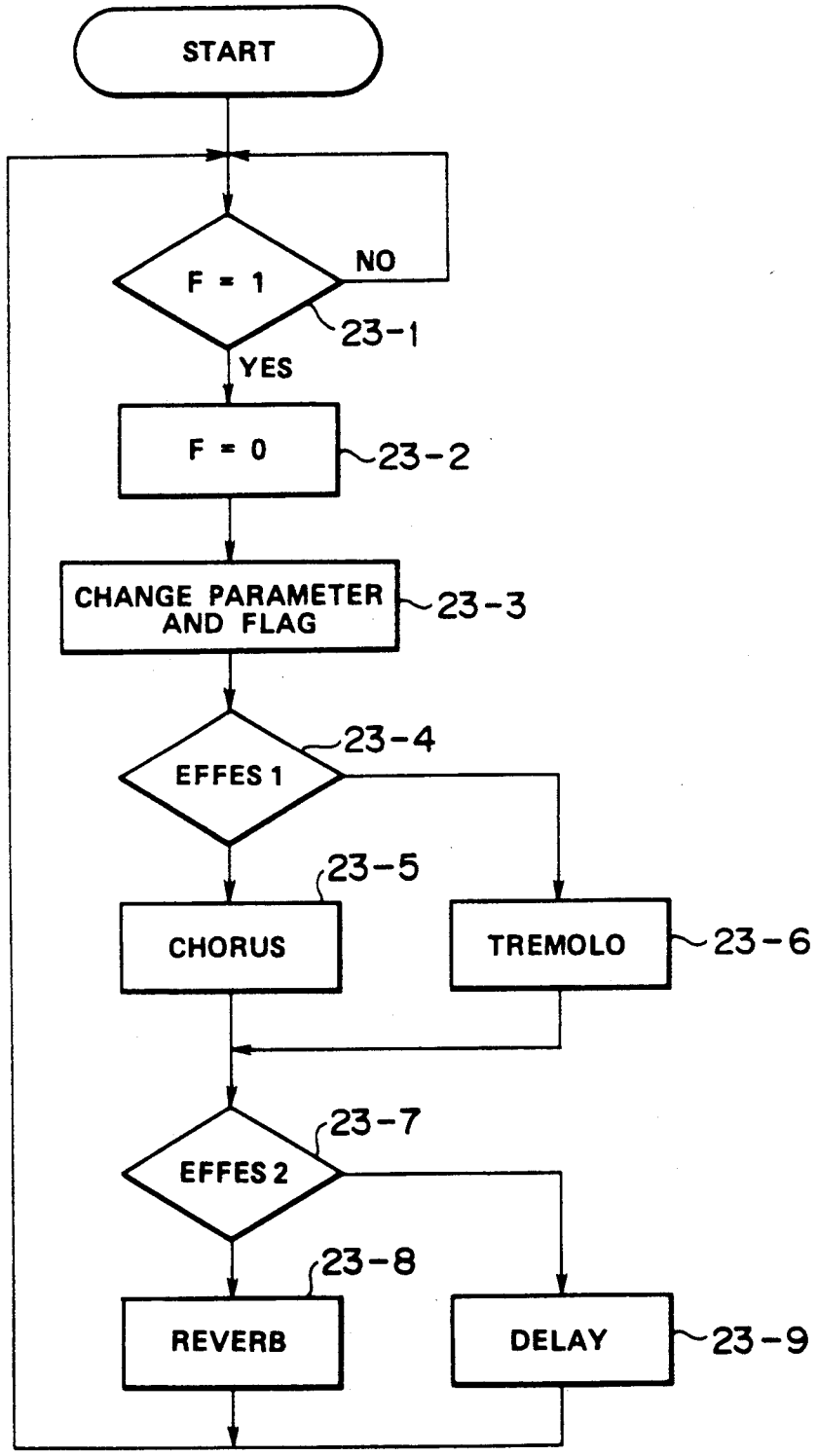
FIG. 23 is a schematic flow chart of an operation of the effector.

FIG. 23 shows the flow of effect addition processing executed by DSP 800. In DSP 800, flag F goes to "1" in response to an external sampling clock. In step 23-1, it is checked if flag F is "1". If F=1 in step 23-1, F=0 in step 23-2. In step 23-3, updating processing of parameters and flags for effect addition supplied from CPU 40 is performed. This updating processing is executed such that one parameter or flag is updated upon each sampling or is updated to be interpolated between predetermined sampling clocks based on an input target value of a parameter to be updated. In step 23-4, it is checked if effect selection signal EFFES1 supplied from CPU 40 indicates a chorus or tremolo mode. If the chorus mode is detected, chorus processing (CHORUS) by chorus effector unit 800B shown in FIG. 22 is executed in step 23-5. If the tremolo mode is detected, tremolo processing (TREMOLO) by tremolo effector unit 800A is executed in step 23-6. In step 23-7, it is checked if effect selection signal EFFES2 supplied from CPU 40 indicates a reverberation or delay mode. If the reverberation mode is detected, reverberation processing (REVERB) by reverberation effector unit 800D is executed in step 23-8. If the delay mode is detected, delay processing (DELAY) by delay effector unit 800C is executed in step 23-9. The flow returns to step 23-1, and the similar processing is repeated in response to each sampling clock.

Figure 24:
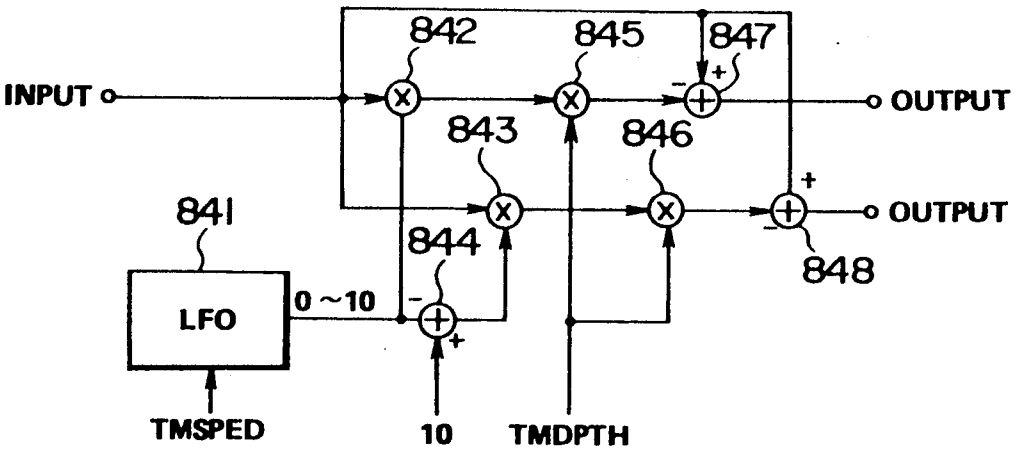
FIG. 24 is a functional block diagram of a tremolo effector unit.

FIG. 24 is a functional block diagram of tremolo effector unit 800A. In FIG. 24, tremolo effector unit 800A executes arithmetic processing using low-frequency waveform data (1.0 to 0) output from low-frequency oscillator (LFO) 841, and obtains stereophonic outputs added with a tremolo effect. LFO 841 reads out predetermined waveform data from, e.g., a memory for storing the predetermined waveform data for each sampling period, and generates a low-frequency waveform such as a sine waveform. The oscillation frequency of LFO 841 is changed in accordance with a parameter (TMSPED) of a tremolo speed. The frequency falls within the range of about 0.15 to 940 Hz. Input signal data is supplied to two multipliers 842 and 843. One multiplier 842 multiplies input signal data with the output from LFO 841. The other multiplier 843 multiplies input signal data with a sum of "1" and a value obtained by inverting the sign of output from LFO 841, i.e., a signal having a 180° phase difference from the output from LFO 841, and supplies the product to multipliers 845 and 846. In these multipliers 845 and 846, the outputs from multipliers 842 and 843 are multiplied with a parameter (TMDPTH) for determining a tremolo depth, and the products are respectively output to adders 847 and 848. Adders 847 and 848 add values obtained by inverting the signs of the outputs from multipliers 845 and 846 to input signal data, respectively. Thus, the sum outputs from adders 847 and 848 serve as two stereophonic tremolo outputs. Therefore, when parameter TMDPTH is "0", the input signal data of an original tone is directly output. When parameter TMDPTH is "1", 100%-modulated input waveform data is output.

Figure 25:
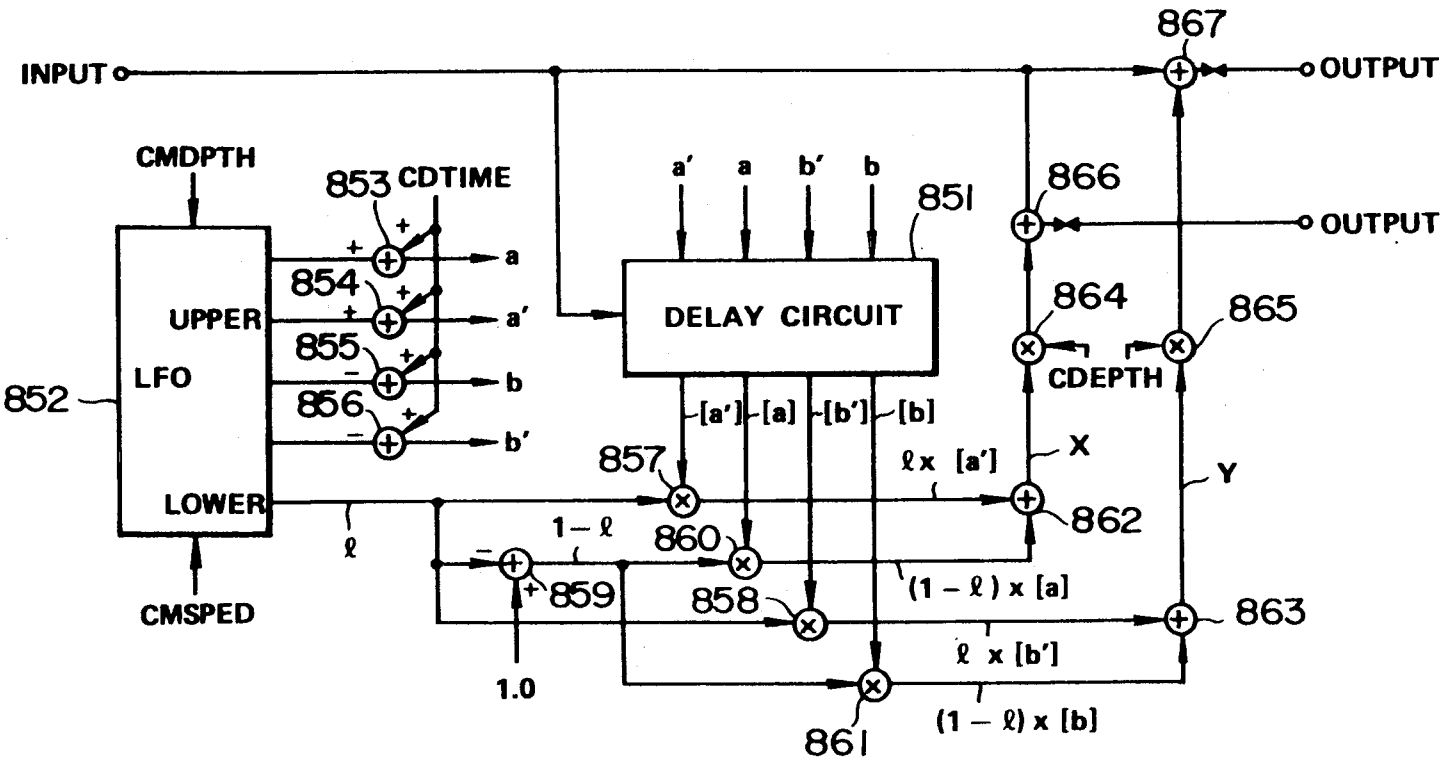
FIG. 25 is a functional block diagram of a chorus effector unit.

FIG. 25 is a block diagram of chorus effector unit 800B. In FIG. 25, chorus effector unit 800B has delay circuit 851 for delaying waveform data, and low-frequency oscillator (LFO) 852, and obtains stereophonic outputs added with a tremolo effect by the arithmetic operation. Delay circuit 851 outputs delayed input signal data, and is realized by delaying an input waveform stored in waveform memory 830 shown in FIG. 21 and reading out the stored data. In the following description, delay circuits have the similar arrangement. LFO 852 generates a low-frequency waveform as described above, and has four integral part outputs on an upper bit side and one decimal part output at a lower bit side. The amplitude and oscillation frequency of LFO 852 are changed in accordance with a parameter (CMDPTH) for determining a modulation depth and a parameter (CMSPED) for determining a modulation speed. The four integral part outputs from LFO 852 are respectively added/subtracted to/from delay time parameters (CDTIME) by adders 853, 854, 855, and 856, and their sum/ difference outputs a, a', b, and b' are supplied to delay circuit 851 as read addresses. Sum/difference outputs a' and b' respectively indicate addresses immediately before and after sum outputs a and b, respectively.

More specifically, a, a', b, and b' take following values. h represents upper-bit data of LFO 852.

$$a=h+CDTIME$$

$$a'=h+1+CDTIME$$

$$b=-h+CDTIME$$

$$b'=-h-1+CDTIME$$

Decimal part output l from LFO 852 is multiplied with waveform data [a'] and [b'] read out from delay circuit 851 by multipliers 857 and 858, respectively. A sum output of "1" and a value obtained by inverting the sign of the decimal part output from LFO 852 is multiplied with [a] and [b] read out from delay circuit 851 by multipliers 860 and 861, respectively. The outputs from multipliers 857 and 860 are added to each other by adder 862, and the outputs from multipliers 858 and 861 are added to each other by adder 863.

Outputs x and y from adders 862 and 863 are given by:

$$x=(1-l)\times[a]+l\times[a']$$

$$y=(1-l)\times[b]+l\times[b']$$

More specifically, x and y are obtained by interpolating between readout preceding and next waveform data [a] and [a'], and [b] and [b'] by decimal part output l. The outputs from adders 862 and 863 are multiplied with the parameter (CDEPTH) for determining a chorus depth by multipliers 864 and 865, respectively. The outputs from multipliers 864 and 865 are added to input signal data by adders 866 and 867, respectively, thus obtaining two chorus outputs. Note that right shift is made at output sides of adders 866 and 867 so as not to cause overflow (indicated by mark "x").

In this manner, in chorus effector unit 800B, low-frequency read addresses are designated based on the integer part outputs from LFO 852 to have delay time parameter as the central value, and waveform data are read out from delay circuit 851. The adjacent readout waveform data are interpolated by the decimal part output from LFO 852, are multiplied with the parameter (CDEPTH) for determining the chorus depth, and are added to input signal data, so that their frequencies are modulated, thus obtaining stereophonic outputs added with the chorus effect.

Figure 26:
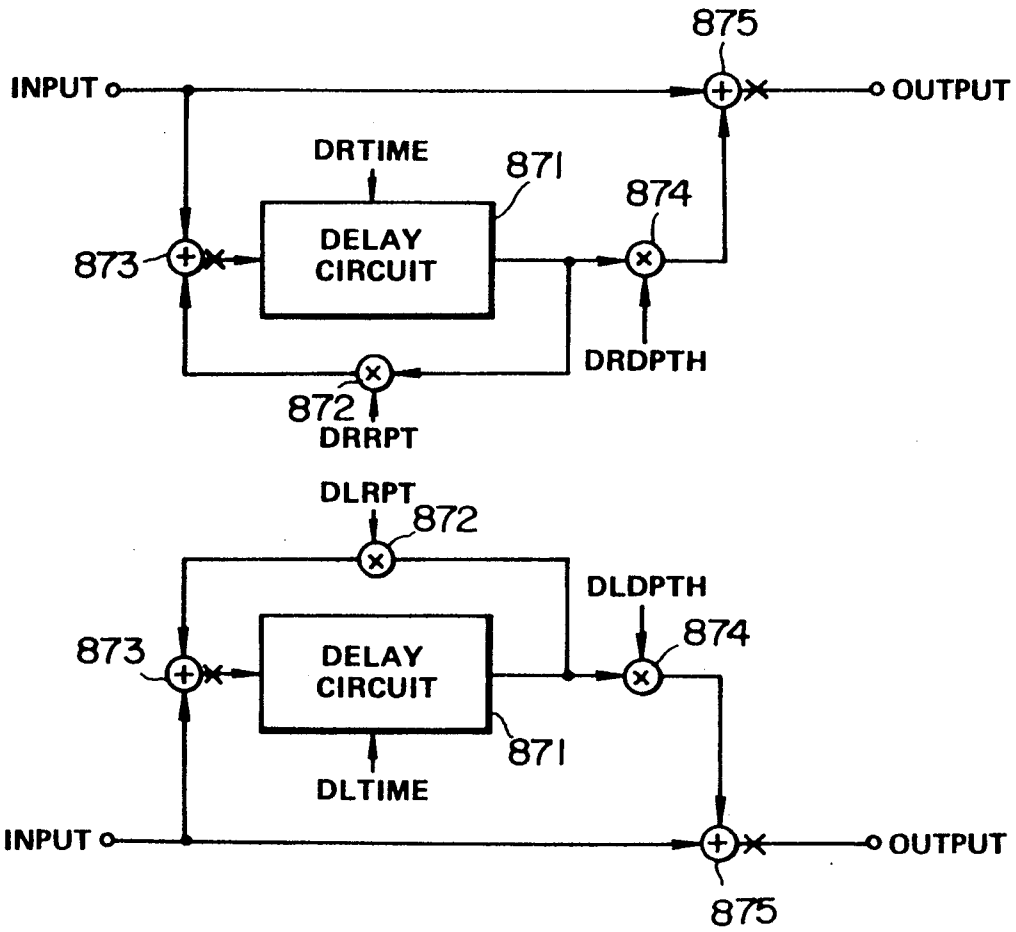
FIG. 26 is a functional block diagram of a delay effector unit.

FIG. 26 is a block diagram of delay effector unit 800C. In FIG. 26, two sets of delay effector units 800C are arranged for adding effects to two inputs, and include two delay circuits 871. Waveform data are read out from these delay circuit 871 to be delayed by delay time parameters (DRTIME and DLTIME), respectively, and are multiplied with repeat parameters (DRRPT and DLRPT) by multipliers 872 on the feedback loops. These products are added to input signal data by adders 873, and are input to delay circuits 871. The outputs from delay circuits 871 are multiplied with parameters (DRDPTH and DLDPTH) for determining delay depths by multipliers 874 and are added to input signal data by adders 875, thus obtaining two delay effect outputs. Note that right shift is made at the outputs sides of adders 873 and 875 in the same manner as described above (indicated by mark "x").

In this manner, input signal data are delayed by delay circuits 871 having the feedback loops, and the delayed signals are added to input signal data again, thus obtaining stereophonic outputs added with the delay effect.

Figure 27:
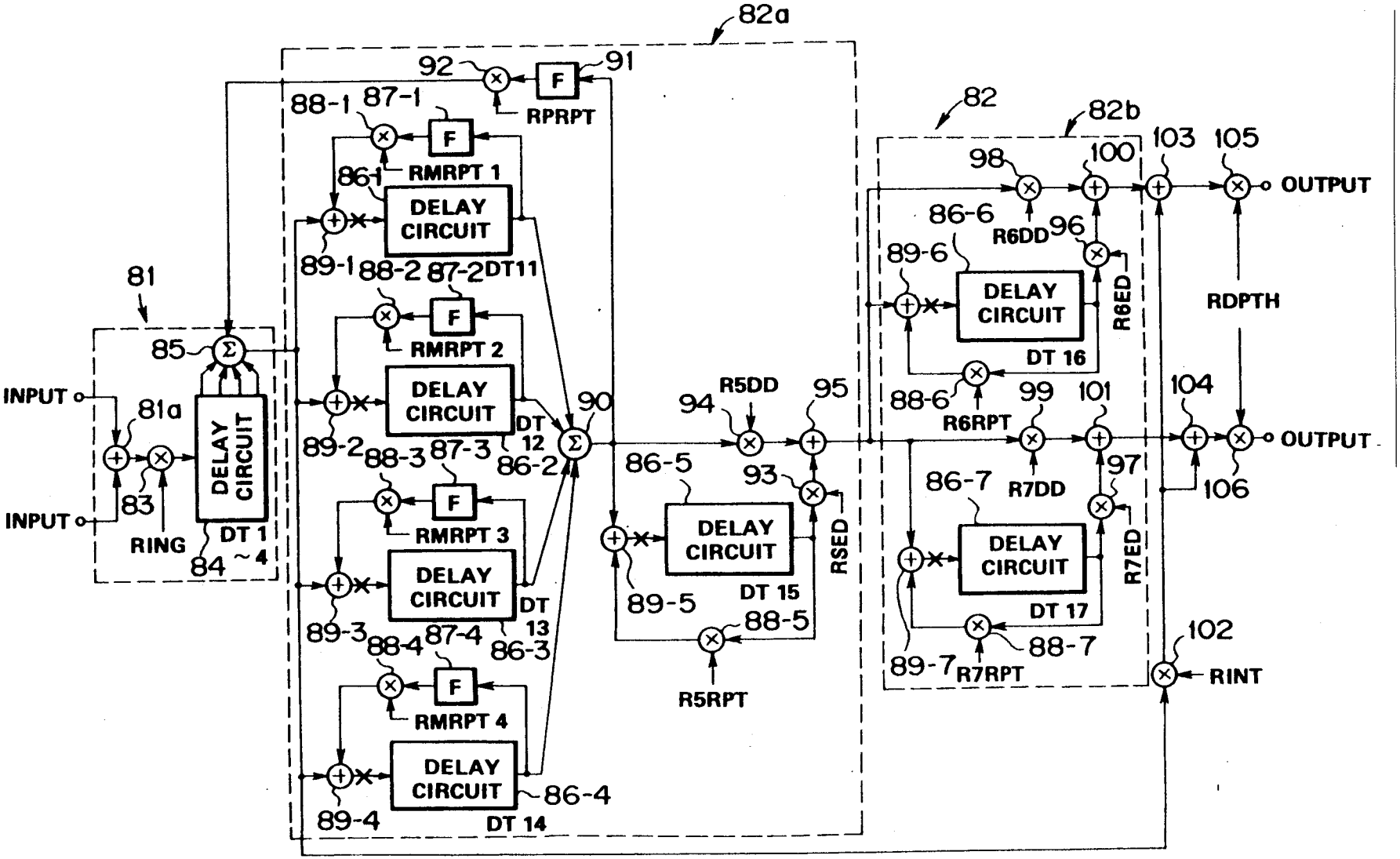
FIG. 27 is a functional block diagram of a reverberation effector unit.

FIG. 27 is a block diagram of reverberation effector unit 800D. In FIG. 27, reverberation effector unit 800D is mainly constituted by initial reflection addition section 81 and reverberation addition section 82. Reverberation addition section 82 is constituted by input-side reverberation addition unit **82*a* and output-side stereophonic section 82*b***.

Initial reflection addition section 81 has adder **81*a* for adding two input signals, multiplier 83 for multiplying the sum output with a tone volume parameter (RING), delay circuit 84 for obtaining outputs of delay times DT1 to DT4 from a plurality of intermediate taps as initial reflection tones based on the product output, and adder 85 for adding these delay outputs and a feedback signal from input-side reverberation addition section 82*a***.

Input-side reverberation addition section **82*a* has a plurality of delay circuits 86-1 to 86-5 having feedback loops, and delay times DT11 to DT15 are respectively set. Low-pass filters 87-1 to 87-4 and multipliers 88-1 to 88-4 for multiplying repeat parameters (RMRPT1 to RMRPT4) are arranged on the feedback loops of delay circuits 86-1 to 86-4, respectively, and feedback signal data are added by adders 89-1 to 89-4 connected to the inputs of delay circuits 86-1 to 86-4. The outputs from adders 89-1 to 89-4 are subjected to right shift processing (indicated by mark "x"), and are then supplied to delay circuits 86-1 to 86-4. The outputs from delay circuits 86-1 to 86-4 are added by adder 90. The output from adder 90 passes low-pass filter 91, is multiplied with the repeat parameter (RPRPT) by multiplier 92, and is fed back to adder 85. Multiplier 88-5 for multiplying the repeat parameter (R5RPT) is arranged on the feedback loop of delay circuit 86-5, and feedback signal data is added to the output signal from adder 90 by adder 89-5 connected to the input terminal of delay circuit 86-5. The output from adder 89-5 is subjected to right shift processing (indicated by mark "x") and is then input to delay circuit 86-5. A value obtained by multiplying the output from delay circuit 86-5 with a tone volume parameter (R5ED) by multiplier 93 is added, by adder 95, to a value obtained by multiplying the output from adder 90 with a tone volume parameter (R5DD) by multiplier 94**.

Output-side stereophonic circuit **82*b* obtains stereophonic outputs from the output from input-side reverberation addition section 82*a*, and has two delay circuits 86-6 and 86-7 having feedback loops, in which delay times DT16 and DT17 are respectively set. Multipliers 88-6 and 88-7 for multiplying repeat parameters (R6RPT and R7RPT) are arranged on the feedback loops, and feedback signal data are added to the output signal from adder 95 by adders 89-6 and 89-7 connected to the inputs of delay circuits 86-6 and 86-7. The outputs from adders 89-6 and 89-7 are subjected to right shift processing (indicated by mark "x") and are then input to delay circuits 86-6 and 86-7, respectively. Values obtained by multiplying the outputs from delay circuits 86-6 and 86-7 with tone volume parameters (R6ED and R7ED) by multipliers 96 and 97 are added, by adders 100 and 101, to values obtained by multiplying the output from adder 95 with tone volume parameters (R6DD and R7DD), respectively. The outputs from adders 100 and 101 are added, by adders 103 and 104, to a value obtained by multiplying the output from adder 85 of initial reflection addition section 81 with a tone volume parameter (RINT) by multiplier 102, and the sums are multiplied with a parameter (RDPTH) for determining a reverberation depth by multipliers 105 and 106**, thus obtaining stereophonic outputs added with a reverberation effect.

To summarize, input signal data is delayed by a plurality of delay times DT1 to DT4 by delay circuit 84, and the delayed outputs are added by adder 85 to obtain an initial reflection tone. In adder 85, the value of RING of multiplier 83 is adjusted in order to prevent overflow noise. The initial reflection tone of adder 85 is supplied to adders 89-1 to 89-4, and is added thereby to feedback signals obtained by multiplying the outputs from delay circuits 86-1 to 86-4 with repeat parameters (RMRPT1 to RMRPT4). The sums are input to delay circuits 86-1 to 86-4 to be delayed by predetermined delay times DT11 to DT14, respectively, and the delayed outputs are added by adder 90. The sum from adder 90 is then delayed by delay circuit 86-5. The output from adder 90 is multiplied with the repeat parameter (RPRPT) by multiplier 92 on the feedback loop, and the product is fed back to adder 85. The repeat parameter (RPRPT) and the repeat parameters (RMRPT1 to RMRPT4) are set to have opposite polarities, so that feedback amounts of delay circuits 86-1 to 86-4 themselves are reduced and other feedback amounts are increased, thus preventing resonance. High-frequency components are attenuated by low-pass filters 87-1 to 87-4 and 91 on the feedback loops, and hence, a natural reverberation effect can be obtained. The output from adder 95 is multiplied with repeat parameters (R6RPT and R7RPT) in output-side stereophonic circuit **82*b* and the products are delayed by delay circuits 86-6 and 86-7 having the feedback loop. The delayed outputs are subjected to tone volume control, and are then added by adders 100 and 101. The outputs from adders 100 and 101 serve as complicated reverberation tones, i.e., having various different reverberation times and a large change in frequency component. The reverberation tones are added to the initial reflection tone subjected to tone volume (RING) control by multiplier 102**, and the sums are multiplied with the reverberation depth (RDPTH), thus obtaining stereophonic outputs.

Fret Switch Type Electronic Guitar

Figure 28:
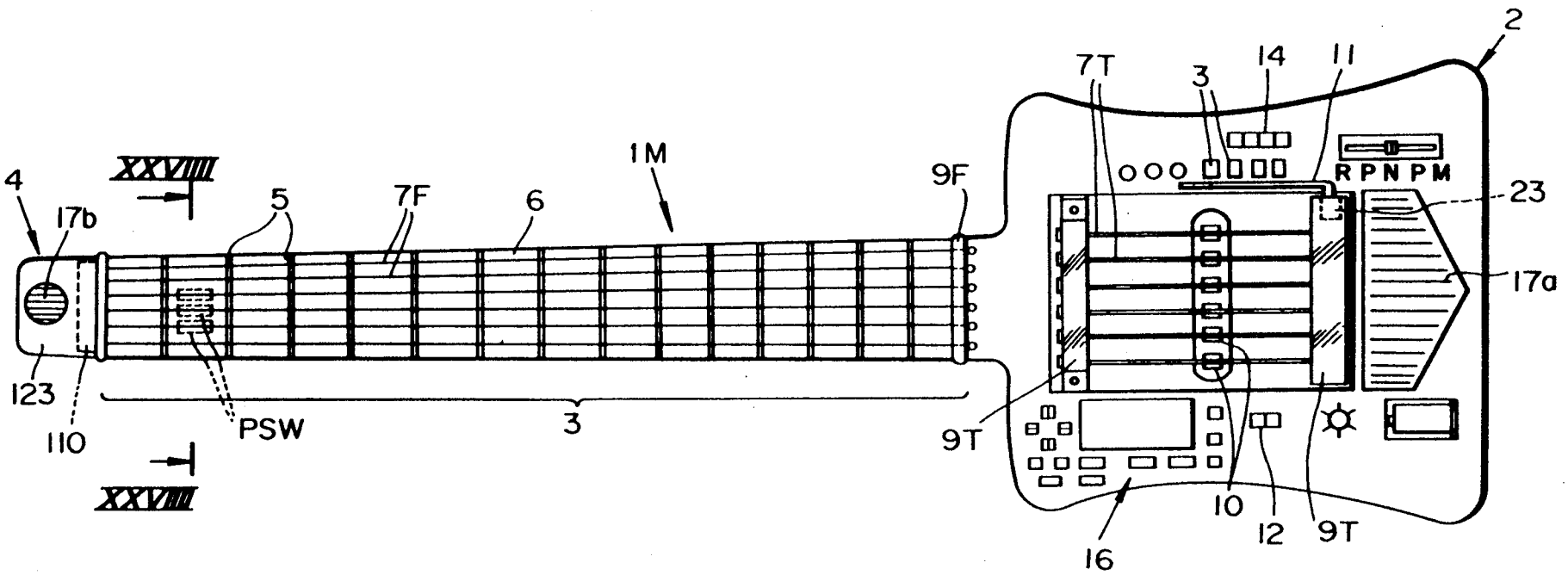
FIG. 28 is a view showing an outer appearance of a fret switch type electronic guitar to which the characteristic feature of the present invention is assembled.

FIG. 28 shows an outer appearance of fret switch type electronic guitar IM to which the characteristic feature of the present invention is applied. The fret switch type electronic guitar is named after the fact that a fret operation position (fret number) on a fingerboard is detected by switches embedded in the fingerboard.

In FIG. 28, of components of fret switch type electronic guitar IM, the same reference numerals and symbols denote the same components corresponding to those of the pitch extraction type electronic guitar described above, and a detailed description thereof will be omitted.

Figure 29:
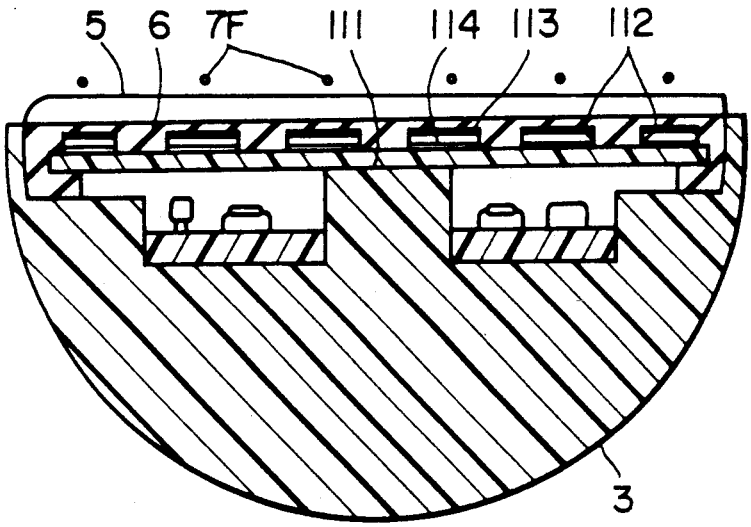
FIG. 29 a sectional view of a neck taken along a line XXVIII—XXVIII of FIG. 28, showing an arrangement of fret switches.

As can be seen from FIG. 28, electronic guitar IM has two sets of strings, i.e., strings 7F (called fret strings) and strings 7T (called trigger strings). Fret strings 7F are kept taut on fingerboard 6. One end of each string 7F is fixed to bridge 9F provided at the base portion of neck 3, and the other end thereof is adjustably supported by string-bending mechanism 110 (to be described later in detail) assembled in headstock 4. Fingerboard 6 is formed of elastic rubber, fret switches PSW are disposed at positions between adjacent frets in lower surface of fingerboard 6 in correspondence with strings 7F. Pressed string positions are detected by these fret switches PSW. More specifically, as best illustrated in FIG. 29, surface rubber (fingerboard) 6 is stacked on printed circuit board 111, and two edges thereof are bent into a U shape so as to surround two edges of printed circuit board 111 and to fix it. Six columns of recess portions are formed at positions between frets 5 and corresponding fret strings 7F in the lower surface of surface rubber 6, which is in contact with printed circuit board 111. Movable contact 113 of fret switch PSW is formed on the bottom surface of each recess portion 112, and fixed contact 114 of fret switch PSW is formed on the upper surface of printed circuit board 111. Therefore, when the surface rubber 6 is pressed downward together with fret string 7F, movable contact 113 is brought into contact with corresponding fixed contact 114, thereby achieving electric connection.

In this manner, fret switches PSW detect pressed string positions. However, these switches cannot provide information associated with a change in tension of strings upon, e.g., bending of strings. For this purpose, string-bending mechanism 110 is arranged.

Figure 30:
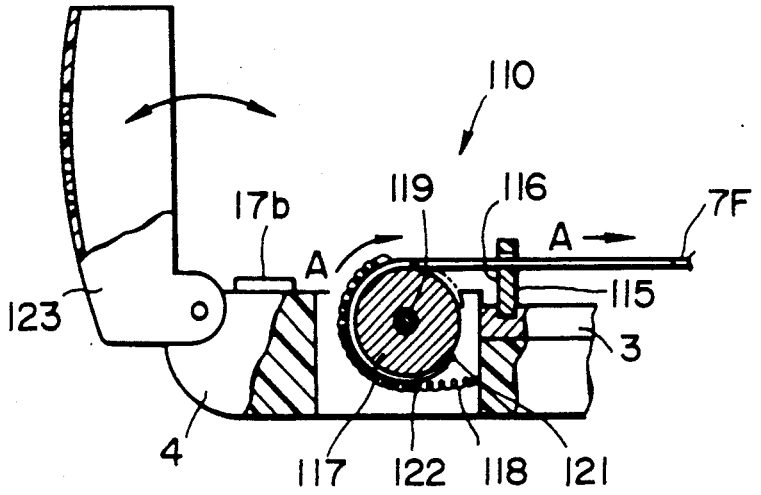
FIG. 30 is a partially cutaway side view of a string-bending mechanism.
Figure 31:
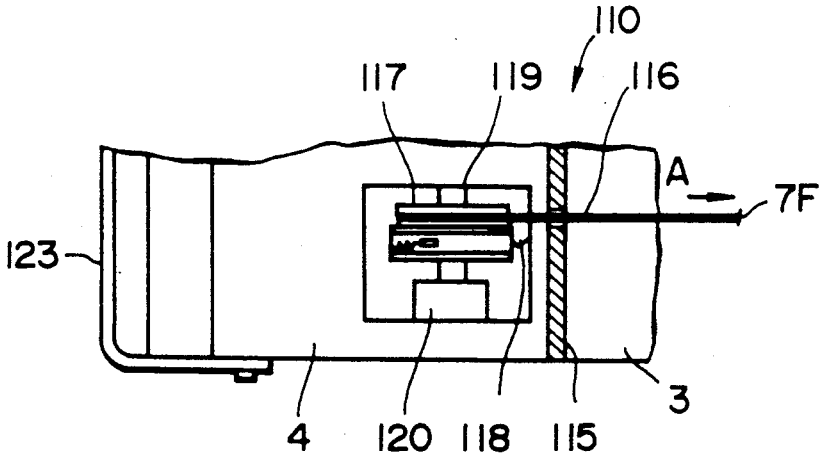
FIG. 31 is a partially cutaway front view of the string-bending mechanism.

FIGS. 30 and 31 show an arrangement of the string-bending mechanism. As shown in FIGS. 30 and 31, each fret string 7F extends through hole 116 of string guide plate 115 provided at the end of neck 3, and its end is locked with pulley 117 rotatably supported by headstock 4. Pulley 117 is locked with one end of spring 118 for elastically drawing pulley 117 in a direction opposite to a tensile direction of fret string 7F (indicated by arrow A). The other end of spring 118 is locked with neck 3.

Volume 120 serving as a string-bending sensor is coupled to shaft 119 formed integrally with pulley 117, and a resistance of volume 120 is variably controlled in accordance with a tensile amount of fret string 7F. The possible pivotal range of pulley 117 is regulated by stopper member 121 fixed to headstock 4. In a normal state, projection 122 formed on pulley 117 is engaged with stopper member 121 to keep the position of pulley 117. Note that reference numeral 123 denotes a head cover for covering pulley 117 to provide a good appearance.

Figure 32:
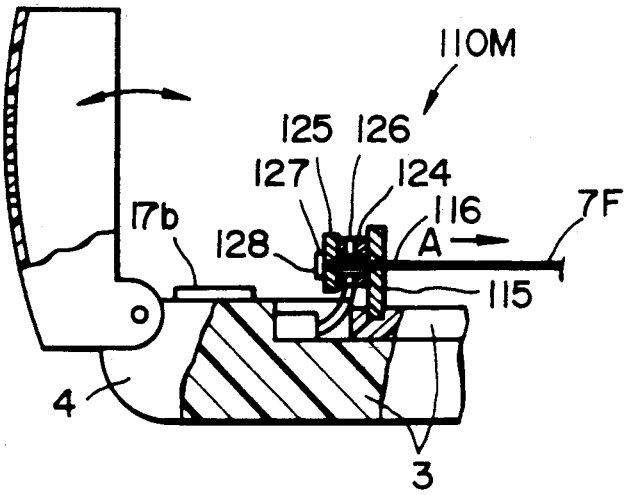
FIG. 32 is a view showing another string-bending mechanism.

FIG. 32 shows another arrangement of the string-bending mechanism. In this string-bending mechanism 110M, one end of each string 7F is coupled to a pressure-sensitive element (e.g., a piezoelectric element), so that a change in tension of string 7F is detected by the pressure-sensitive element.

More specifically, ring-shaped pressure-sensitive element 124 (e.g., a piezoelectric element) and holding plate 125 are stacked on string guide plate 115, and one end of each fret string 7F is inserted in string guide hole 116 formed in string guide plate 115, through hole 126 formed in pressure-sensitive element 124, and string locking hole 127 formed in holding plate 125, so that locking projection 128 provided at the string end is locked with holding plate 125.

In this arrangement, when fret string 7F is pushed upward or downward by a string-bending operation, fret string 7F is bent, and a pressure acting on pressure-sensitive element 124 is changed since tension of the string is increased. As a result, an electrical signal is output from pressure-sensitive element 124 in accordance with a tension of corresponding fret string 7F.

Referring back to FIG. 28, the trigger strings are kept taut on body 2, and two ends of each string are supported by bridges 9T which are arranged on body 2 to be separated from each other. Each trigger string 7T is formed of a magnetic material, and pickups 10 are arranged on body 2 below the central portions of trigger strings 7T in correspondence with strings 7T. Vibrations of strings 7T are detected by pickups 10. As will be described later, string touch data indicating a plucking strength of a string is extracted from a picked up string vibration signal. However, unlike in pitch extraction type guitar 1, a vibration period is not detected. Thus, a mechanism around tremolo arm 11 shown in FIG. 28 becomes simpler than that of pitch extraction guitar 1. More specifically, tremolo arm 11 need not mechanically increase/decrease tensions of trigger strings 7T. An operation amount of tremolo arm 11 is detected by coupling variable-resistor type tremolo arm sensor 23 to the base portion of the arm.

Overall Circuit Arrangement

Figure 33:
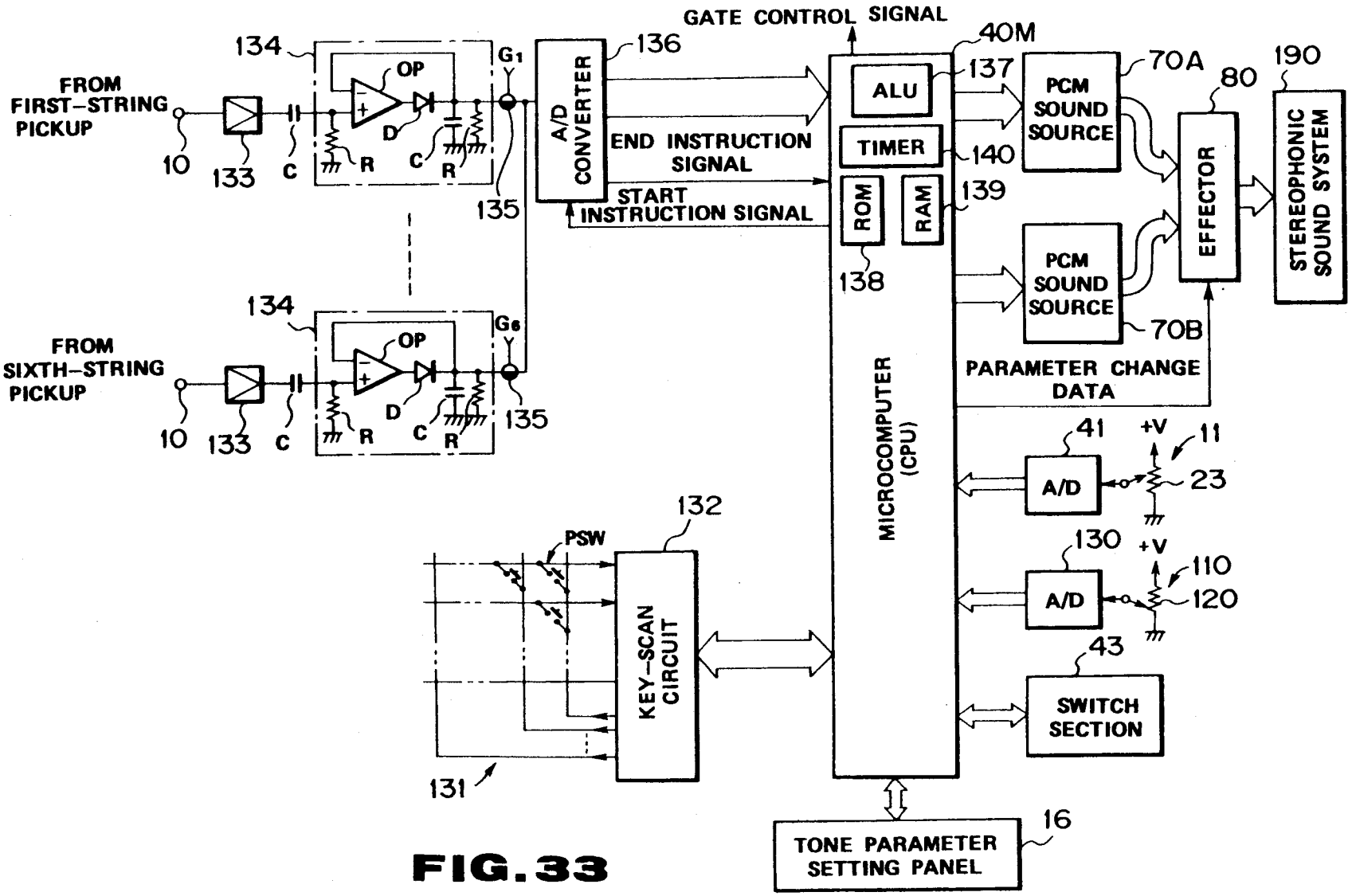
FIG. 33 is a circuit diagram showing the entire circuit arrangement of the fret switch type electronic guitar.

FIG. 33 shows the overall circuit arrangement of fret switch type electronic guitar 1M. For the purpose of comparison, please refer to the overall circuit arrangement (FIGS. 7 and 8) of pitch extraction type electronic guitar 1. The same reference numerals in FIG. 33 denote the same components as in FIGS. 7 and 8. Thus, only a difference will be described below.

String-bending sensor 120 of string-bending mechanism 110 is connected to A/D converter 130, and a detected analog string-bending signal is converted into a digital signal by A/D converter 130. The digital signal is fetched by CPU 40M.

Fret switches PSW disposed in fingerboard 6 are coupled to form key matrix circuit 131. Fret switches PSW are scanned by key scan circuit 132 connected to key matrix circuit 131, thus detecting states of switches PSW. The scanning result of key scan circuit 132 is supplied to CPU 40M. In this manner, operated fret positions associated with fret strings 7F are detected.

Therefore, in the fret switch type guitar, a vibration period of each string need not be detected. For this reason, signal processing circuits for string vibration pickups 10 can have a simpler arrangement than those of the pitch extraction type guitar. In FIG. 33, each analog processing circuit for a string vibration pickup signal is constituted by amplifier 133 for amplifying a signal from each pickup 10, and envelope detection circuit 134, coupled to the corresponding amplifier through DC preventing capacitor C, for detecting an envelope of a string vibration signal.

Each amplifier 133 can be one similar to amplifier 44 in pickup signal processing circuit P in pitch extraction type guitar 1. Each envelope detection circuit 134 can be basically constituted by a part of peak detection circuit 46 (FIG. 10). More specifically, envelope detection circuit 134 is constituted by operational amplifier OP, grounded through resistor R, for receiving a pickup signal at its non-inverting input, diode D connected to the output of operational amplifier OP, and a time constant circuit consisting of capacitor C and resistor R. One end of the time constant circuit is connected to the cathode of diode D and the other end thereof is grounded. A potential (envelope) at one end of the time constant circuit is fed back to the inverting input of operational amplifier OP.

The outputs from envelope detection circuits 134 are multiplexed on a common line through gates 135 which are controlled by gate control signals G1 to G6 from CPU 40M and the multiplexed signal is then input to A/D converter 136. In a state wherein one of gates 135 is enabled, A/D converter 136 converts an analog envelope signal from selected gate 135 into a digital signal in response to an A/D start instruction signal sent from CPU 40M. Upon completion of conversion, A/D converter 136 supplies an end instruction signal to CPU 40M. In response to this, CPU 40M reads A/D converter 136 and stores the converted envelope signal vibration level data). Thereafter, CPU 40M disables selected gate 135, and selects (enables) the next gate 135 to read string vibration envelope data of the next string.

CPU 40M includes ALU (Arithmetic & Logic Unit) 137, ROM (Read Only Memory) 138, RAM (Random Access Memory) 139, and timer 140. CPU 40M processes performance input data from the performance input operation elements using these components, and controls sound sources 70A and 70B and effector 80 based o the processed input data and data set at tone parameter setting panel 16.

Pickup Processing

Figure 34:
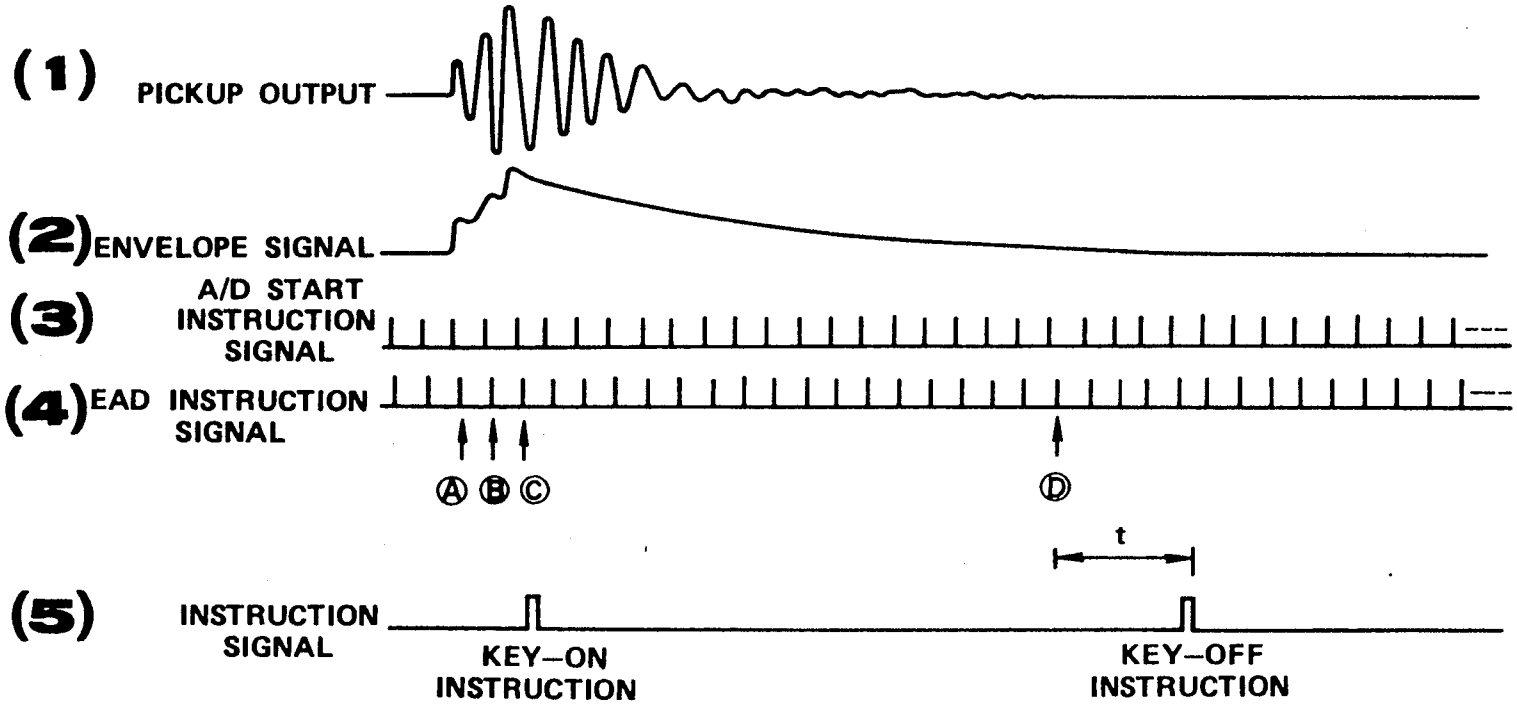
FIG. 34 is a timing chart of pickup processing in the fret switch type electronic guitar.
Figures 35, 36:
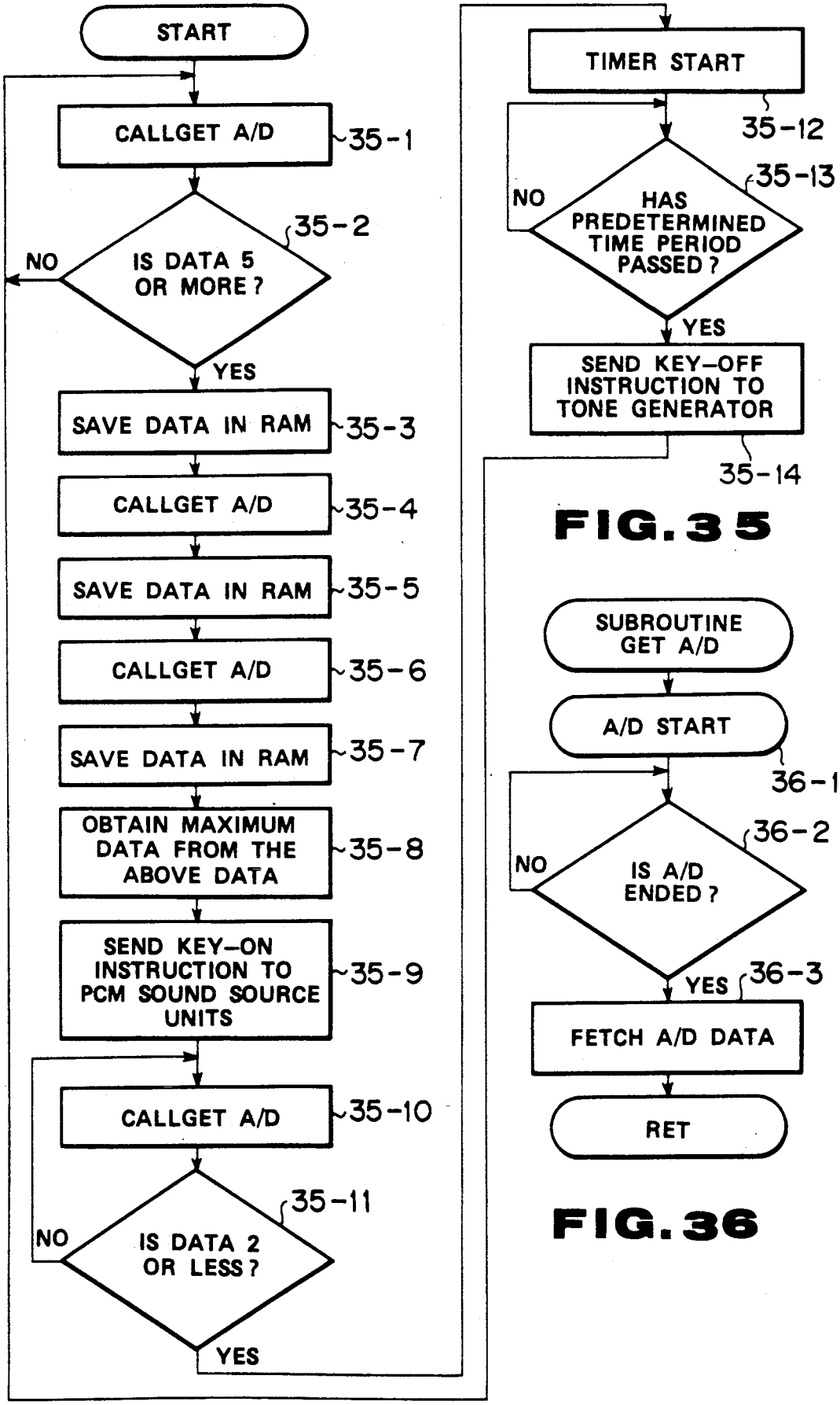
FIG. 35 is a flow chart of pickup signal processing.
FIG. 36 is a flow chart of reading envelope data of a pickup signal.

FIG. 34 is a timing chart of a pickup signal corresponding to a single plucking operation, processing data associated therewith, and a control signal. FIG. 35 is a flow chart of a processing operation cycle of CPU 40M in correspondence with a life cycle of a plucking operation. CPU 40M repeats a loop consisting of steps 35-1 and 35-2 while trigger string 7F of interest is in a still state. More specifically, CPU 40M reads envelope data of a vibration of the corresponding string from A/D converter by Call and get A/D processing 35-1 (36-1 to 36-3 in FIG. 36). In a still state of the string, since envelope data is a value approximate to zero, the condition (data≧5) in step 35-2 is not established. When a string is plucked, a pickup signal is generated, and the envelope changes upward. As a result, CPU 40M detects in step 35-2 that data≧5, and saves the data in RAM 139 (35-3). This occurs at time Ⓐ in FIG. 34. Thus, CPU 40M enters a mode for measuring a plucking strength. More specifically, as indicated by Ⓐ, Ⓑ, and Ⓒ in FIG. 34 and shown in steps 35-3 to 35-8 in FIG. 35 envelope data upon detection of generation of a string vibration and two subsequent envelope data are sampled, and a maximum value thereof is selected as string touch data representing a plucking strength. Then, tone generation processing using the string touch data is executed (35-9). Thereafter, the CPU enters a mode for monitoring attenuation of a string vibration, and executes loop processing of steps 35-10 and 35-11. When the vibration of a string is sufficiently attenuated, CPU 40M detects in step 35-11 that the envelope data of the string becomes 2 or less. Then, CPU 40M starts timer 140 (35-12). After the lapse of a predetermined period of time, processing of muting a musical tone of the corresponding string is executed (35-13 and 35-14). CPU 40M thus returns to a mode in the still state of the string (35-1 and 35-2). (Other Fret Position Detection Techniques)

Figure 37:
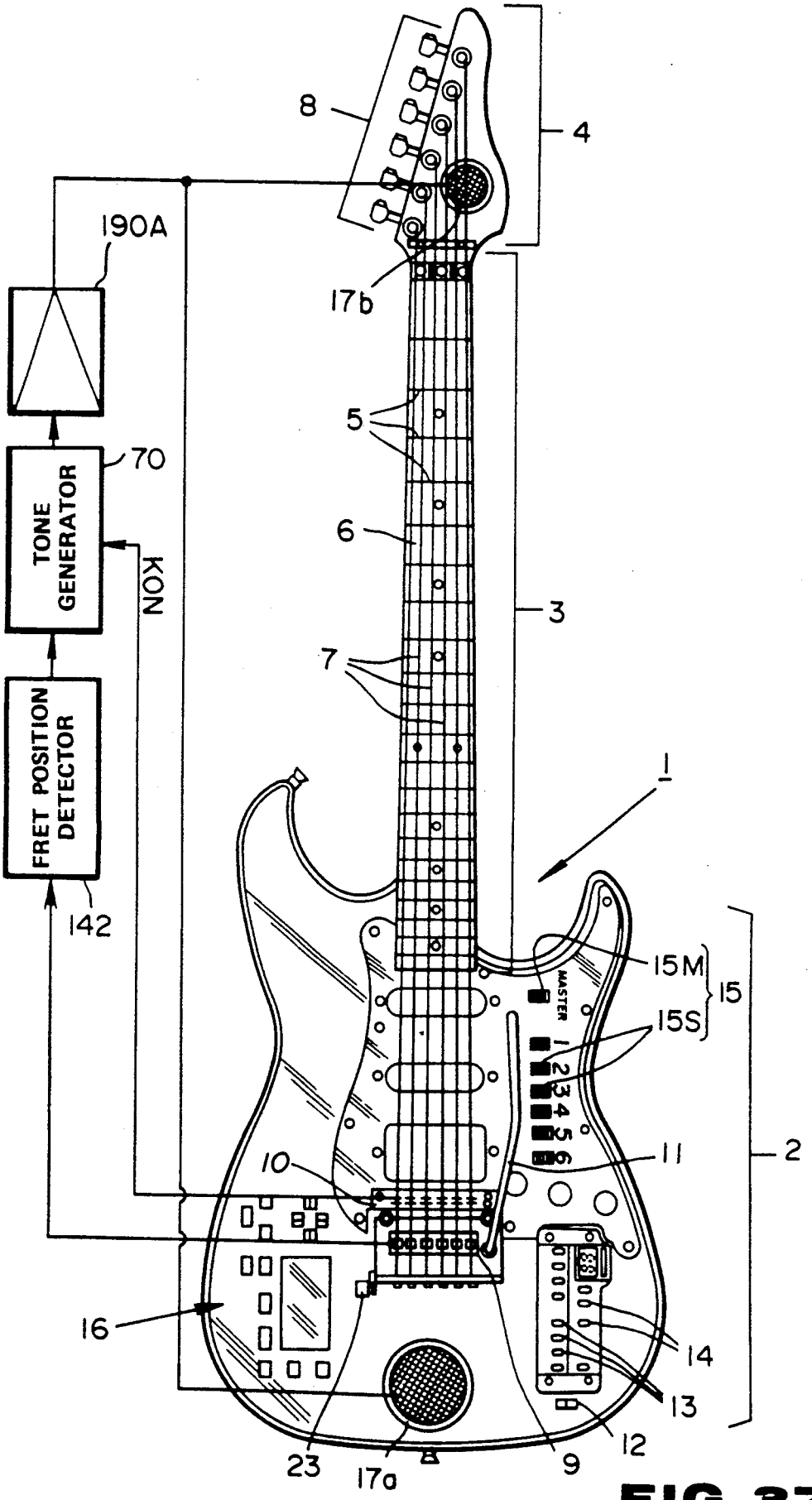
FIG. 37 is a view showing an outer appearance of an electronic of a type for detecting a fret position using an ultrasonic wave.

Some other techniques of detecting a pressed fret position of a string are known. In one technique, an ultrasonic wave is transmitted to a string and is reflected by a fret contacting the string, so that an operated fret position is determined based on a delay time of this echo (e.g., a technique described in U.S. Pat. No. 4,723,468). FIG. 37 illustrates this principle. Piezoelectric element 141 contacting each string 7 is intermittently driven by a high-frequency oscillator and a transmitter (neither are shown). Each time piezoelectric element 141 is driven, it converts an oscillation electrical signal into an ultrasonic wave, and transmits it into string 7. The ultrasonic wave transmits through string 7, and when string 7 is urged against some fret 5, it is reflected by the fret 5. This echo is received by piezoelectric element 141, is converted into an echo electrical signal, and is input to a receiver (not shown). Fret position detector 142 measures a time (as a function of an operation length of a string) from transmission of an ultrasonic wave to reception of an echo, and determines an operated fret position from this measurement time.

In another fret position detection apparatus, conductive strings and conductive frets are used, a very small current flows through conductive strings, and a fret contacting the conductive string is detected (e.g., techniques described in U.S. Pat. Nos. 4,658,690 and 4,372,187).

In still another fret position detection apparatus, a plurality of elongated resistors and conductors which are normally separated from the resistors are vertically arrange to be parallel to the longitudinal direction of a fret board, and an operated fret position is detected by a divided voltage which changes depending on a contact position of the resistor by a pressure of a finger acting on the fret board (e.g., a technique described in U.S. Pat. No. 4,235,141).

These fret position detection apparatuses can be used in the electronic guitar of the present invention. (Setting of Tone Parameter)

The characteristic feature of this invention lies in musical tone control in an electronic stringed instrument.

In the illustrated embodiments, function assignment and setting of an envelope and effect are performed by tone parameter setting panel 16 (FIGS. 6, 7, and 33). In function assignment, a tone control function is variably assigned to an input from each performance operation element. In envelope setting, an envelope parameter is set. In effect setting, an effect parameter is set. After setting, CPU 40 or 40M converts input data from performance operation elements or processed input data into control data for sound source 70 and effector 80 based on set data, or selects or generates a tone parameter for sound source 70 and effector 80 in response to an event of a performance input and transfers the parameter thereto, thereby controlling a musical tone.

Setting of a tone parameter will be described in detail below.

Function Assignment

Figure 38A:
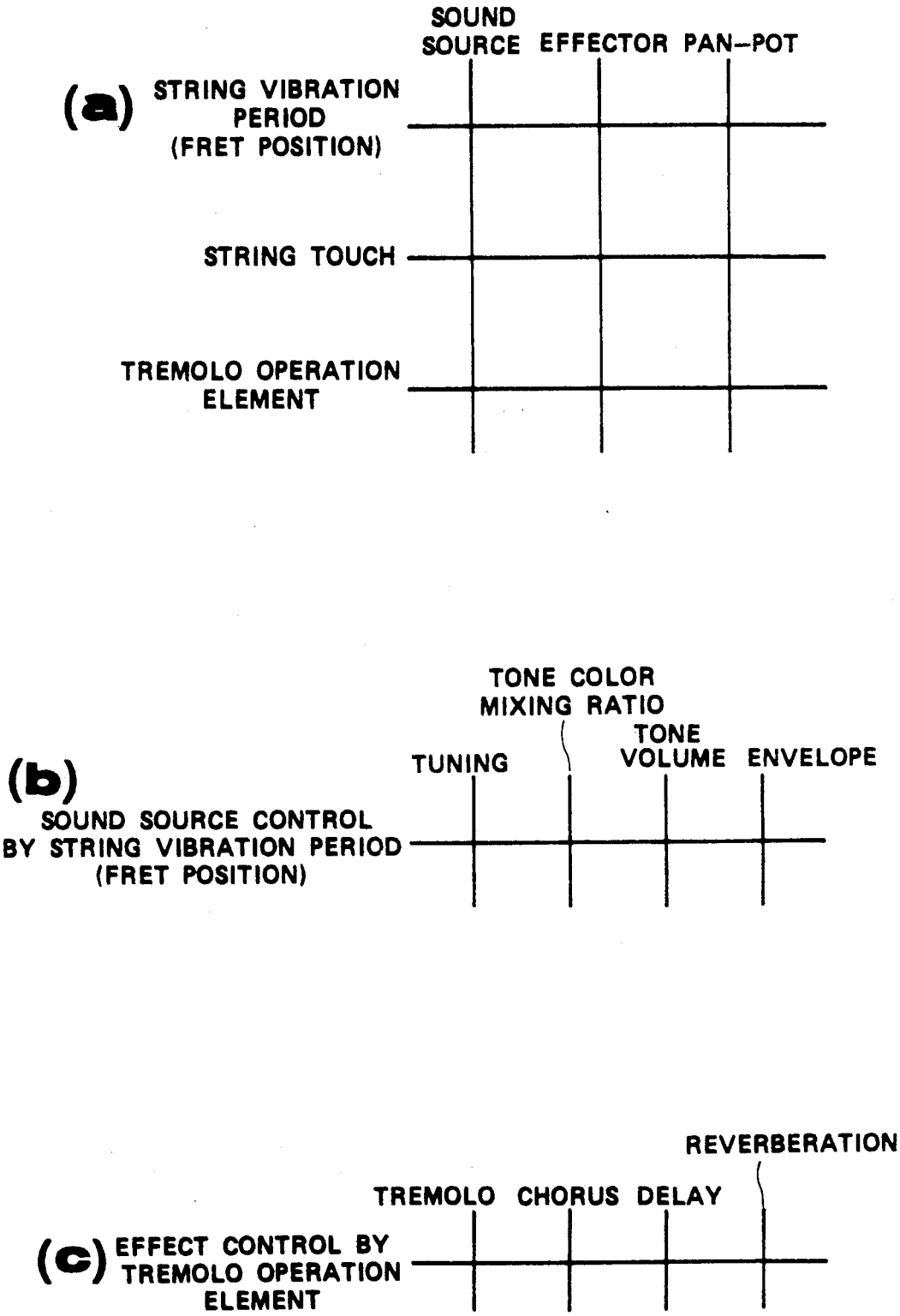
FIG. 38A is a view showing some screens appearing on a tone parameter display panel in a function assignment mode.
Figure 38C:
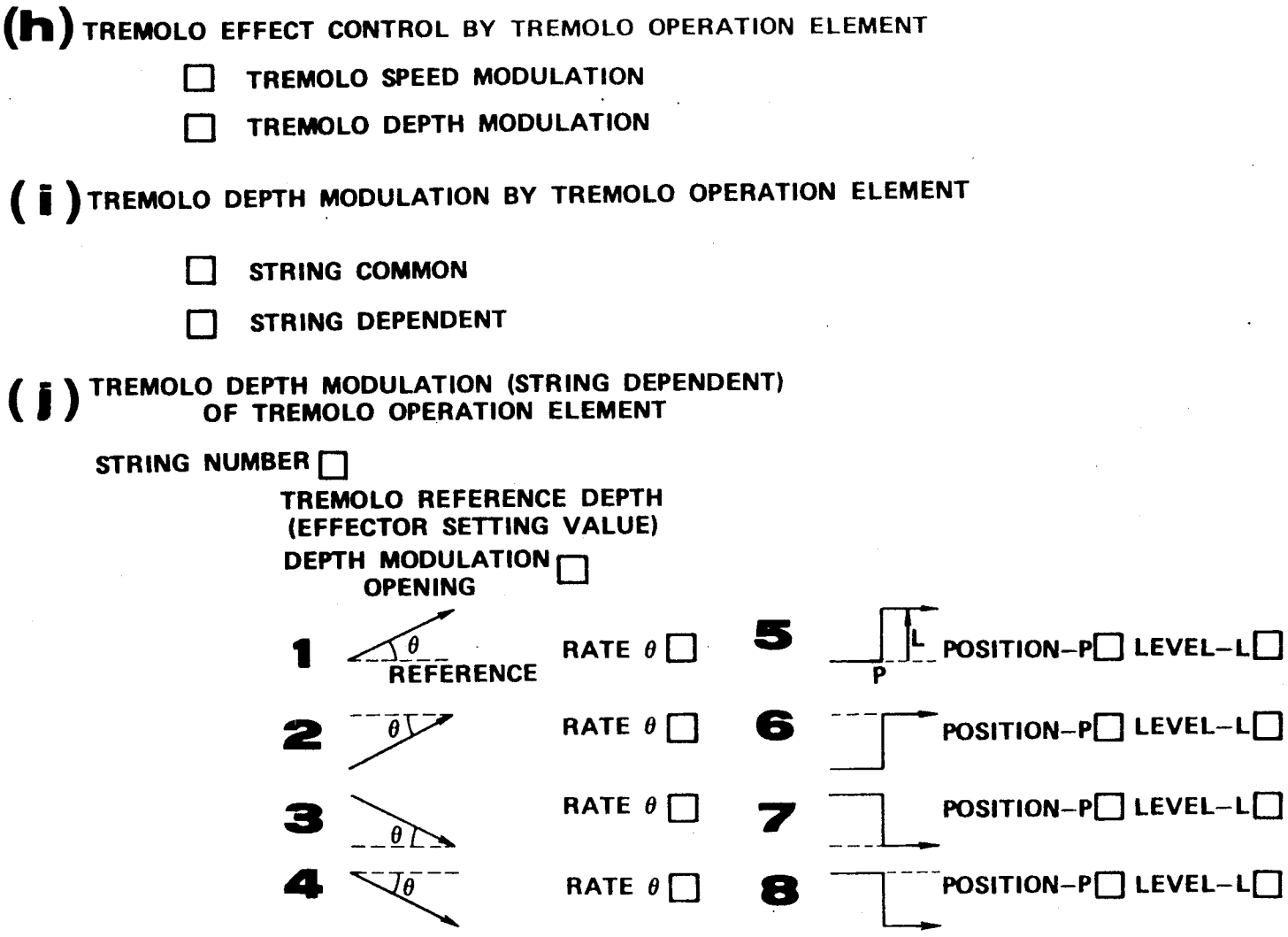
FIG. 38C is a view showing still some other screens in the function assignment mode.

FIGS. 38A, 38B, and 38C show some screens displayed on display panel 28 of tone parameter setting panel 16 (FIG. 6) in a function assignment mode.

FIG. 38A shows initial screen (a) of the function assignment mode which appears first after function assignment key 25 is depressed. As can be seen from this screen, a horizontal line corresponding to a string vibration period (in the case of pitch extraction type electronic guitar) or fret position (in the case of the fret position detection type electronic guitar) crosses vertical lines corresponding to the sound source, effector, and pan-pot. This means that the string vibration period (or fret position) can be assigned as a control function of the sound source, effector and/or pan-pot. Similarly, string touch data (plucking strength) can be assigned as a control function of the sound source, effector and/or pan-pot, and the tremolo operation element (operation amount of tremolo arm 11) can be assigned as a control function of the sound source, effector and/or pan-pot. More specifically, screen (a) shows a state wherein no performance input is assigned to any tone control function (a function assigned by a user is indicated by a mark at an associated intersection). However, in practice, a necessary function assignment area which cannot be updated by the user is present. For example, the vibration period of a string basically determines the pitch of a musical tone.

FIG. 38A shows screen (b) including tone control items by the string vibration period (or fret position). This screen is displayed by depressing next key 29 while initial screen (a) is displayed. Screen (c) includes effect control items by the tremolo operation element. This screen is displayed by depressing next key 29 a plurality times from screen (a) or moving a screen cursor (not shown) to an intersection of the tremolo operation element line and the effector line by cursor key 31 and depressing next key 29 once. In the latter case, when return key 30 is depressed in this state, initial screen (a) is displayed again.

When a function assignment mode is selected in screens (a) to (c), the screen cursor is moved to an intersection of lines to be selected and selection key 35 can be depressed. For example, when a sound source control function is assigned to string touch in screen (a), the screen cursor is placed at the intersection of the string touch line and the sound source line and selection key 35 is depressed. The CPU sets associated function assignment flag TONE GEN (TOUCH). Thus, the function assignment mode is set. Similarly, when an envelope control function is assigned to a string vibration period in screen (b), function assignment flag ENV (PERIOD) is set. In this case, since the envelope control function is one of control functions of the sound source, function assignment flag TONE GEN (PERIOD) is also set. More specifically, a higher-order function assignment flags of a performance input is linked with a lower-order function assignment flag group of the identical performance input. When one of lower-order flags is set, the upper-order flag is simultaneously set. When the selected function assignment is to be canceled, the screen cursor is located at the intersection of the corresponding function assignment, and cancel key 36 is depressed. Thus, the corresponding function assignment flag is reset.

FIG. 38B shows screen (d) including selection items of tuning of a string vibration period. This screen (d) can be displayed upon operation of next key 29 in screen (b). In screen (d), when item "piano tuning" is selected (by locating the screen cursor in a square on the left-hand side of item "piano tuning" and depressing selection key 35), a corresponding flag is set.

As tuning of a string vibration period (or fret position), CPU 40 or 40M automatically selects item "normal" unless the user selects tuning (e.g., piano tuning) other than item "normal".

Screen (e) includes selection items of tone color mixing ratio control by a string vibration period. Item "string common" means that tone color mixing ratio control is performed regardless of types of string, and item "string dependent" means that the control is made depending on the types of string. One function assignment flag TONE MIX (PERIOD, String) is used for both items "string common" and "string dependent". This flag is reset while item "string common" is selected, and is set while item "string dependent" is selected. Therefore, items "string common" and "string dependent" are alternative selection items.

Screen (f) appears by placing the screen cursor in a square on the left-hand side of item "string dependent" and depressing next key 29. Screen (f) is a screen for setting data items of tone color mixing ratio control depending on strings by a string vibration period (or fret position). When data is set, a string number is designated, and a tone color mixing ratio function associated with the selected string is designated. The string number is designated as follows. First, the screen cursor is moved to a square on the right-hand side of the string number by cursor key 31, and a numerical value is input using value keys 32 and 33. Thus, the input numerical value is displayed in the square. When the target string number is displayed, numerical value selection key 34 is depressed. The tone color mixing ratio function is designated in the same manner as described above. When the already set data is to be checked, the next key is depressed, and data patterns of the tone color mixing ratio functions are sequentially displayed in the order of string numbers. In each data pattern, designation of the tone color mixing ratio function can be changed. When the user selects item "string dependent" in screen (e) but does not select the tone color mixing ratio functions of the strings in screen (f), CPU 40 or 40M assigns predetermined tone color mixing ratio functions to the corresponding strings.

Screen (g) includes items of envelope control by a string vibration period (or fret position). By using this screen, the user can select whether or not an envelope rate is changed in accordance with a string vibration period, change sensitivity data of the envelope rate when selected, whether or not an envelope level is changed in accordance with the string vibration period, and change sensitivity data of the envelope data.

Screen (h) is a screen of items of tremolo effect control by the tremolo operation element. By using this screen, the user can select whether or not a tremolo speed is modulated in accordance with the operation amount of tremolo arm 11, and whether or not a tremolo depth is changed in accordance with the operation amount of tremolo arm 11.

Screen (i) is a screen of items of tremolo depth modulation by the tremolo operation element. The user can select whether or not updating of a tremolo depth is performed depending on types of string.

Screen (j) is a setting screen of tremolo depth modulation data in units of strings by the tremolo operation element. The user can set a modulation function of a tremolo depth in units of strings. A value of a tremolo reference value set by setting of an effect parameter (to be described later) is displayed on the right-hand side of the corresponding item.

In addition, there are many other function assignment screens but they can be supposed to an extent and are not illustrated.

In order to escape from the function assignment mode, function assignment key 25 can be depressed again.

Figure 39:
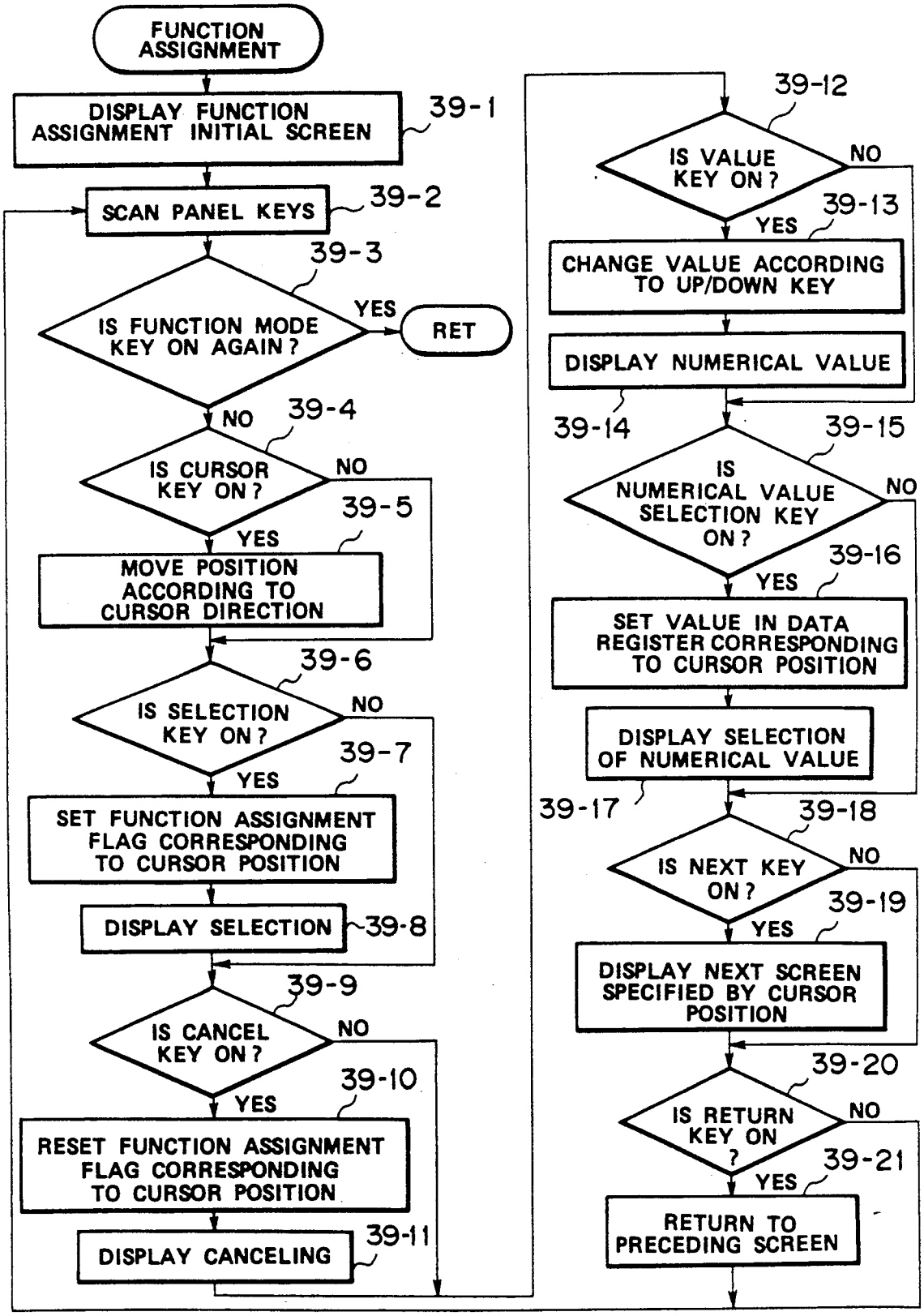
FIG. 39 is a flow chart of function assignment.

FIG. 39 shows a flow chart of processing executed by CPU 40 or 40M in the function assignment mode. According to this flow, when function assignment key 25 is depressed, CPU 40 or 40M enters the function assignment mode, and displays function assignment initial screen (a) shown in FIG. 38A in step 39-1. Thereafter, CPU 40 or 40M periodically scans keys on tone parameter setting panel 16 (39-2). When a change in state is detected upon each key-scan, corresponding key processing is executed. More specifically, when cursor key 31 is ON, the position of the screen cursor is moved by one step in accordance with the direction (up, down, left, or right) of cursor key 31 (39-4 and 39-5). When selection key 35 is ON, the function assignment flag corresponding to the present cursor position is set, and a message indicating that the function is selected is displayed (39-6 to 39-8). Similarly, when cancel key 36 is turned on, the function assignment flag corresponding to the present cursor position is reset, and a message indicating that the function is canceled is displayed (39-9 to 39-11). Of course, when the cursor is at an inappropriate position, since there is no corresponding assignment flag, updating, selection, or canceling of the flag is not displayed. More specifically, there are a table specified by an image number and a selection key number, and a table specified by an image number and a cancel key number. Each table stores a reference cursor position and a pointer to a flag table. When CPU 40 or 40M finds a cursor position coinciding with the present cursor position, it accesses the flag table using a pointer belonging to the reference cursor position. The flag table stores sets of memory locations of flags. CPU 40 or 40M reads out a flag at the corresponding memory location (in the case of selection) or resets the flag (in the case of cancel) and returns it to the memory location.

When value keys 32 and 33 are turned on, CPU 40 or 40M increments/decrements the content of the numerical value input buffer in accordance with up or down key 32 or 33 as a detected ON key, and the numerical value is displayed (steps 39-12 to 39-14).

When value key 34 is turned on, a value in a numerical value input buffer is written in a data register corresponding to the cursor position, and a message indicating that a numerical value is selected is displayed (39-15 to 39-17). The corresponding data register is specified by a screen number and a numerical value selection key number, or the screen number, the numerical value selection key number, and other associated data set in the present screen (e.g., string number).

When next key 29 is turned on, a screen determined by the present cursor position is displayed (39-18 and 39-19). In this case, the preceding screen number is pushed in a stack. When return key 30 is depressed, the preceding screen number is popped from the stack, and the corresponding screen is displayed (39-20 and 39-21).

In this manner, CPU 40 or 40M executes function assignment processing in accordance with inputs from keys on tone parameter setting panel 16. CPU 40 or 40M escapes from this function assignment mode when function assignment key 25 is depressed again. (Envelope Setting)

FIG. 40 shows two screens displayed o display panel 28 of tone parameter setting panel 16 in the tone parameter setting mode.

Screen (a) is an envelope initial setting screen which appears when envelope key 27 on panel 16 (FIG. 6) is depressed. When the user sets an envelope regardless of types of string, he can select item "string common". When he intends to set the envelope depending on types of string, he can select item "string dependent". The way of selection is the same as that in the case of function assignment. When item "string dependent" is selected, CPU 40 or 40M sets corresponding flag ENV (STRING). When item "string common" is selected or item "string dependent" is canceled, the CPU resets flag ENV (STRING).

Screen (b) is a setting screen of envelopes in units of strings. In this screen, the envelopes are set in units of strings as follows. First, the screen cursor is placed in a frame o the right-hand side of item "string number" using cursor key 31, and the string number is selected using value keys 32 and 33 and numerical value selection key 34. Similarly, the total number of steps, i.e., the total number of segments of an envelope for a selected string (a maximum of 8 segments) is then selected. Furthermore, a step number is selected, and an envelope rate and envelope level of the step are selected. When an envelope of a step is to be fixed, item "sustain" is selected by selection key 35. A rate change factor name set by the above-mentioned function assignment mode, its associated data, a change level factor name, and its associated data are respectively displayed in areas on the right-hand side of a rate change factor and a level change factor below in the lower portion of screen (b).

CPU 40 or 40M escapes from the envelope setting mode when envelope key 27 is depressed again.

Effect Setting

FIG. 41 shows three screens displayed on display panel 28 (FIG. 6) in the effect setting mode.

Screen (a) is an effect setting screen appearing on display panel 28 when effect key 26 on tone setting panel 16 is depressed. In this screen, a user selects types of effect to be set. The way of selection is the same as that in the case of function assignment. As can be seen from screen (a), effect items include "tremolo", "chorus", "delay", and "reverberation".

Screen (b) is a selection screen associated with a tremolo effect. When the user sets the tremolo effect regardless of types of string, he selects item "string common". When the user sets the effect in units of strings, he selects item "string dependent". When item "string dependent" is selected, CPU 40 or 40 M sets corresponding flag TREMOLO (STRING). When item "string dependent" is canceled or item "string common" is selected, the CPU resets the flag.

Screen (c) is a screen for setting a tremolo effect parameter in units of strings. A string number is selected by value key 32 and numerical value selection key 35, and similarly, a tremolo speed and a tremolo depth can be selected. A tremolo speed change factor name, its associated data, a tremolo depth change factor name, and its associated data are displayed in areas on the right-hand side of items "tremolo speed change factor" and "tremolo depth change factor".

CPU 40 or 40 M escapes from the effect setting mode in response to the second depression of effect key 26. (Musical Tone Control)

Data generated by the tone parameter setting operation described above, e.g., function assignment data, effect parameter, envelope parameter, and the like are used for generating control data for sound source 70 and/or effector 80 from performance input data from the performance operation elements or processed input data. Musical tone control will be described below. (Tone Color Control)

Figure 42:
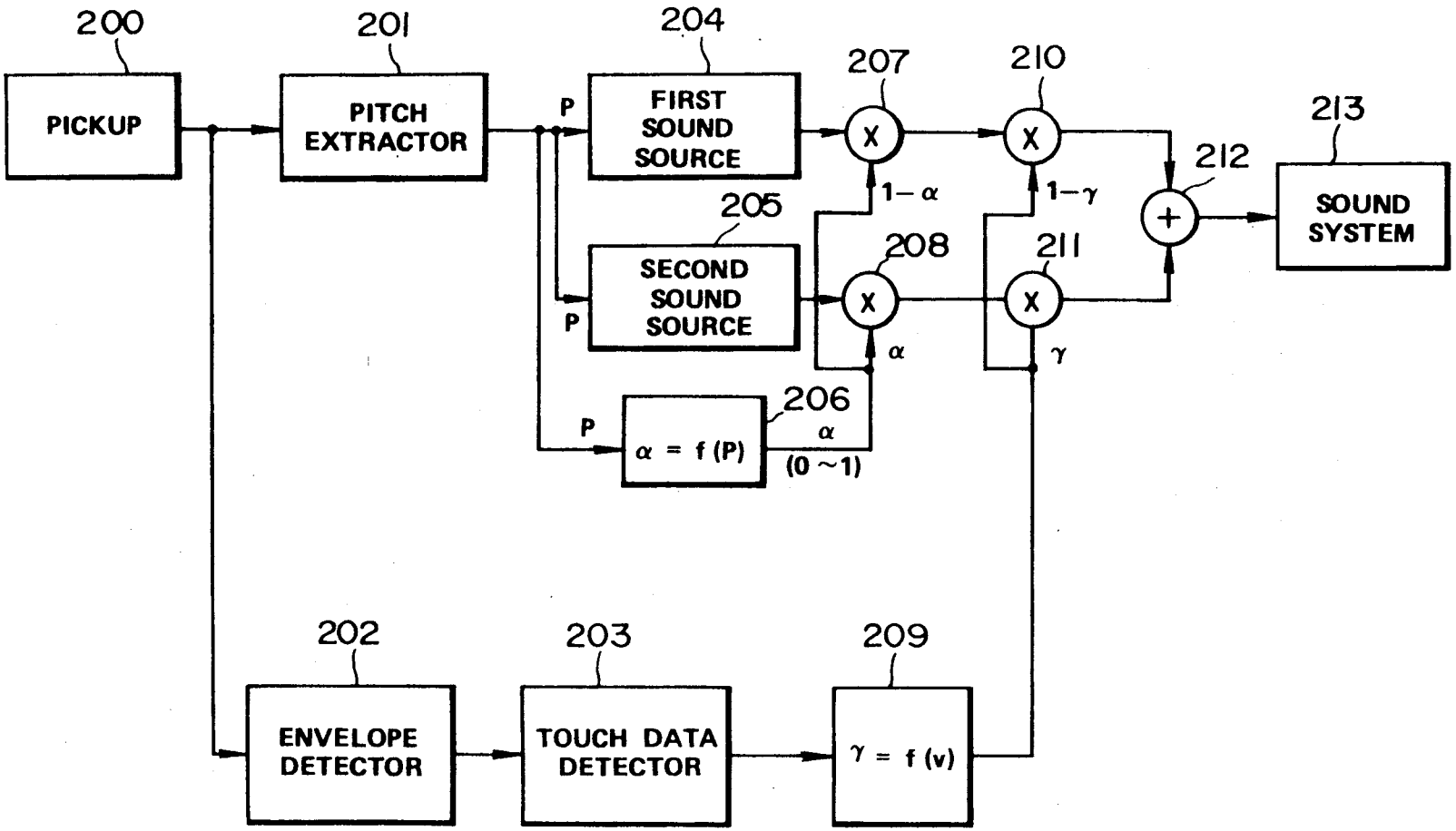
FIG. 42 is a functional block diagram showing an electronic guitar according to the present invention, whose a tone color mixing ratio is controlled based on a vibration period of a string and a plucking strength.

FIG. 42 is a functional block diagram of a electronic guitar system in which a tone color mixing ratio is controlled by a vibration period and a plucking strength (string touch data) of a string. Pickup 200 detects a vibration of a string. The detected string vibration signal is supplied to pitch extractor 201, and a fundamental frequency (pitch) of the vibration is extracted. The signal output from pickup 200 is supplied to envelope detector 202, and an envelope of the pickup signal is detected. The detected envelope is sent to touch data detector 203, thus generating touch data representing the plucking strength. Pickup 200 can be realized by pickups 10 of pitch extraction type guitar 1 described above. Pitch extractor 201, envelope detector 202, and touch data detector 203 can be realized by pickup signal processing circuits Pl to P6 (FIG. 7) and the pickup signal processing routine (FIGS. 14 to 18) of CPU 40.

The pitch data extracted by pitch extractor 201 is supplied to first and second sound sources 204 and 205. Sound sources 204 and 205 generate musical tones of the supplied pitch. The output from pitch extractor 201 is also supplied to tone color mixing ratio data generator 206, and the pitch data is converted to tone color mixing ratios $\alpha$ and $1-\alpha$. Data $(1-\alpha)$ is supplied to multiplier 207, and is multiplied with the output (first musical tone) from first sound source 204. Data $\alpha$ is supplied to multiplier 208 and is multiplied with the output (second musical tone) from second sound source 205.

The touch data from touch data detector 203 is supplied to second tone color mixing ratio data generator 09, and the touch data, i.e., the plucking strength is converted to tone color mixing ratios $\gamma$ and $1-\gamma$. Data $1-\gamma$ is supplied to multiplier 210, and is multiplied with the weighted first musical tone from multiplier 207. Data $\gamma$ is supplied to multiplier 211, and is multiplied with the weighted second musical tone from multiplier 208.

The weighted first and second musical tones from multipliers 210 and 211 are added by adder 212, and the sum musical tone signal is supplied to sound system 213.

Figure 43A:
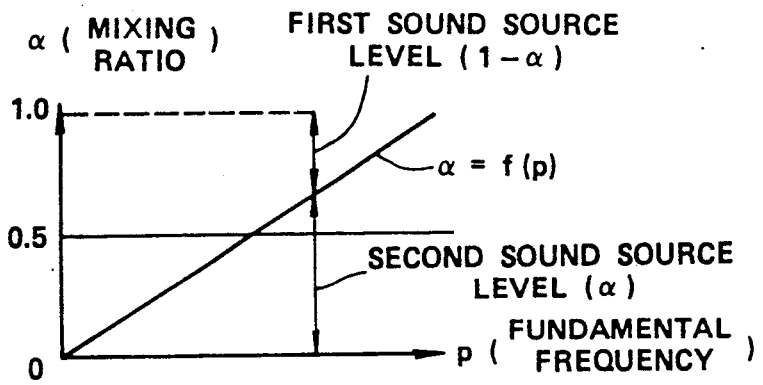
FIGS. 43A, 43B and 43C are views showing conversion functions used in converter 206.
Figure 43B:
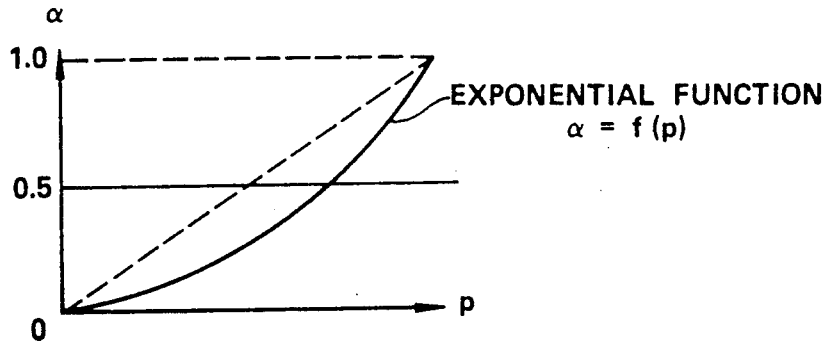
Figure 43C:
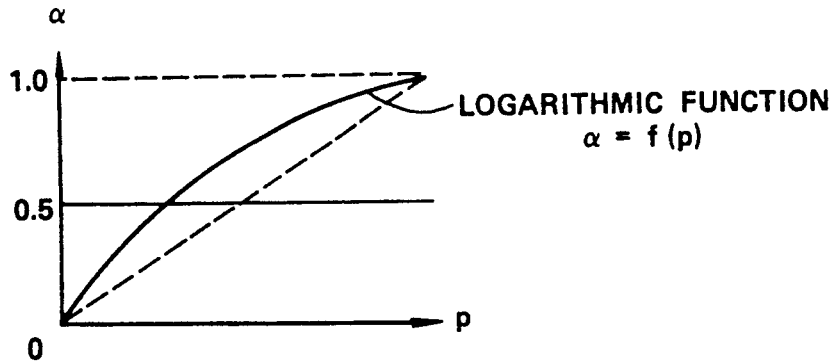
Figure 44A:
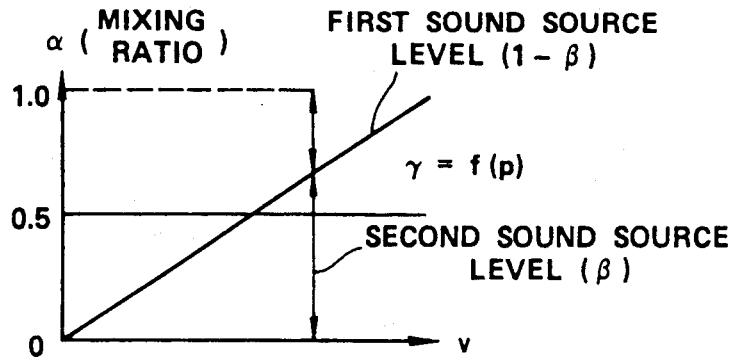
FIGS. 44A, 44B and 44C are views showing other conversion functions used in converter 206.
Figure 44B:
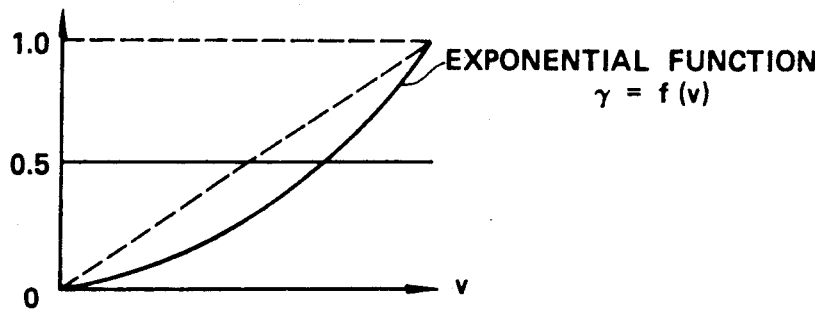
Figure 44C:
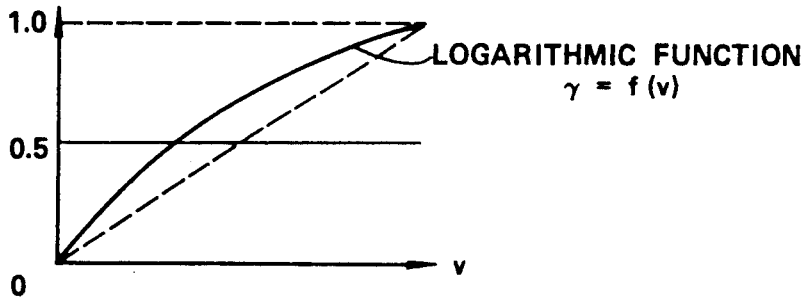

Therefore, with this arrangement, the mixing ratio of the two musical tones can be controlled by the plucking strength and the vibration period of a string. FIGS. 43A, 43B and 43C show conversion characteristics of first tone color mixing ratio data generator 206, and FIGS. 44A, 44B and 44C show conversion characteristics of second tone color mixing ratio data generator 209. Each figure shows linear conversion (FIGS. 43A and 44A), exponential conversion (FIGS. 43B and 44B), and logarithmic conversion (FIGS. 43C and 44C).

First and second sound sources 204 and 205 can employ appropriate digital sound source modules (e.g., PCM sound source, sine wave mixing sound source, subtraction type sound source, phase distortion (PD) sound source, and frequency modulation (FM) sound source). In the above embodiment, sound sources 204 and 205 are realized by the modules of PCM sound source 70 (FIG. 8). Sound system 213 can employ an appropriate audio system. In the above embodiment, system 213 is realized by stereophonic sound system 190 (FIG. 8). When the stereophonic sound system is employed in the arrangement shown in FIG. 42, an identical musical tone number is input to the right and left stereophonic channels, and in practice, a monophonic tone is generated. Of course, adder 212 can be bypassed, so that the first musical tone output from multiplier 210 is input to the right stereophonic channel, and the second musical tone output from multiplier 211 is input to the left stereophonic channel.

In place of pitch extractor 20 for extracting pitch data from the pickup signal, a fret position detection apparatus for detecting an operated fret position from a pitch designation signal other than the pickup signal (e.g., the state of fret switches PSW, or a time for which an ultrasonic wave shuttles a string) can be used. In this case, a mixing ratio of musical tones from first and second sound sources is controlled depending on the fret position.

For the sake of simplicity, in FIG. 42, two multipliers 207 and 210 are illustrated along the output line of first sound source 204, and two multipliers 208 and 211 are illustrated along the output line of second sound source 205. However, it is preferable for the purpose of improving a processing speed and maintaining a musical tone level that multipliers 207 and 210 are constituted by a single multiplier for multiplying the musical tone from first sound source 204 with a mixing ratio (1-A) obtained by mixing coefficients $\alpha$ and $\gamma$, multipliers 208 and 211 are constituted by a single multiplier for multiplying the second musical tone from second sound source 205 with mixing ratio A obtained by mixing coefficients and Y. Data A is given by:

$$A = \frac{\alpha\gamma}{(1-\alpha)(1-\gamma)+\alpha\gamma}$$

When $\alpha=1$ and $\gamma=0$ or $\alpha=0$ and $\gamma=1$, $A=\frac{1}{2}$.

The sum of weight coefficient W1 of the first musical tone and weight coefficient W2 of the second musical tone need not be constant ("1"). In FIG. 42, if $\overline{\alpha}$ is used in place of (1-$\alpha$) and $\overline{\gamma}$ is used in place of (1-$\gamma$)

($0 \leqq \overline{\alpha} \leqq 1$ and $0 \leqq \overline{\gamma} \leqq 1$), W1 is given by:

$$W1=\overline{\alpha}.\overline{\gamma}/(\overline{\alpha}.\overline{\gamma}+\alpha.\gamma)$$

W2 is given by:

$$W2=\alpha.\gamma/(\overline{\alpha}.\overline{\gamma}+\alpha.\gamma)$$

In the above embodiment, conversion functions used in first and second mixing ratio data generators 206 and 209 are selected in the function assignment mode (screen (f) in FIG. 38B).

Figure 45:
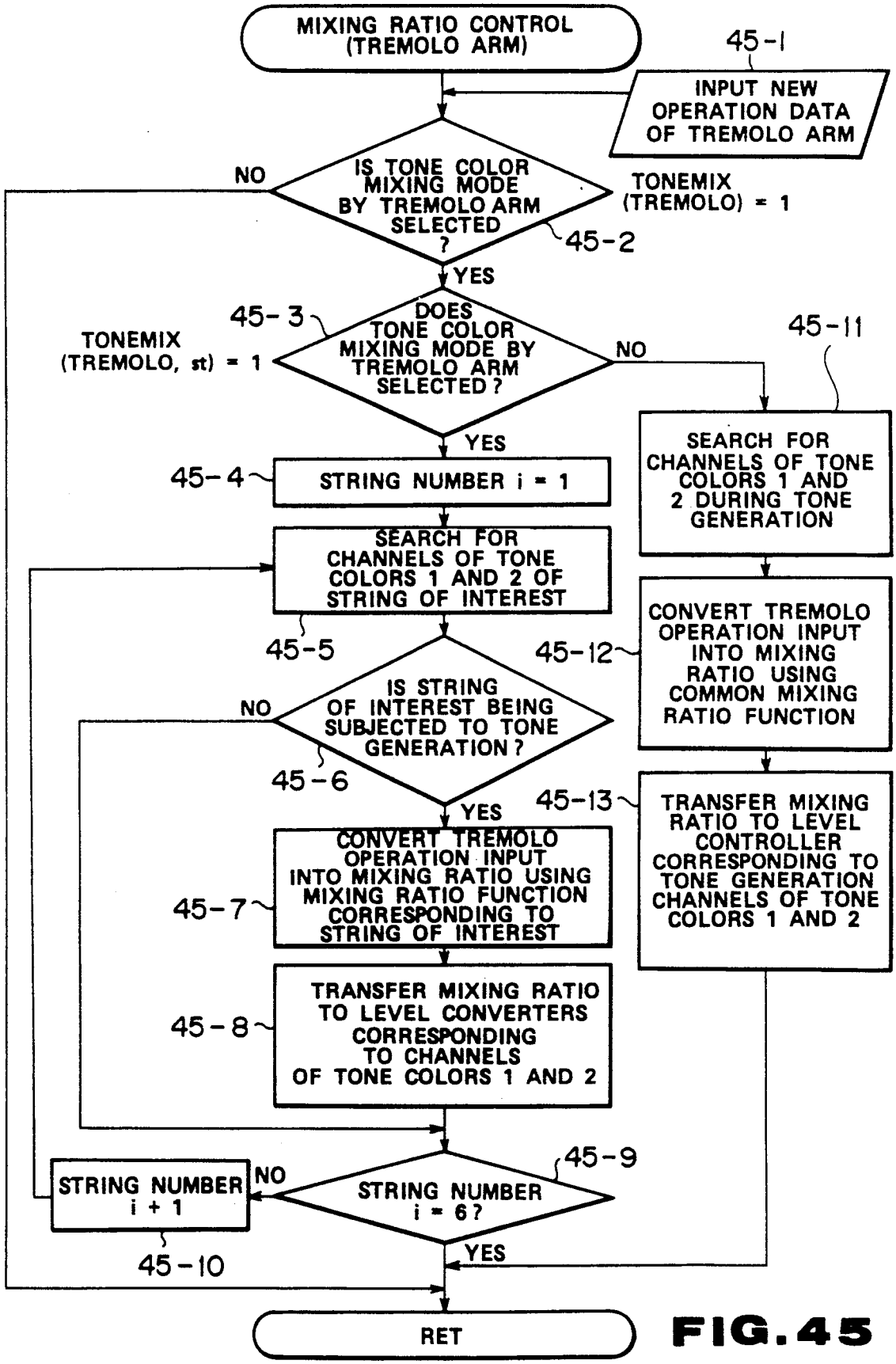
FIG. 45 is a flow chart of tone color mixing ratio control by a tremolo arm.

FIG. 45 shows a routine executed by CPU 40 or 40M in order to control a tone color mixing ratio in accordance with an operation amount from tremolo arm 11. This routine is started when the input from tremolo arm 11 changes, and new operation data of the tremolo arm is input as input data (45-1). In step 45-2, CPU 40 or 40M checks if tremolo arm 11 controls the tone color mixing ratio. This can be determined based on the content of flag TONE MIX (TREMOLO) generated in the function assignment mode described above. If this flag is set, the tone color mixing ratio is controlled; otherwise, tremolo arm 11 does not influence the tone color mixing ratio. When tremolo arm 11 controls the tone color mixing ratio, it is checked in step 45-3 if the control depends on types of string. This can be determined based on the content of flag TONE MIX (TREMOLO, ST) generated in the function assignment mode.

When the condition of step 45-3 is established, the first string is selected in step 45-4. In step 45-5, two sound source channels corresponding to the selected first string, i.e., a sound source channel producing the first musical tone and a sound source channel producing the second musical tone are retrieved with reference to key-assign data. When the channels are detected, the musical tones associated with the string are being produced; otherwise, no musical tones associated therewith are produced (45-6). If the two musical tones are being produced, operation data of tremolo arm 11 is converted to a tone color mixing ratio using a mixing ratio function selected for the string, i.e., a function selected by the user in the function assignment mode, and the mixing ratio is transferred to the first and second sound source channels producing the musical tones associated with the string (45-7 and 45-8). Thus, the mixing ratio of the musical tones generated for the first string is controlled in accordance with the operation amount of tremolo arm 11 and in a mode unique to the string. Processing in steps 45-5 to 45- is repeatedly executed for all the strings (45-9 and 45-10).

When the mixing ratios of the musical tones of all the strings are similarly controlled by the operation amount of tremolo arm 11, all the sound source channels producing first type musical tones and all the sound source channels producing second type musical tones are searched in step 45-11. The input data of tremolo arm 11 is converted to tone color mixing ratio data using a common mixing ratio function, and the converted data is transferred to the channels retrieved in step 45-11 (45-12 and 45-13). Thus, the mixing ratios of musical tones of all the strings are uniformly controlled in accordance with the operation amount of tremolo arm 11.

Figure 46:
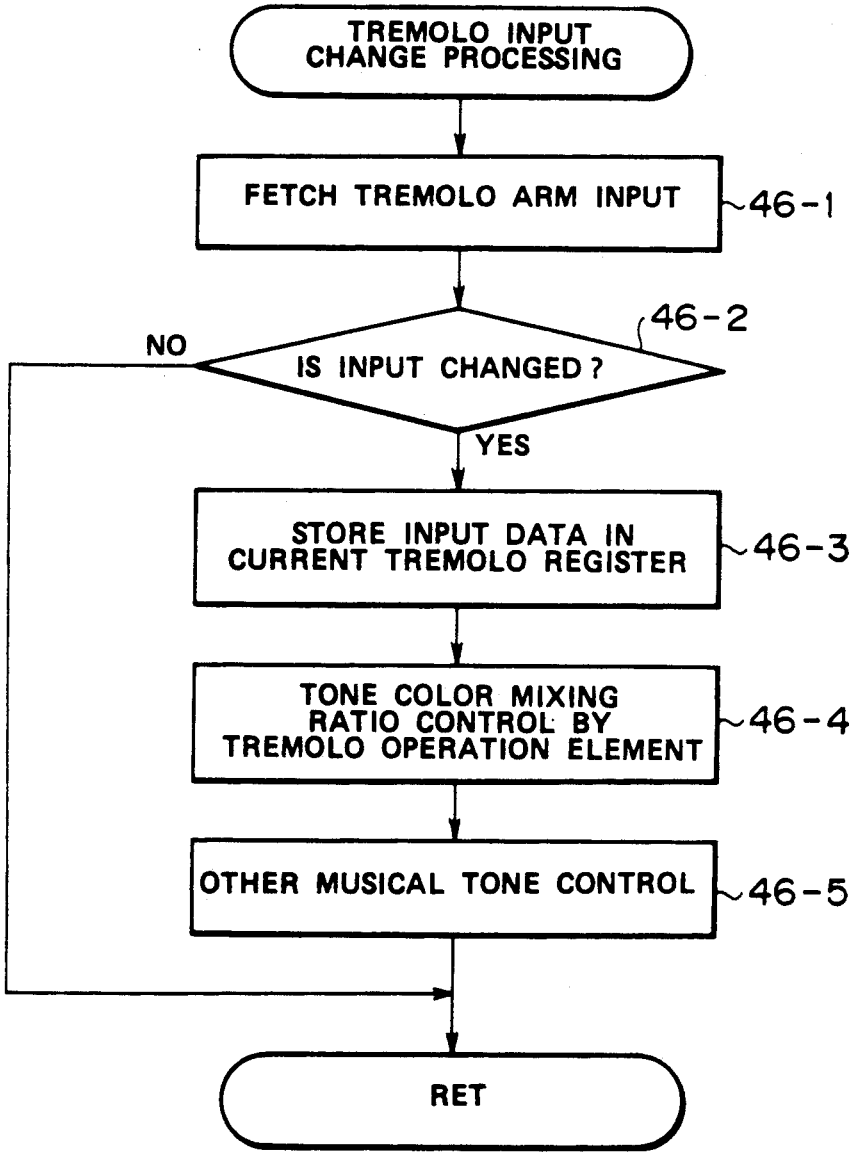
FIG. 46 is a flow chart of tremolo arm input change processing and tone control processing with respect to the change.

FIG. 46 is an input change processing routine of tremolo arm 11, and is illustrated to show when the routine shown in FIG. 45 should be executed. Step 46-5 corresponds to the routine shown in FIG. 45. Since other musical tone control functions can be assigned to tremolo arm 11 in the function assignment mode, other musical tone control routine 46-5 is provided in order to realize those musical tone control functions.

Although not shown, when generation of a musical tone for a string is started, tone color mixing ratio data obtained by converting the input from tremolo arm 11 is generated and transferred to the sound source. This processing is similar to the routine shown in FIG. 45, but is executed for a string for which generation of a musical tone is started. In this processing, as data representing the operation amount of tremolo arm 11, a current value stored in a current tremolo register is used (see step 46-3).

In the above embodiment, the mixing ratio of tone colors can be controlled by an arbitrary combination of a vibration period (in the case of pitch extraction type electronic guitar 1) or a fret position (in the case of fret switch type electronic guitar 1M), a plucking strength, and an operation amount of tremolo arm 11.

According to the present invention, tone color control other than tone color mixing ratio control can be employed.

Figure 47:
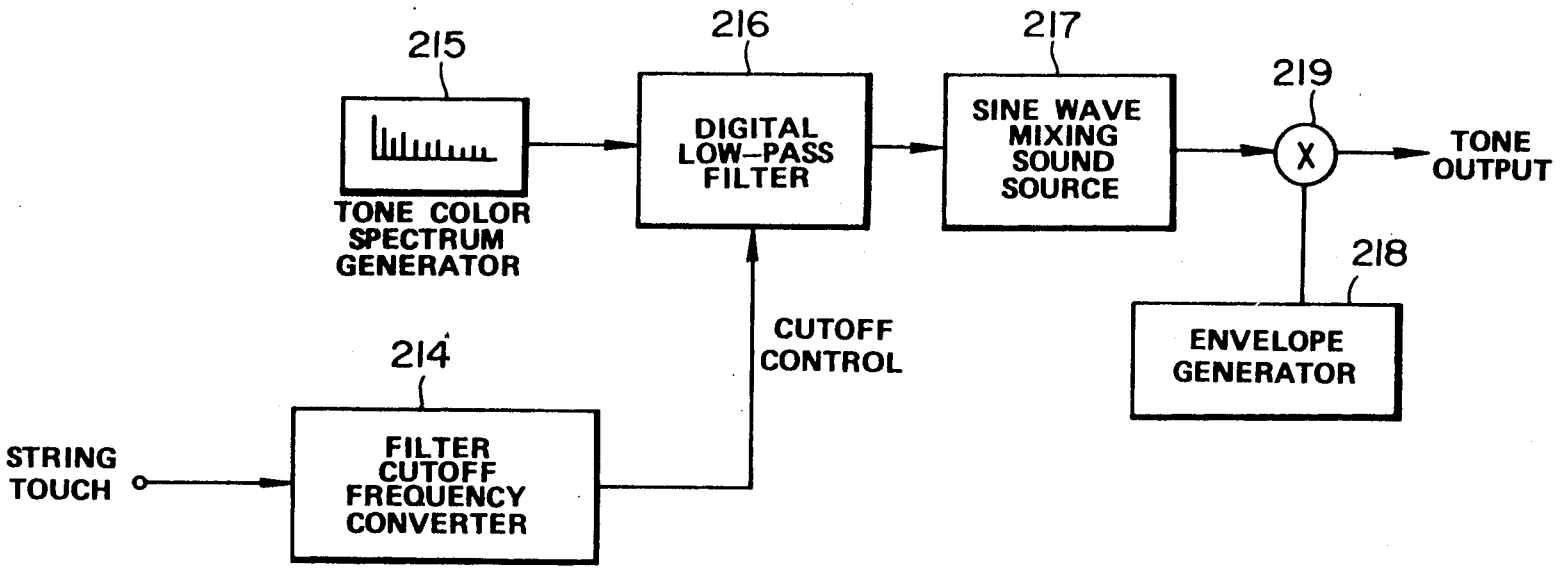
FIG. 47 is a diagram showing a part of a system according to the present invention for controlling a tone spectrum according to a plucking strength.

FIG. 47 shows such a case. In this case, a musical tone spectrum is controlled by string touch data. As a sound source, sine wave mixing sound source 217 is used. String touch data is supplied to converter 214, and is converted to cutoff frequency data for digital low-pass filter 216 in accordance with its conversion characteristics (e.g., illustrated in FIG. 48B). Musical tone spectrum generator 215 generates a magnitude (weight coefficient) of each frequency component of a musical tone. Typically, generator 215 generates weight data such as a fundamental tone weight, a first overtone weight, second overtone weight, . . . , Nth harmonic overtone weight (see FIG. 48A). Digital low-pass filter 216 has filter characteristics illustrated in FIG. 48C. Filter 216 uses data, supplied from converter 214, for changing the weight of the frequency component from musical tone spectrum generator 215, as a cutoff frequency and, more specifically, leaves the weight of a frequency component lower than the cutoff frequency unchanged and decreases the weight of the frequency component higher than the cutoff frequency in accordance with their frequency difference. A set of updated weights of frequency components is supplied to sine wave mixing sound source 217. Sound source 217 includes sine wave generating modules corresponding in number to number N of frequency components generated by musical tone spectrum generator 215, and sine wave signals of respective orders are generated by sine wave generating modules. The output of each sine wave generating module is coupled to corresponding multiplier 219, and is multiplied with a weight of a corresponding order. The outputs from multipliers 219 are input to a plurality of multipliers 219 (generally illustrated), and are multiplied with envelopes of corresponding orders supplied from envelope generator 218. The outputs from multipliers 219 are accumulated (not shown), thus obtaining a musical tone output signal.

Data other than string touch data, e.g., operation data of tremolo arm 11 or vibration period data can be input to converter 214.

Tone Volume Control

Figure 50A:
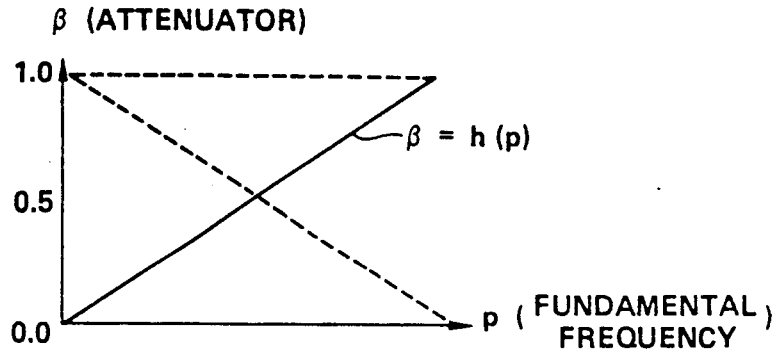
FIGS. 50A, 50B and 50C are views showing conversion functions used in converter 221 shown in FIG. 49.
Figure 50B:
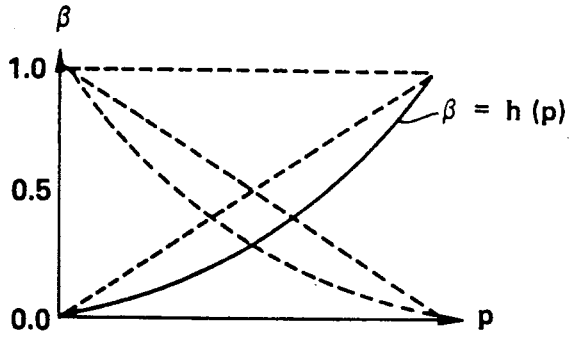
Figure 50C:
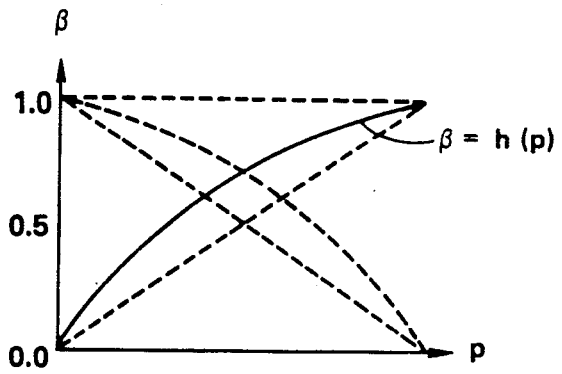

FIG. 49 is a functional block diagram of an electronic guitar system in which a tone volume of a musical tone is controlled by a vibration period of a string. As shown in FIG. 49, a fundamental period of a string vibration from pitch extractor 201 is converted to tone volume control parameter $\beta$ by converter 221. FIGS. 50A, 50B and 50C are views showing conversion functions used in converter 221 shown in FIG. 49. The converted data is supplied to multiplier 222, and is multiplied with a musical tone signal from sound source 220. Therefore, the volume of a musical tone is controlled in accordance with the vibration period of a string.

Figure 51:
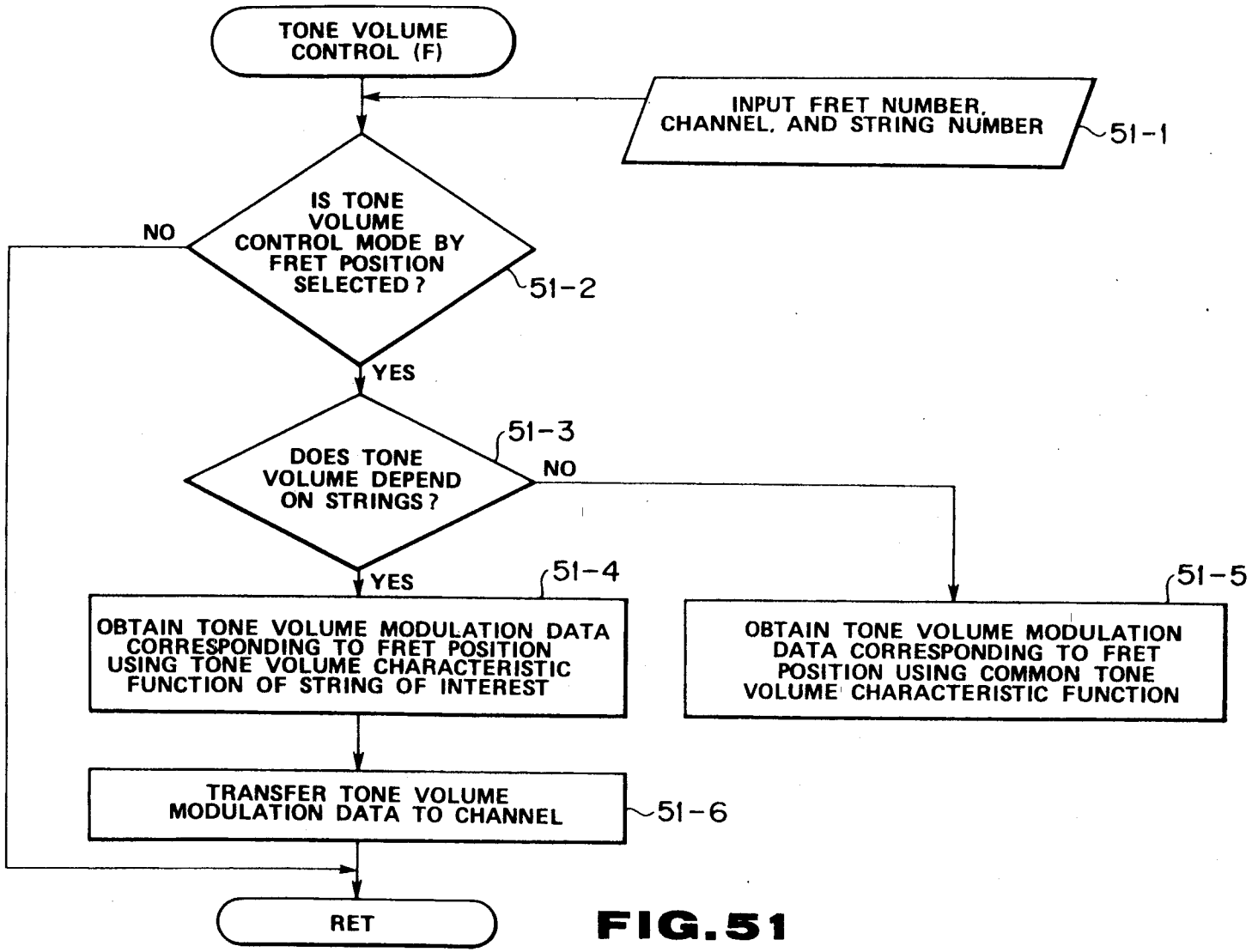
FIG. 51 is a flow chart of changing a tone volume according to a fret position.

FIG. 51 shows a tone volume control routine based on a fret position, executed by CPU 40M. This routine is started when an operated fret position is changed during generation of a musical tone associated with specific fret string 7F or at the beginning of generation of a musical tone associated with the fret string 7F. In this routine, as input data, a fret position, a string number, and a channel number of a sound source which generates a musical tone associated with the string are input (51-1). In step 51-2, CPU 40M checks if tone volume control based on the fret position is selected. If it is selected, it is checked in step 51-3 if the current selection of function assignment corresponds to tone volume control depending on types of string. If a condition of step 51-3 is established, fret position data is converted to tone volume modulation data using a tone volume characteristic function selected for the given string, and the converted data is transferred to the channel which produces the musical tone associated with the string (51-4 and 51-6). If the current selection of function assignment corresponds to tone volume control common to all the strings, fret position data is converted to tone volume modulation data using a selected common tone volume characteristic function, and the converted data is transferred to the corresponding channels (51-5 and 51-6).

As can be seen from the above description, when a user selects tone volume control based on a fret position in the function assignment mode, tone volume control based on the fret position is executed in this routine. Furthermore, when the user determines that the tone volume control based on the fret position is performed depending on types of string and selects the tone volume characteristic functions for respective strings, control is made in this routine according to the selections. Note that if the user determines that the tone volume control based on the fret position is performed depending on types of string but does not select the tone volume characteristic function for the respective strings in practice, predetermined functions are used in step 51-4. When the user does not require the tone volume control based on the fret position in the function assignment mode, control is made accordingly. More specifically, a tone volume is not changed depending on a change in fret position. Transfer processing 51-6 will be additionally explained. Sound source 70 incorporates an interpolation circuit (not shown) which calculates a target value of a tone volume level in accordance with tone volume modulation data (musical tone amplitude control data) supplied from CPU 40 during generation of a musical tone of a specific channel, and performs interpolation of the target value and weight data currently used in the multiplier in practice, thereby calculating next weight data input to the multiplier. With this circuit, generation of noise can be prevented.

Figure 52:
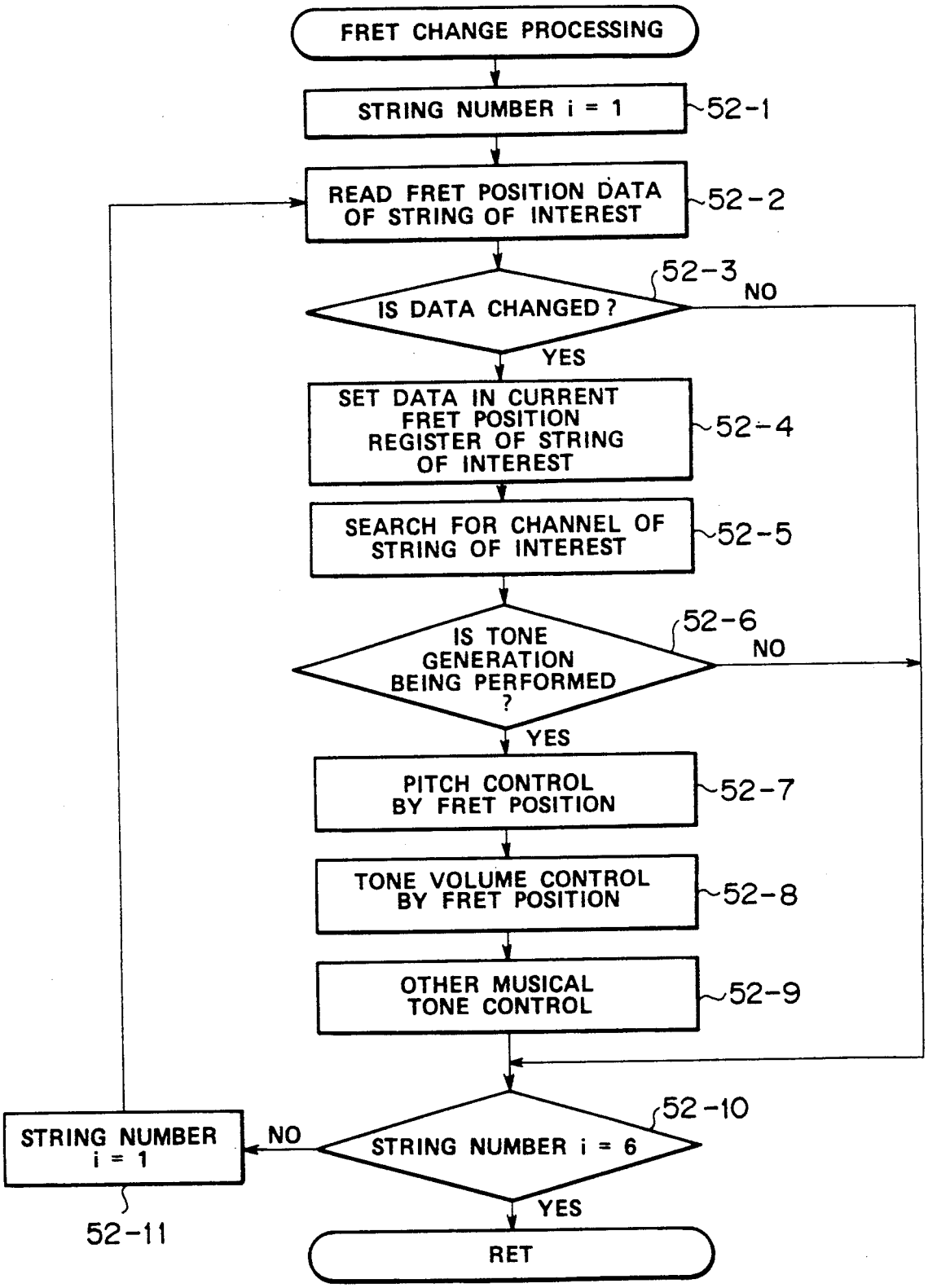
FIG. 52 is a flow chart of detection of a change in fret position and tone control for detection.

FIG. 52 is a flow chart of detection of a change in fret operation position in units of strings and musical tone control processing for the detection. Step 52-7 corresponds to the routine shown in FIG. 51. The routine shown in FIG. 51 is executed at the beginning of generation of a musical tone for a given string.

In the above embodiment, performance inputs which can be assigned to a tone volume control function are a vibration period of a string (or fret position), an operation amount of the tremolo arm, and a plucking strength. Each assignment selection includes alternative selection items for determining whether control is made in units of strings or common to strings. As for the plucking strength (touch data), if a user does not assign the plucking strength to musical tone control elements using tone parameter setting panel 16, a tone volume is changed in accordance with a change in plucking strength. In this case, CPU 40 or 40M converts the plucking strength into tone volume modulation data using a predetermined conversion function.

Pitch Control

Figure 53:
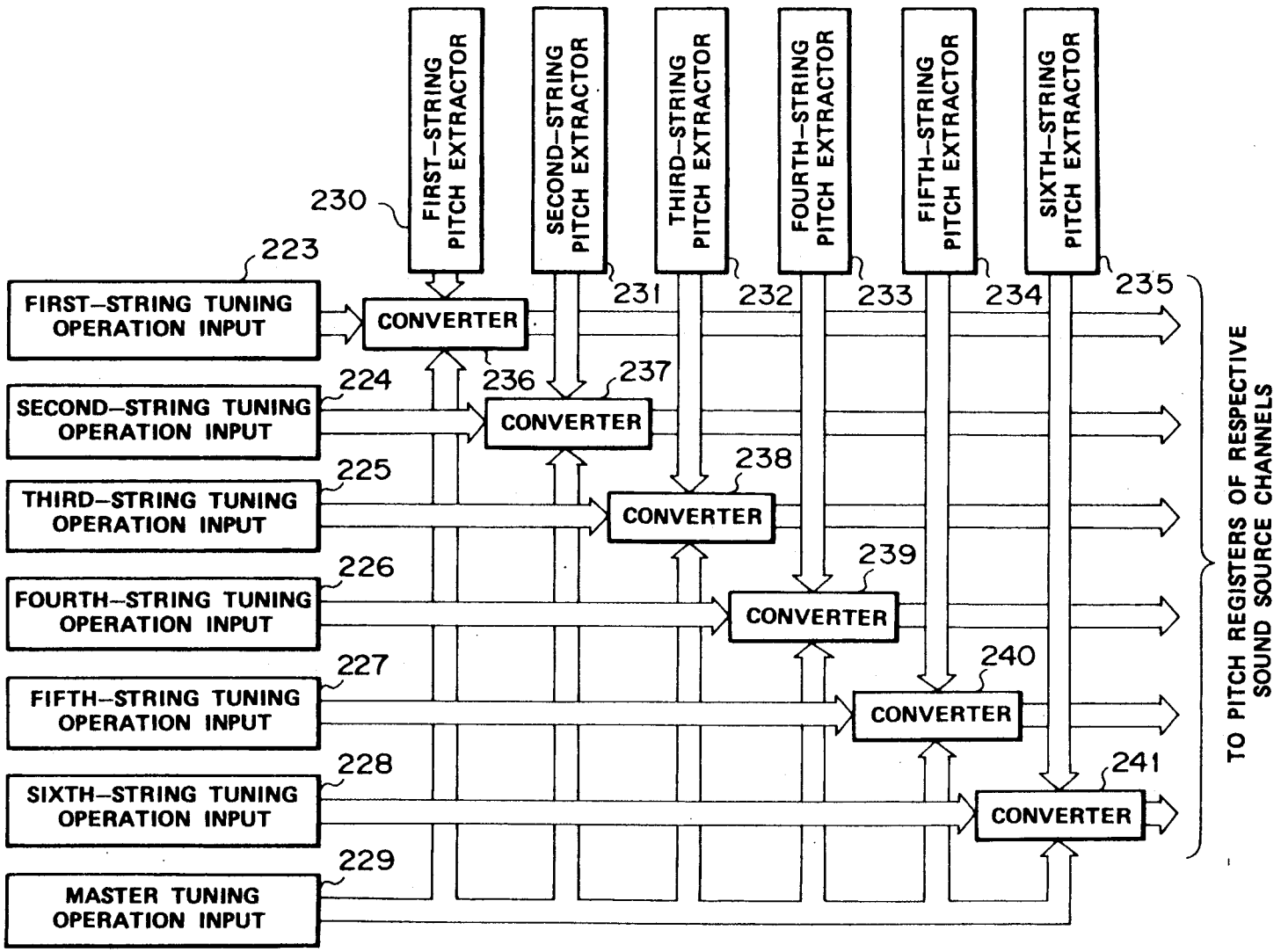
FIG. 53 is a circuit diagram of a circuit arrangement for changing a pitch by a tuning operation element according to the present invention.

FIG. 53 is a functional block diagram of an arrangement for changing a pitch of a musical tone by tuning operation element 15 (FIG. 1) of the electronic guitar. In FIG. 53, each of converters 236 to 241 generates pitch data of a musical tone from three inputs. Converter 236 is used for the first string; converter 237 is used for the second string, . . . , and converter 241 is used for the sixth string. Converter 236 receive data from first-string pitch extractor 230, input data 223 from first-string tuning operation element 15S-1 (FIG. 1), and input data 229 from master tuning operation element 15M, and calculates pitch data of a musical tone for the first string based on these input data. The calculated pitch data is supplied to a pitch register of a sound source channel for producing a musical tone of the first string. Thus, the pitch of a string vibration extracted by first-string pitch extractor 230 is changed in accordance with operation amounts of first-string tuning operation element 15S- and/or master tuning operation element 15M, and serves as a pitch of a musical tone generated for the first string. Since data 223 to 229 of the tuning operation elements for the respective strings are input to corresponding converters 236 to 241, the updated pitches are effective only for musical tones of the corresponding strings. Meanwhile, since data from master tuning operation element 15M is input to all converters 236 to 241, the updated pitch is uniformly effective for musical tones of all the strings. Therefore, in some case, a player can enjoy playing the guitar wherein musical tones of all the strings 7 are similarly pitch modulated using master tuning operation element 15M. In some case, he can operate tuning operation elements 15S in units or selectively for each of the strings to enjoy playing the guitar wherein musical tones of desired strings are pitch-modulated. The function described with reference to FIG. 53 is assembled in the above embodiment (pitch extraction type electronic guitar 1).

Figure 54:
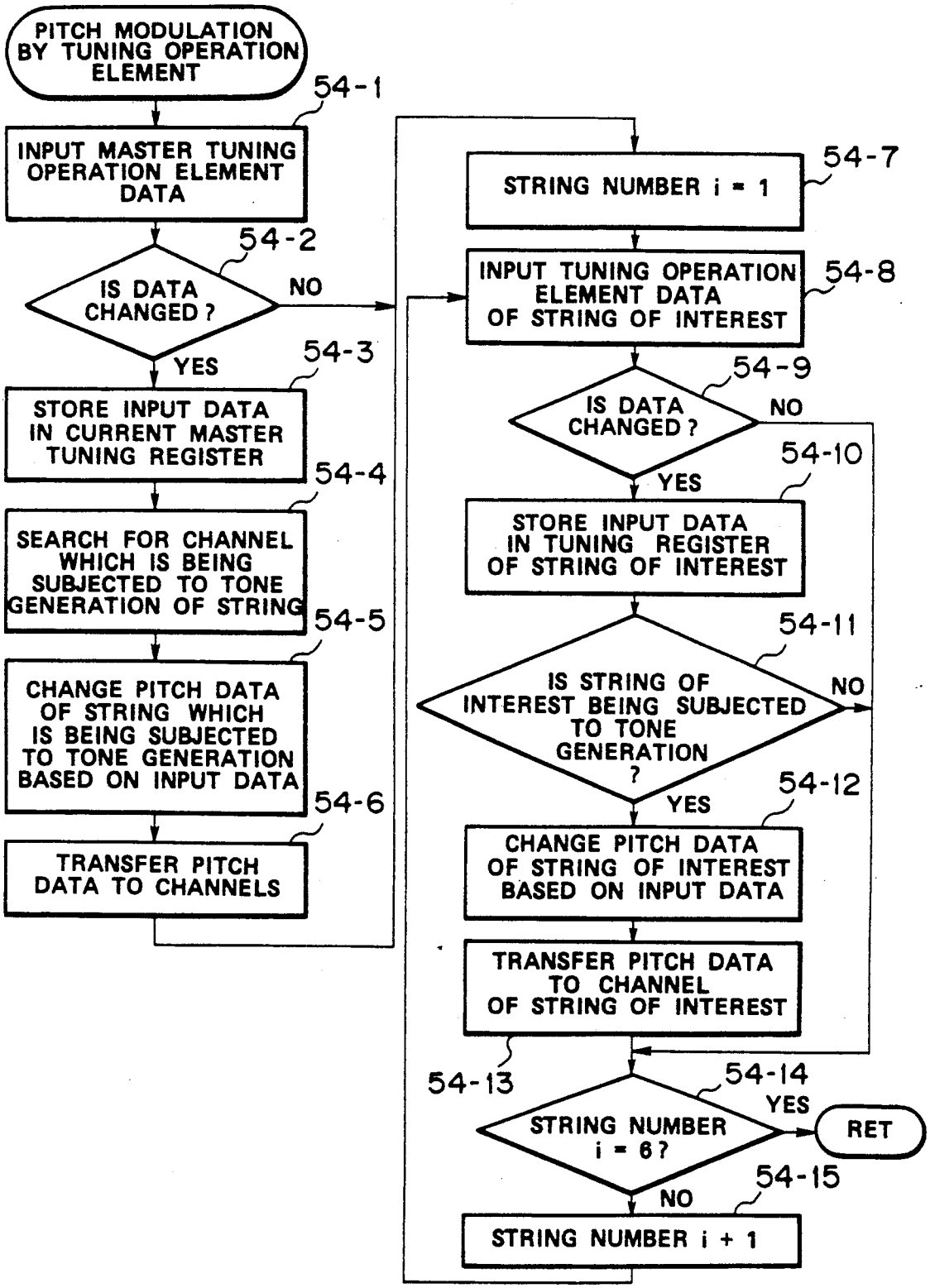
FIG. 54 is a flow chart of changing a pitch by the tuning operation element.

This function is realized by the routine shown in FIG. 54. In steps 54-1 to 54-6, detection of a change in data from master tuning operation element 15M and updating processing of pitch data upon detection are performed. In steps 54-9 to 54-15, detection of a change in data from tuning operation elements 15S in units or selectively for each of the strings and pitch updating processing of musical tones of the corresponding strings upon detection are performed.

Figure 55:
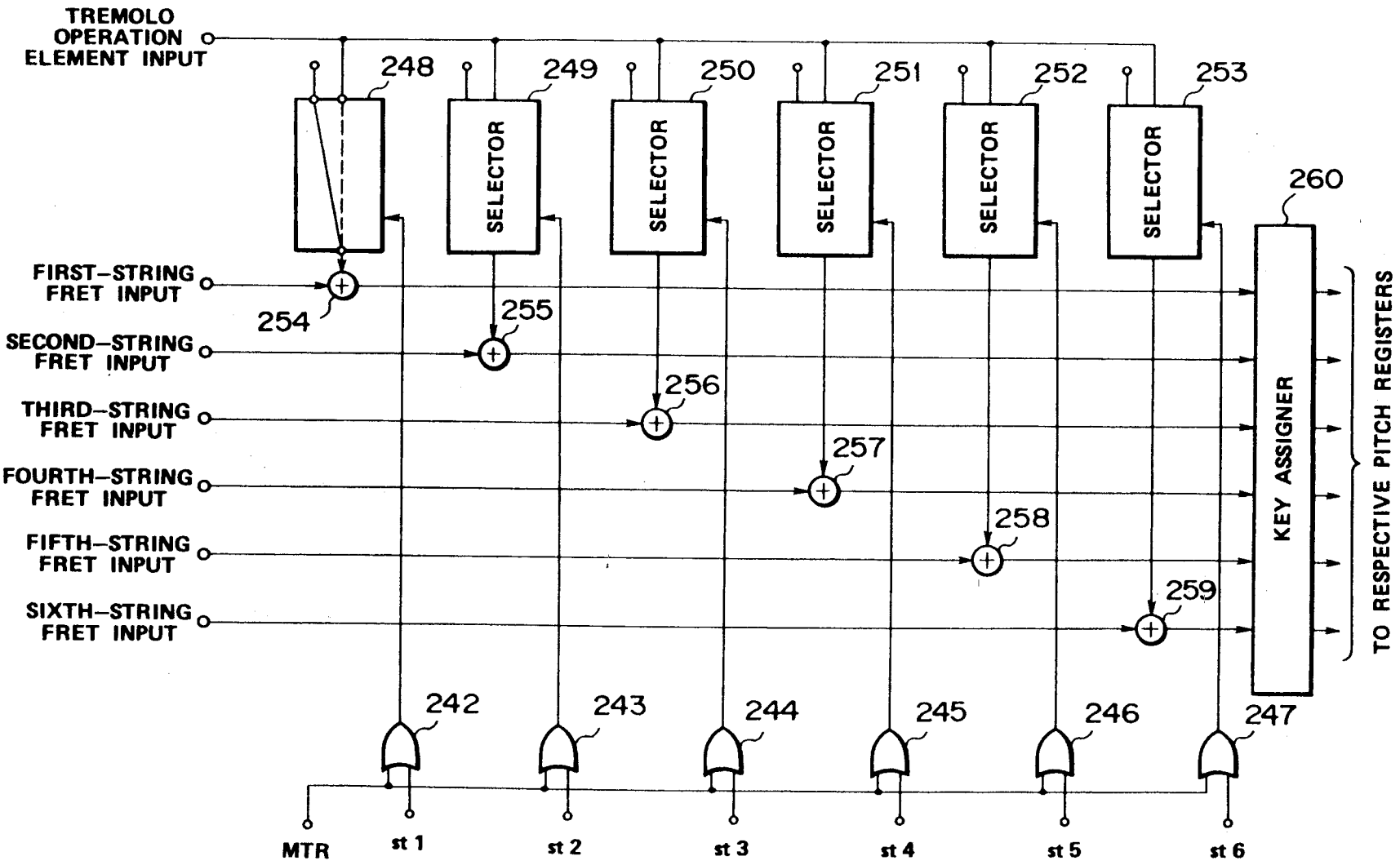
FIG. 55 is a partial circuit diagram of a system of the present invention for changing a pitch of all the strings or in units of strings by a tremolo arm.

FIG. 55 is a functional block diagram of an arrangement for controlling pitches of musical tones commonly in all the strings or in units of strings. In FIG. 55, reference symbol MTR denotes a state input (at logic "1" when the switch is ON) of master switch 348; and st1 to st6, state inputs of string selection switches 354 provided in correspondence with the first to sixth strings. OR gates 242 to 247 receive the state inputs from master switch 348 and string selection switches 354, and generate outputs at logic "1" when any of these switches is ON. The outputs from OR gates 242 to 247 are input to selection control gates of selectors 248 to 253, respectively. The data inputs of all selectors 248 to 253 receive data from tremolo arm 11. Each of selectors 248 to 253 generates tremolo operation data when the signal from a corresponding one of OR gates 242 to 247 is at logic "1", and outputs zero when it is at logic "0". The outputs from selectors 248 to 253 are input to corresponding adders 254 to 259. The second inputs of adders 254 to 256 receive pitch data determined by operated fret positions of the corresponding strings. Therefore, when selection control signals of logic "0" are supplied to corresponding selectors 248 to 253, the outputs from adders 254 to 256 serve as pitch data determined by the operated fret positions of the corresponding strings. When the selection control signals of logic "1" are supplied to corresponding selectors 248 to 253, the outputs from adders 254 to 256 become values corresponding to sums of pitch data determined by the operated fret positions of the corresponding strings (linear-expression key codes) and operation amount data of tremolo arm 11.

The outputs from adders 254 to 259 are transferred to pitch registers of sound source channels for producing musical tones of corresponding strings through key assigner 260.

In this arrangement, after master switch 348 is depressed, musical tones of all the strings are uniformly pitch-modulated in accordance with the operation amount of tremolo arm 11. After string selection switch 354 is depressed only a musical tone associated with the selected string is pitch-modulated.

Figure 56:
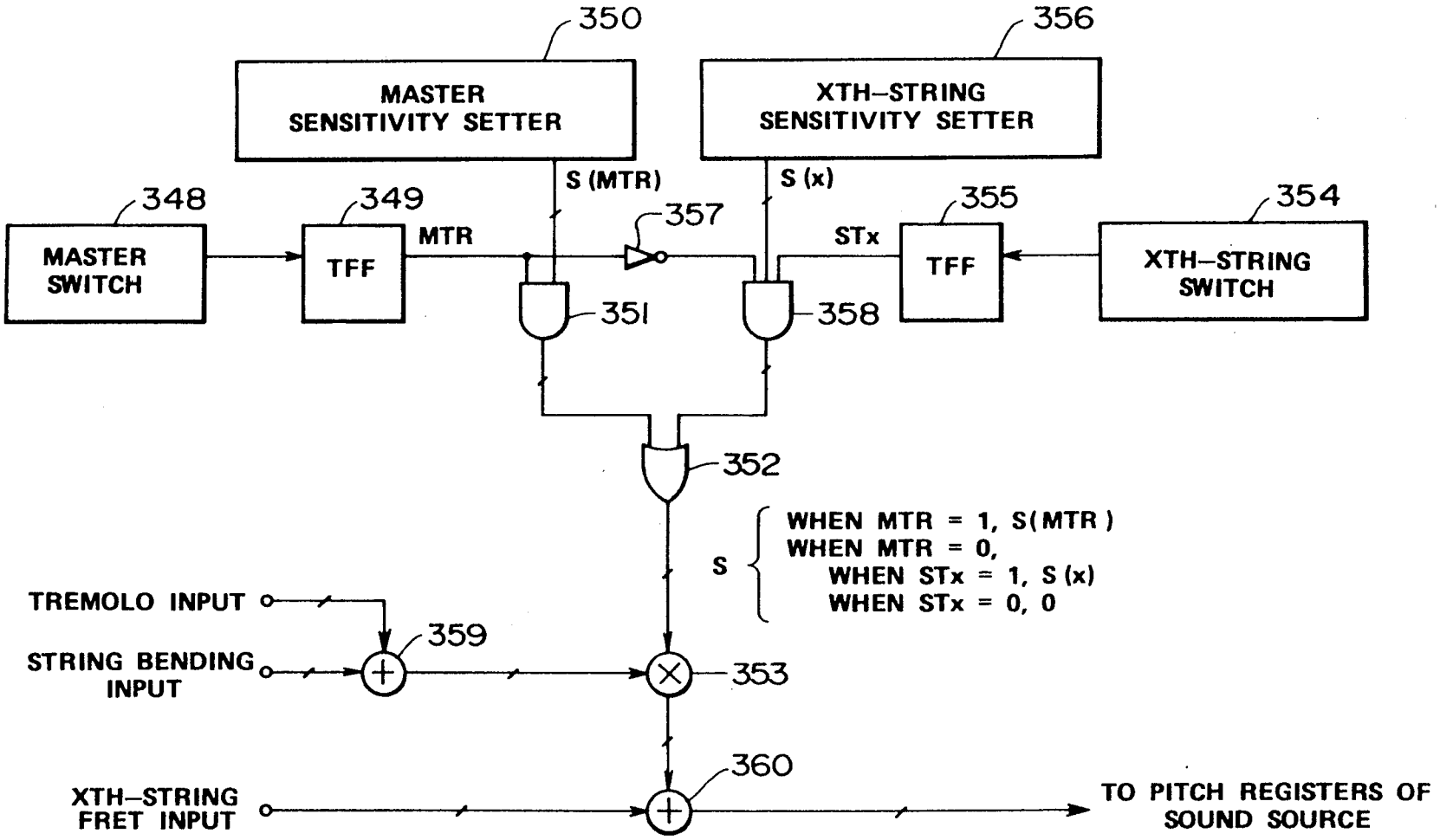
FIG. 56 is a partial circuit diagram of a system of the present invention for changing a pitch with a variable sensitivity by an arming or string-bending operation element.

FIG. 56 is a functional block diagram of an arrangement wherein pitches of musical tones of strings can be controlled depending on states of master switch 348 and string selection switch 354 and sensitivity data in accordance with an operation amount of tremolo arm 11 and/or a string-bending input from string-bending sensor 110. Master switch 348, toggle flip-flop (TFF) 349, master sensitivity setter 350, and gate 351 are connected as shown in FIG. 56. When a "master" mode is selected by master switch 348, gate 351 outputs master sensitivity data set by master sensitivity setter 350. When the "master" mode is canceled, gate 351 outputs data "zero". The master sensitivity data is input to multiplier 353 through gate 352. Xth string selection switch 354, TFF 355, setter 256 for setting a pitch sensitivity for an xth string, master switch 348, TFF 349, inverter 357, and gate 358 are connected as shown in FIG. 56. When the "master" mode is selected or a "string" mode is canceled by xth string selection switch 354, gate 358 outputs data "zero". When the "master" mode is canceled and "string" mode is selected by xth string selection switch 354, gate 358 outputs sensitivity data set by xth string sensitivity setter 356. In the latter case, the sensitivity data is input to multiplier 353 through gate 352.

The second input of multiplier 353 receives the sum of data from tremolo arm sensor 23 and data from string-bending sensor 110 through adder 359. Therefore, multiplier 353 multiplies data from gate 35 with data from adder 359 The output from multiplier 353 is input to adder 360, and is added to pitch data determined by the operated fret position of the xth string. The output from adder 360 is supplied to a pitch register of a sound source.

In this arrangement, the pitch-modulation sensitivities can be set by sensitivity setters 350 and 356 in accordance with the operation of tremolo arm 11 or a string-bending operation of strings 7 or 7F. One sensitivity is common to strings 7 or 7F, and the other sensitivity is inherent to strings 7 or 7F. Therefore, a degree of a change in pitch of a musical tone caused by the arming operation and/or string-bending operation can be desirably set, and whether pitch-modulation is made in units of strings or commonly in strings can be selected.

Tuning

Figure 57:
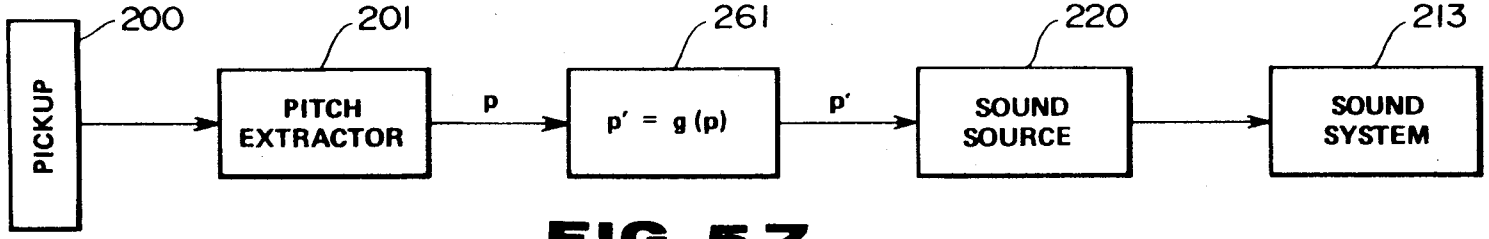
FIG. 57 is a functional block diagram of an electronic guitar for tuning an extracted pitch.

FIG. 57 is a functional block diagram of an electronic guitar system for correcting (tuning) a pitch extracted from a string vibration signal and causing a sound source to generate a musical tone using the tuned pitch. As shown in FIG. 57, pitch P from pitch extractor 201 is input to tuning section 261, and is converted to another pitch in accordance with tuning function g(P). Converted pitch data P' is supplied to sound source 220, and a musical tone of pitch P' is generated and supplied to sound system 213.

In FIG. 57, in place of pickup 200 and pitch extractor 201, a fret position detection apparatus for detecting an operated fret position of a string based on an input signal other than the pickup signal can be used.

Figure 58:
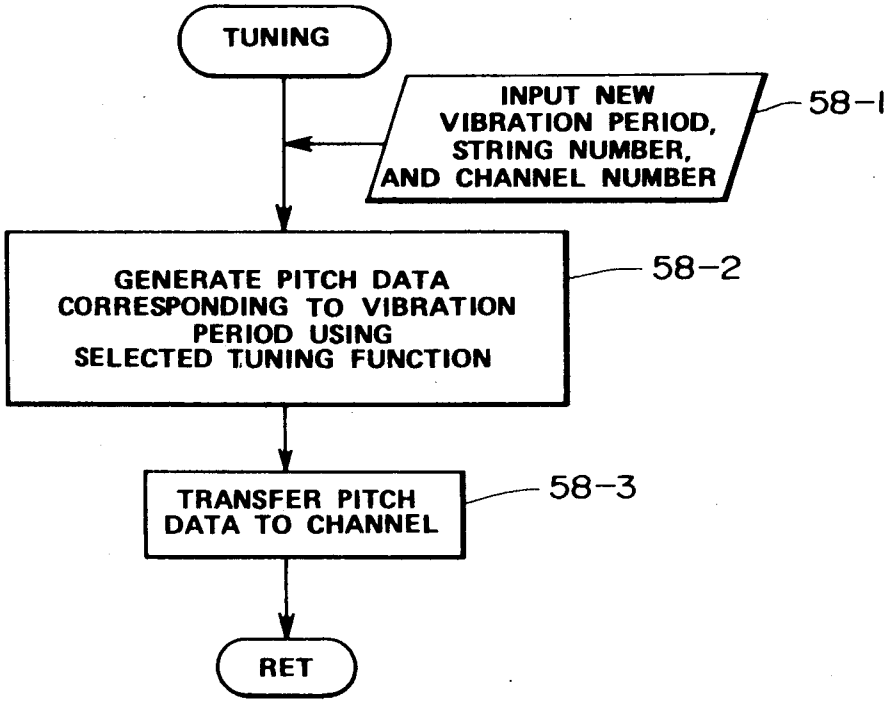
FIG. 58 is a flow chart of tuning.

The tuning function is incorporated in the above embodiment, and is realized by the function assignment function and the routine shown in FIG. 58 (for pitch extraction type electronic guitar 1). In this routine, as input data, a vibration period, a string number, and a channel number for producing a musical tone corresponding to the string are input (58-1). CPU 40 generates pitch data corresponding to a vibration period in accordance with a selected tuning function in step 58-2, and transfers the data to the corresponding sound source channel in step 58-3. The tuning function used in step 58-2 is a function selected in the function assignment mode described above (see FIG. 38B(d)).

Control Envelope

Figure 59:
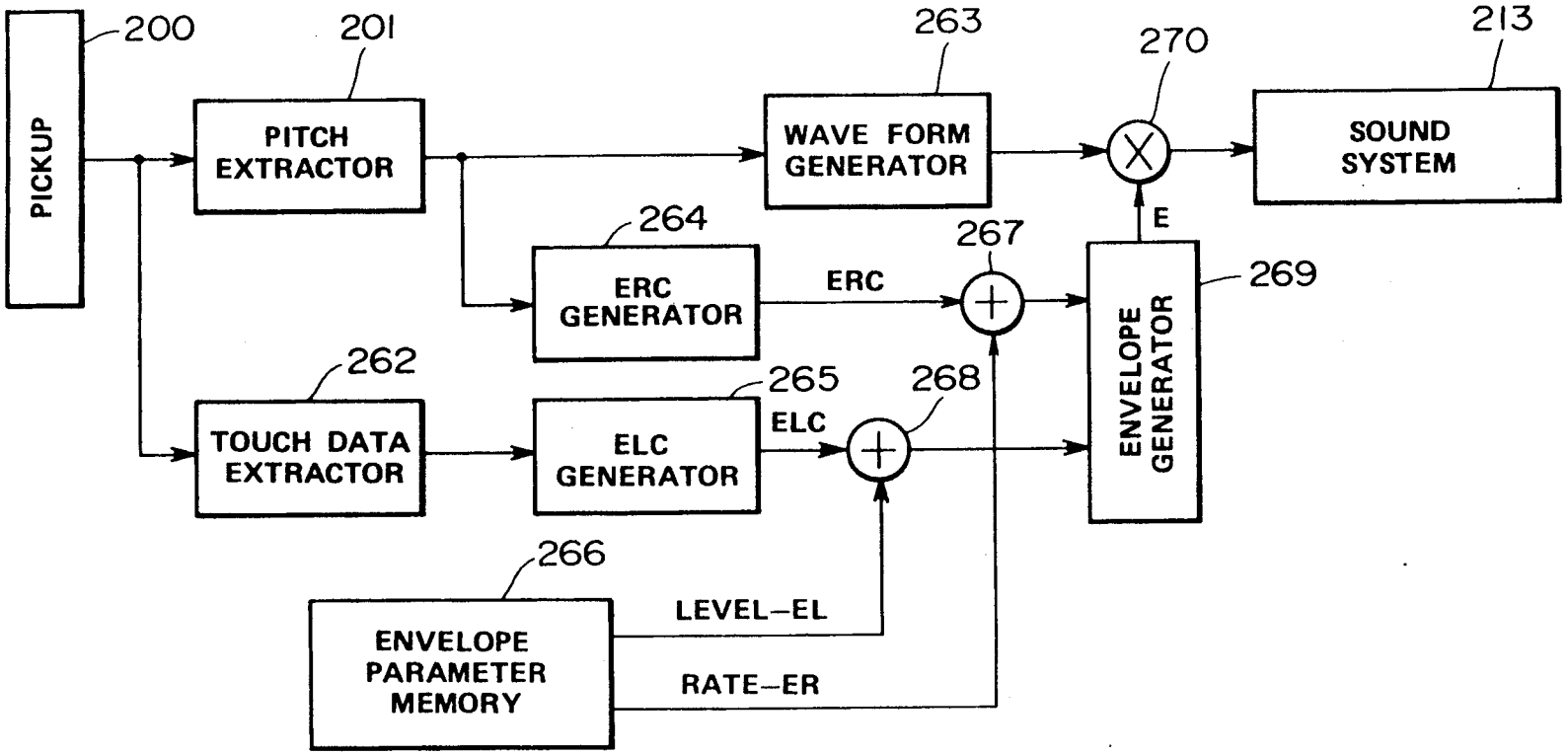
FIG. 59 is a functional block diagram of an electronic guitar of the present invention for controlling a tone envelope based on a vibration period of a string and a plucking strength.

FIG. 59 is a functional block diagram of an electronic guitar system in which an amplitude envelope of a musical tone is controlled by a vibration period of a string and string touch data.

A string vibration signal from pickup 200 is supplied to pitch extractor 201, and pitch data is extracted thereby. The pickup signal is supplied to touch data extractor 262, and string touch data is extracted. The pitch data from pitch extractor 201 is supplied to waveform generator 263, and a musical tone waveform signal having the input pitch is generated. The pitch data is input to envelope rate change parameter (ERC) generator 264, and is converted to a corresponding envelope rate change parameter. The extracted touch data is input to envelope level change parameter (ELC) generator 265, and is converted to a corresponding envelope level change parameter. The ERC parameter from ERC generator 264 is sent to adder 267, and is added to an envelope rate of each step from envelope parameter memory 266. The ELC parameter from ELC generator 265 is added to an envelope level of each step from envelope parameter memory 266 by adder 268. The envelope level of each step changed by adder 267 and the envelope rate of each step changed by adder 268 are supplied to envelope generator 269. Envelope generator 269 generates envelope E consisting of the envelope rate and envelope level of each step, and supplies the envelope to multiplier 270. Multiplier 270 multiplies the musical tone waveform signal from waveform generator 263 with envelope E from envelope generator 263, and outputs an amplitude-modulated musical tone waveform signal. The waveform signal is supplied to sound system 213.

Therefore, the amplitude envelope of a musical tone is controlled in accordance with the vibration period of a string and a plucking strength.

In the above embodiment, an operated fret position of a string (in the case of fret switch electronic guitar 1M) or an operation amount of tremolo arm 11 can be selectively assigned as a change factor of an envelope rate and/or a change factor of an envelope level in addition to the vibration period of the string (in the case of pitch extraction type electronic guitar 1) and the plucking strength. Envelope parameter change processing according to the function assignment schedule is executed by CPU 40 or 40M, and obtained data is transferred (from the CPU to sound source 70) at the beginning of generation of a musical tone for a specific string.

Figure 60:
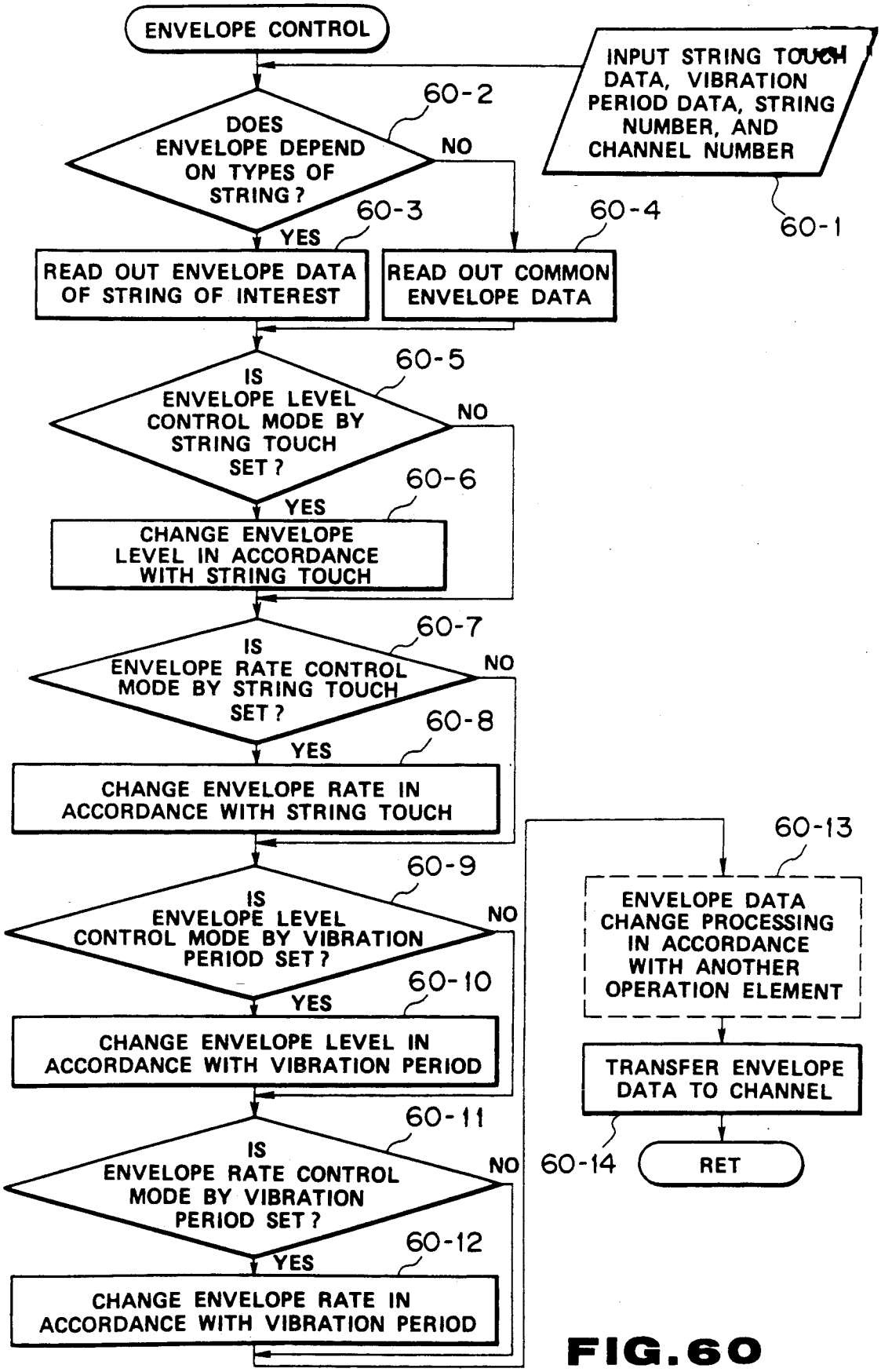
FIG. 60 is a flow chart of envelope control.

FIG. 60 shows an envelope control routine executed by CPU 40. This routine is one of subroutines of tone generation processing shown in FIG. 15. Therefore, in the routine which is started first when generation of a musical tone for a string is started, string touch data, string vibration period data, a string number, and a sound source channel number are input. It is checked in step 60-2 if the envelope depends on types of string. If item "string dependent" is selected in the envelope setting mode, this condition is established (see FIG. 40). In this case, envelope parameters selected for the string are loaded (60-3). On the other hand, when item "string common" is selected in the envelope setting mode, the condition of step 60-2 is not established. Therefore, common envelope parameters are loaded (60-4). Thereafter, these envelopes are changed in accordance with performance input data assigned as envelope parameter change factors in the function assignment mode (60-5 to 60-13), and the changed envelopes are transferred to the sound source channels (60-14). For example, if the user determines that the vibration period of a string is used as an envelope rate change factor (modulator) (screen (g) in FIG. 38B) in the function assignment mode, the condition shown in step 60-11 is established. In step 60-12, the vibration period is scaled by sensitivity data, and the obtained data is added to the envelope rate. The sensitivity data takes a positive value, zero, or negative value.

Although not employed in the above embodiment, the envelope parameter can be continuously changed in accordance with the operation amount of tremolo arm 11 and/or a change in vibration period over time.

Effect Control

As described above, digital effector 80 in the above embodiment comprises tremolo effector unit 800A, chorus effector unit 800B, delay effector unit 800C, and reverberation effector unit 800D (FIGS. 22, 24, 25, 26, and 27). A reference effect parameter to be used in each effector is set commonly in strings or in units of strings in the effector setting mode (FIG. 41). In the function assignment mode, it is determined which performance inputs are assigned to which effect parameter change factors and how the effect parameters are set by the assigned performance inputs (FIG. 38C). Effect mode selection switch 14 arranged on the body 2 of the guitar is monitored by CPU 40 or 40M. CPU 40 or 40M generates a master enable/disable signal in accordance with a change in state of the switch, and transfers it to effector 80. Effect mode selection switch 14 can be operated during guitar playing. During guitar playing, CPU 40 or 40M selectively calls reference effect parameters set in the effector setting mode in accordance with the present state of effect mode selection switch 14 in response to the inputs from the performance operation elements, and changes the effect parameters in accordance with the setting made in the function assignment mode. The changed parameters are transferred to effector 80. Thus, effect control by the performance operation elements can be achieved.

For example, tremolo effect control by the performance operation element will be explained below. From this description, other effect control operations (e.g., chorus, delay, and reverberation effect control operation will be readily understood.

Tremolo Control

Figure 61:
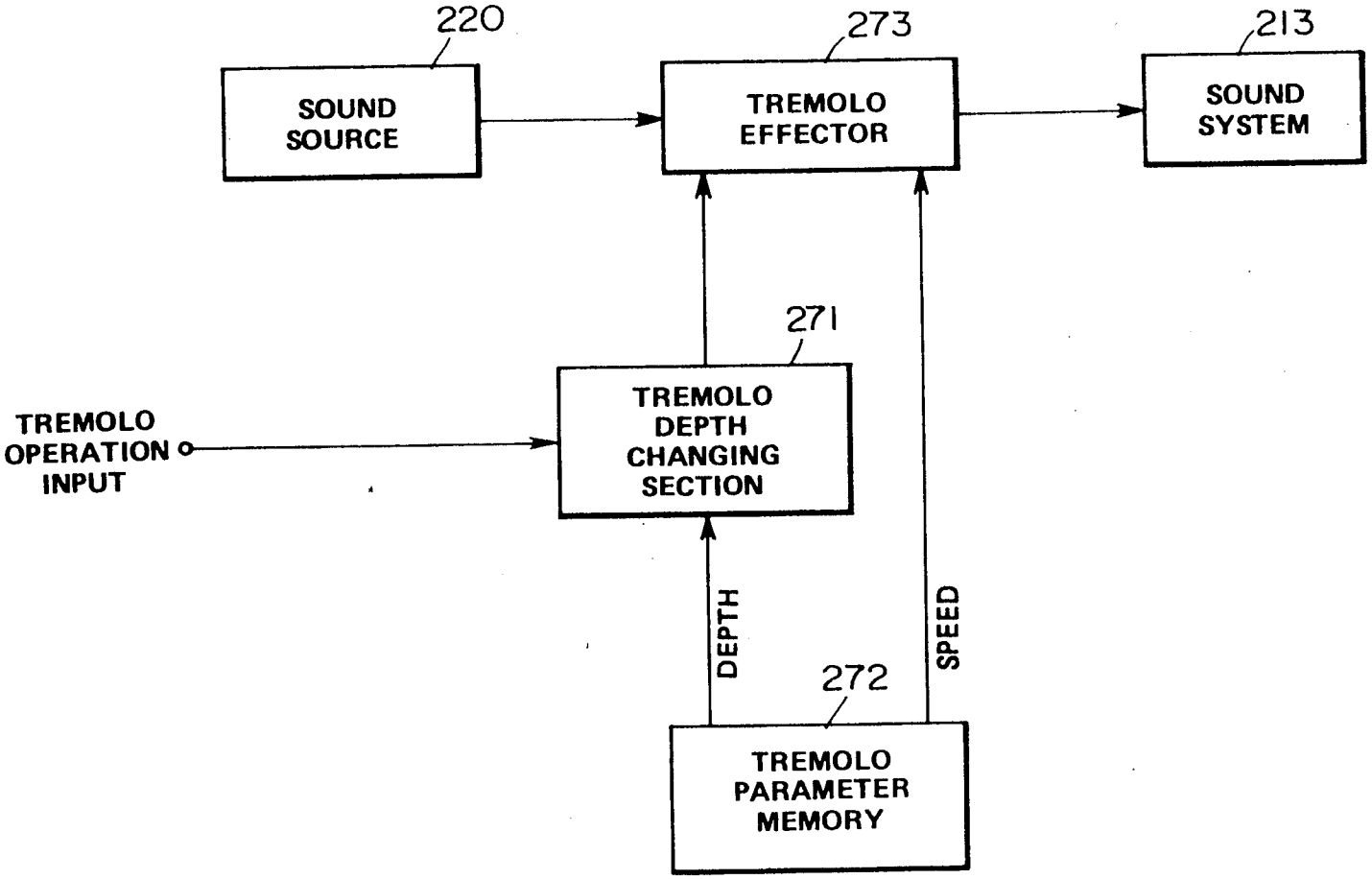
FIG. 61 is a functional block diagram of an electronic guitar of the present invention for controlling a depth of a tremolo effect by a tremolo arm.

FIG. 61 is a functional block diagram of an electronic guitar system in which a tremolo effector is controlled upon operation of tremolo arm 11. Operation data of tremolo arm 11 is supplied to tremolo depth changing section 271. Tremolo depth changing section 271 changes a tremolo depth parameter from tremolo parameter memory 272 using the input operation data of tremolo arm 11, and supplies the changed parameter to tremolo effector 273. On the other hand, the tremolo speed parameter in tremolo parameter memory 272 is directly supplied to tremolo effector 273. Tremolo effector 273 receives a musical tone signal from sound source 220, and adds the tremolo effect to the musical tone signal using the directly input tremolo speed parameter and the changed tremolo depth parameter from tremolo depth changing section 271. The musical tone signal added with the tremolo effect is supplied to sound system 213.

Figure 62:
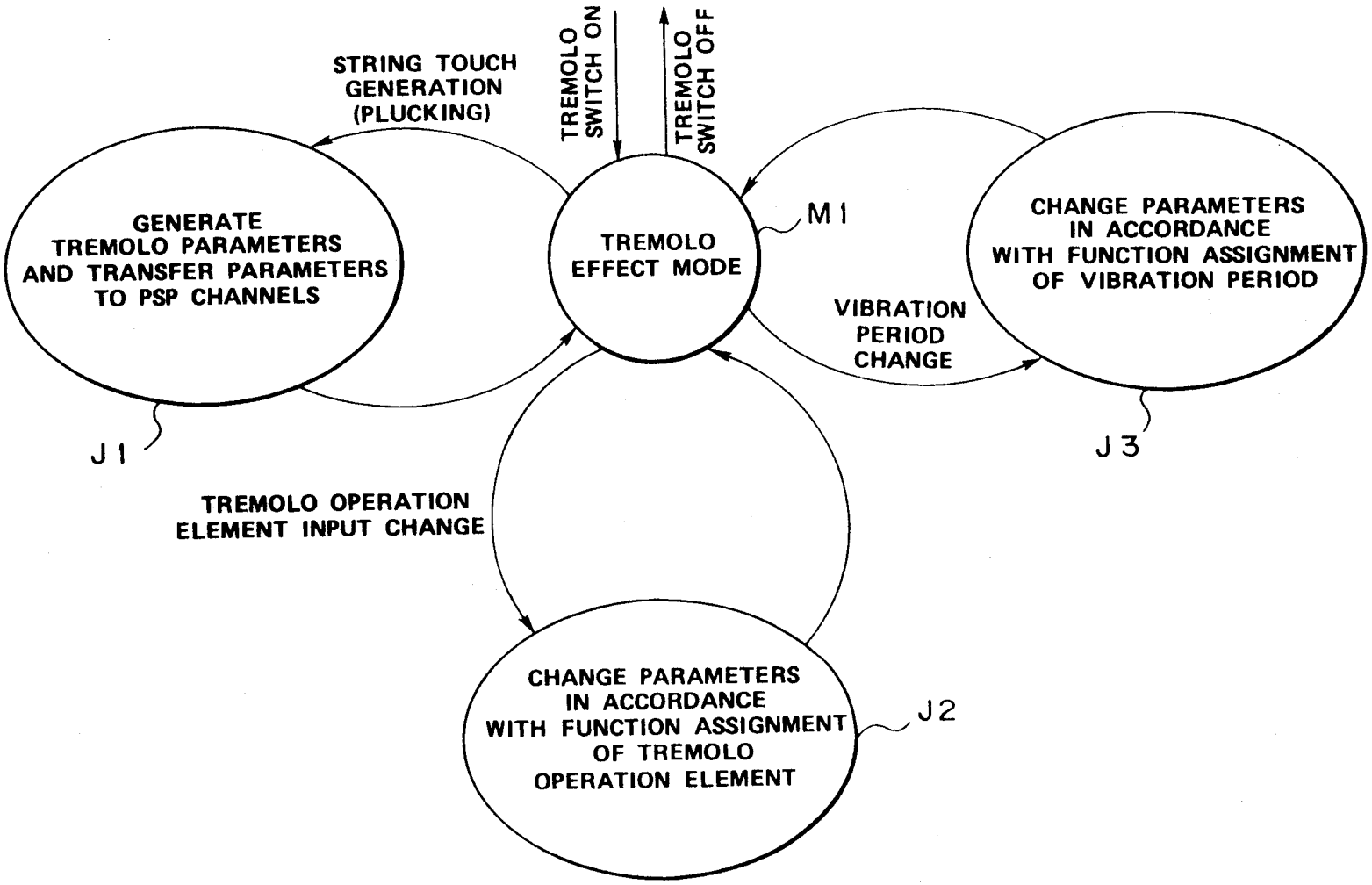
FIG. 62 is a flow chart of a mode associated with tremolo effect control.

FIG. 62 is an operation chart of tremolo effect control in the above embodiment (pitch extraction type electronic guitar 1). In pitch extraction type electronic guitar 1, a vibration period of a string, a plucking strength, and an operation amount of the tremolo arm can serve as tremolo depth and/or speed modulators in accordance with function assignment.

When tremolo switch TLSW (FIG. 1) is turned on, CPU 40 enters tremolo effect mode Ml. When specific string 7 is plucked during guitar playing, string vibration period data and string touch data are generated as described above. In this case, CPU 40 in tremolo effect mode M1 generates a tremolo parameter using these input data, function assignment data, and a reference tremolo parameter, and transfers the parameter to the corresponding channel of digital effector 80 (J1). When the operation amount of tremolo arm 11 is changed, CPU 40 changes the tremolo parameter in accordance with the tremolo effect control function assigned to tremolo arm 11, and transfers the changed parameter to effector 80. When the string vibration period is changed, CPU 40 changes the tremolo parameter in accordance with the tremolo effect change function assigned to the vibration period, and transfers the changed parameter to effector 80.

Figure 63:
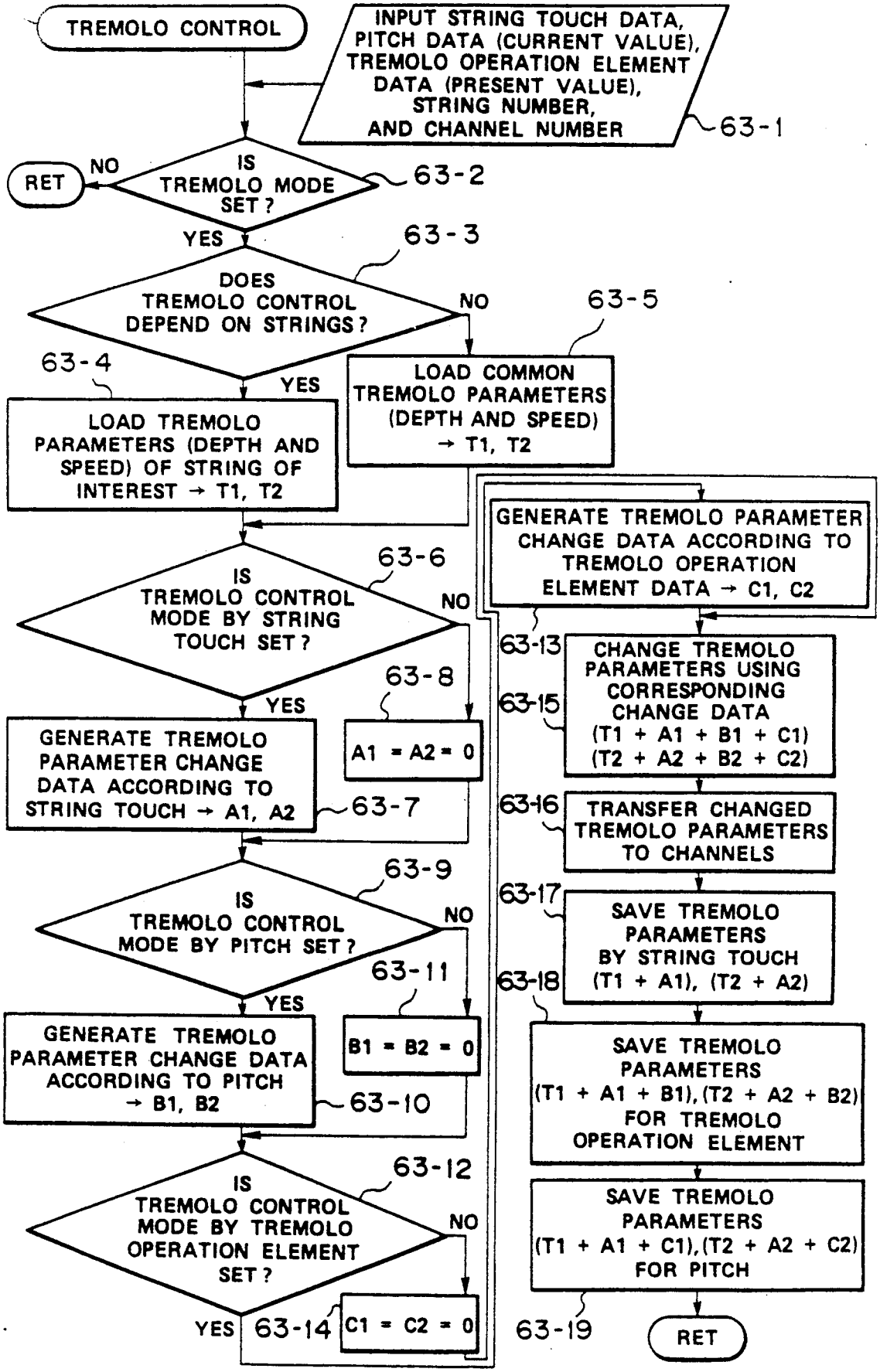
FIG. 63 is a flow chart of tremolo effect control at the beginning of generation of a tone.

FIG. 63 shows a tremolo control routine (corresponding to processing J1 in FIG. 62). This routine is one of subroutines of tone generation processing 15-7 in FIG. 15, and string touch data, present pitch data, present tremolo arm operation data, a string number, and a channel number are input in advance (63-1). It is checked in step 63-2 if the tremolo effect mode is set. If the tremolo effect mode is not set, the routine is returned. If the tremolo effect mode is set, it is checked in step 63-3 if the tremolo effect depends on types of string. YES is obtained if item "string dependent" is selected in the tremolo effect setting mode; and NO is obtained if item "string common" is selected (see FIG. 41). If item "string dependent" is selected, the tremolo depth and speed parameters set for a string of interest are loaded to T1 and T2 registers, respectively (63-4). If item "string common" is selected, the common tremolo depth and speed parameters are loaded. It is checked in step 63-6 if the tremolo control mode based on string touch data is selected. This condition is established when selection is made to assign the plucking strength to the tremolo effect control element. In this case, touch data is converted to tremolo depth modulation data using a set depth modulation opening (if set) and is loaded to an Al register, and string touch data is also converted to tremolo speed modulation data using a set speed modulation opening (if set), and is loaded to an A2 register. Refer to screen (j) in FIG. 38C about modulation opening. If the condition in step 63-6 is not established, the Al and A2 registers are cleared (63-8). Therefore, the content of the Al register corresponds to a change amount of the tremolo depth parameter, and the content of the A2 register corresponds to a change amount of the tremolo speed parameter.

Similarly, tremolo depth modulation data B1 and tremolo speed modulation data B2 for the vibration period (pitch) of a string and tremolo depth modulation data C1 and tremolo speed modulation data C2 for the tremolo arm are generated (63-9 to 63-14).

Thereafter, a sum of tremolo reference depth parameter T1 and depth modulation data A1, B1, and C1, and a sum of tremolo reference speed parameter T2 and speed modulation data A2, B2, and C2 are calculated (63-15), and the sums are transferred to effector 80 (63-16).

In step 63-17, the sum of reference depth parameter T1 and depth modulation data Al is calculated and stored in a RAM. Similarly, a sum of reference depth parameter T2 and modulation data A2 is calculated and saved in the RAM.

Similarly, a sum of reference depth parameter T1, depth modulation data by string touch data, and depth modulation data B1 by pitch data, and a sum of reference speed parameter T2, speed modulation data A2 by string touch data, and speed modulation data B2 by pitch data are calculated and saved in the RAM.

Similarly, in step 63-19, a sum of T1, A1, and C1 (tremolo depth modulation data by the tremolo arm), and a sum of T2, A2, and C2 (tremolo speed modulation data by the tremolo arm) are calculated and saved in the RAM.

The data stored in steps 63-17 to 63-19 are used in the tremolo control routine performed for a change in vibration period and in a tremolo control routine performed for a change in tremolo operation input.

Figure 64:
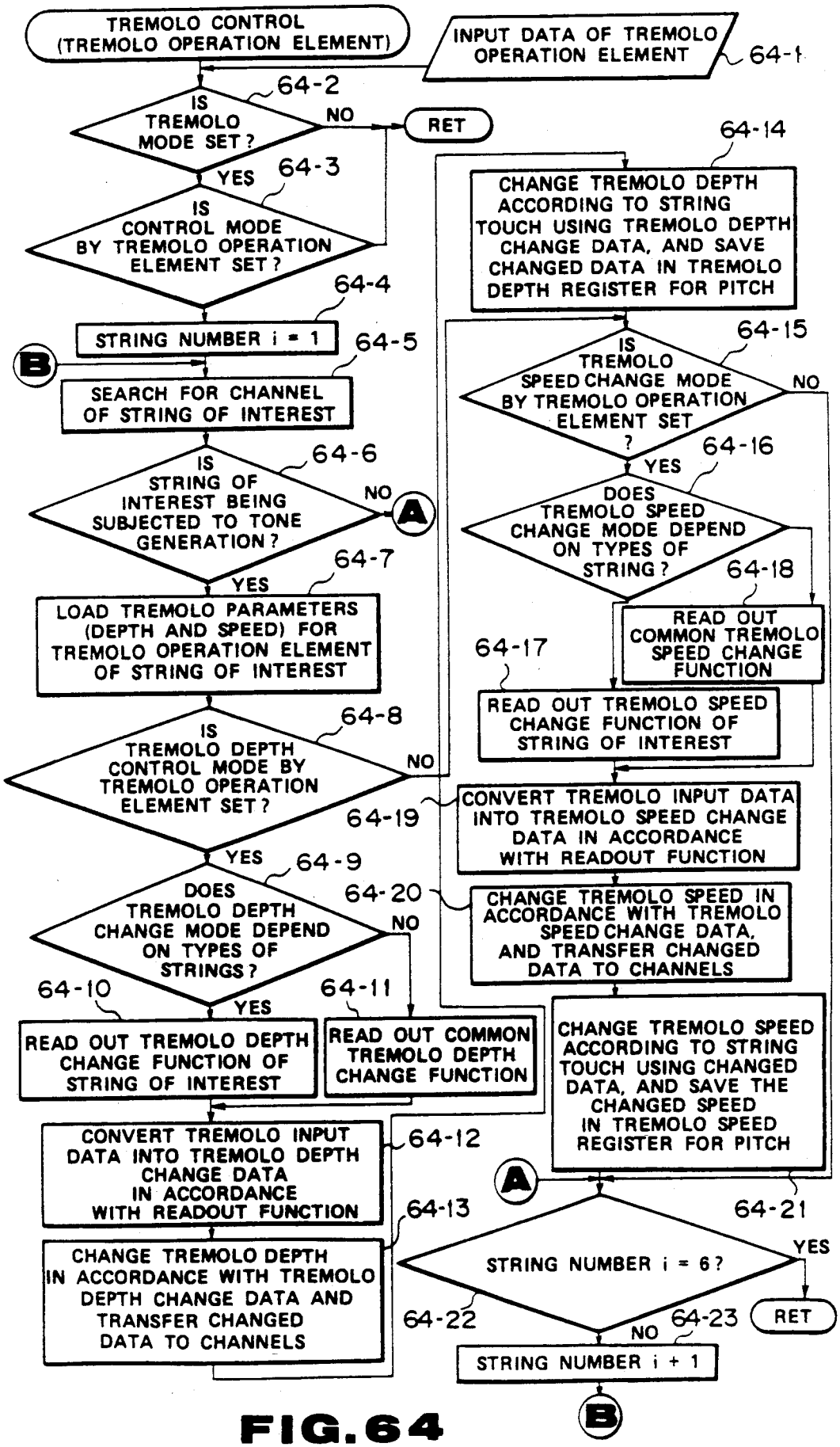
FIG. 64 is a flow chart of tremolo effect control for a change in operation amount of a tremolo arm.

FIG. 64 shows the latter routine. This routine is started when data from tremolo arm sensor 23 is changed, and new operation data from tremolo arm 11 is input first (64-1). As can be seen from steps 64-2 and 64-3, when the tremolo effect mode is not selected, or when tremolo control mode by tremolo arm 11 is not selected, nothing is made and the routine is returned. If the tremolo effect mode and the tremolo control mode by tremolo arm 11 are selected, the tremolo effect parameters for musical tones of the respective strings are updated. Of course, this updating is made for only strings for which musical tones are generated by sound source 70 (64-5 and 64-6). In step 64-7, a tremolo parameter stored for a string of interest, i.e., a sum of a reference tremolo parameter, a variation based on vibration period, and a variation based on string touch data, is loaded. If a variation in tremolo parameter by tremolo arm 11 is added to the tremolo parameter, the sum becomes data to be transferred to a corresponding tremolo channel of effector 80. Tremolo depth modulation data is generated based on new operation data from tremolo arm 11 in steps 64-8 to 64-12, and tremolo speed modulation data is generated based on new operation data from tremolo arm 11 in steps 64-15 to 64-19. The condition shown in step 64-8 is established when item "tremolo depth modulation by tremolo arm" is selected in the function assignment mode, and the condition in step 64-15 is established when item "tremolo speed modulation by tremolo arm" is selected in the function assignment mode (see screen (h) in FIG. 38C). Similarly, the condition in step 64-9 is established when the user has already selected item "string dependent" using the screen shown in FIG. 38C. In this case, the tremolo depth modulation function (see screen (j) in FIG. 38C) selected for a string of interest is loaded, and the operation data of tremolo arm 11 is converted to tremolo depth modulation data using this function (64-10 and 64-12). When item "string common" is selected, the common modulation function is used instead (64-11). The obtained tremolo depth modulation data is added to the tremolo depth parameter and is transferred to a corresponding channel in effector 80 (64-13) The tremolo depth modulation data by tremolo arm 11 is added to a sum of reference tremolo depth modulation data and tremolo depth modulation data by string touch data, and the sum is saved in the RAM (64-14). The saved data is used in the pitch routine.

Similarly, tremolo speed modulation data by tremolo arm 11 is generated, and is added to the tremolo speed parameter. The sum is sent to effector 80 (64-20). The reference tremolo speed parameter added with a variation in tremolo speed by string touch data is added to tremolo speed modulation data by a new operation input of tremolo arm 11, and the sum is saved in the RAM (64-21)..

Although not shown, pitch routine (routine for updating a tremolo parameter in response to a change in vibration period) will be readily understood from the routines shown in FIGS. 63 and 64.

Pan-pot Control

Figure 65:
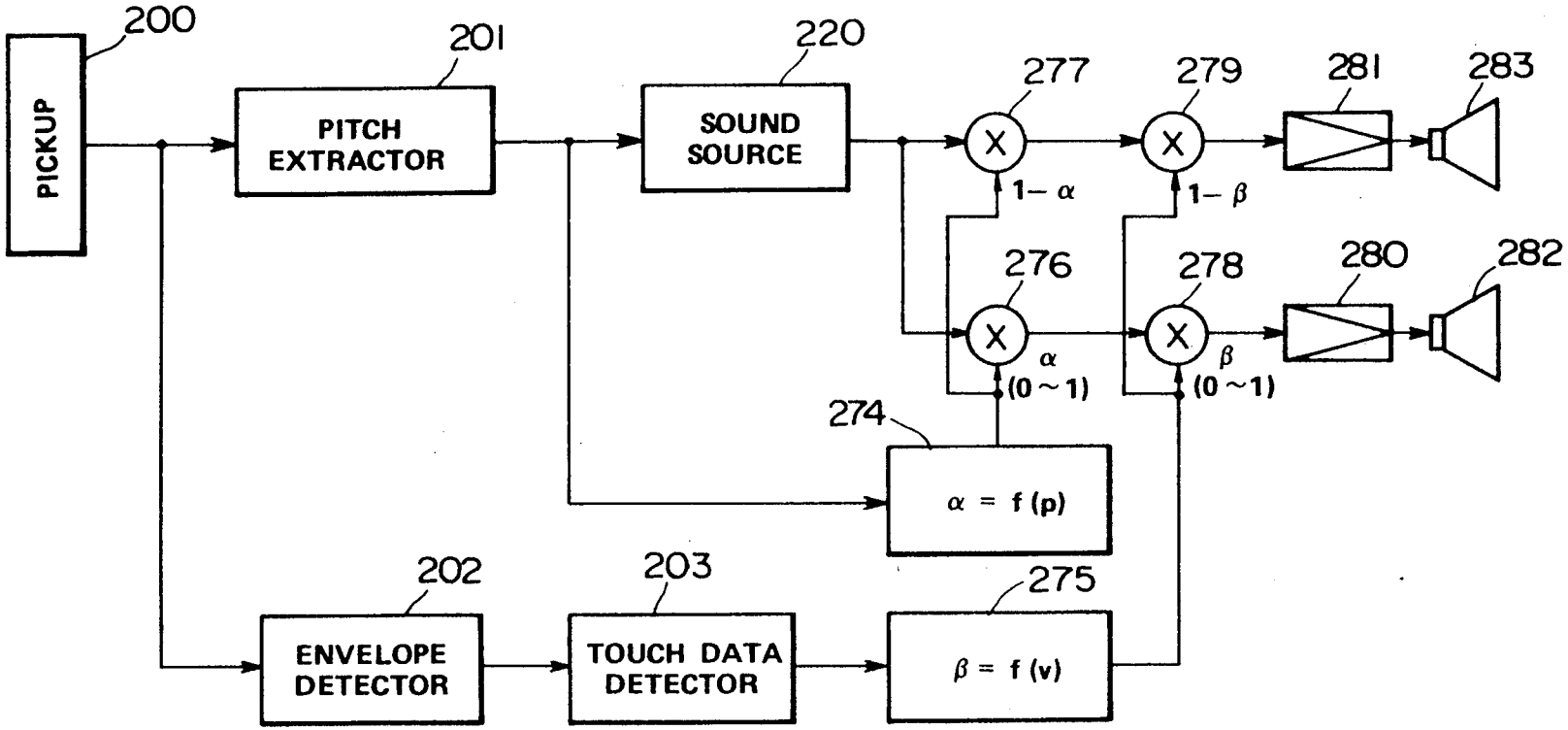
FIG. 65 is a functional block diagram of an electronic guitar of the present invention, for controlling a pan-pot based on a vibration period of a string and a plucking strength.

FIG. 65 is a functional block diagram of an electronic guitar system for performing pan-pot control based on a vibration period and a plucking strength. A signal from pickup 200 is converted to a vibration period by pitch extractor 201, and the converted period is supplied to sound source 220 and pan-pot converter 274. Pan-pot converter 274 converts the input vibration period into two pan-pot control data $\alpha$ and 1-$\alpha$ in accordance with conversion function f(p). Data $\alpha$ is input to multiplier 276 arranged along the first stereophonic channel for a musical tone signal from sound source 220, and is multiplied with the musical tone signal. Meanwhile, data (1-$\alpha$) is supplied to multiplier 277 arranged along the second stereophonic channel for a musical tone signal from sound source 220, and is multiplied with the musical tone signal.

Furthermore, the pickup signal is supplied to touch data detector 203 through envelope detector 202, and touch data representing a plucking strength is generated. The touch data is supplied to second pan-pot converter 275, and is converted to two pan-pot control data $\beta$ and 1-$\beta$ in accordance with conversion function f(v). Pan-pot control data $\beta$ is input to multiplier 278 connected to the output of multiplier 276, and is multiplied with the right musical tone signal from multiplier 276. Data (1-$\beta$) is supplied to multiplier 279 connected to the output of multiplier 277, and is multiplied with the left musical tone signal from multiplier 277. The output from multiplier 278 is produced as an actual sound through right stereophonic audio systems 280 and 282. The output from multiplier 279 is produced as an actual sound through left stereophonic audio systems 281 and 283.

Therefore, the center (pot) of the tone defined by the acoustic outputs from right and left loudspeakers 282 and 283 is moved in accordance with the vibration period of the string and the plucking strength, and an acoustic pan effect can be provided.

In the above embodiment, an operated fret position (in the case of fret switch type electronic guitar IM) or an operation amount of tremolo arm 11 can be assigned as pan-pot control elements in addition to the vibration period of the string (in the case of pitch extraction type electronic guitar 1) and the plucking strength.

Figure 66:
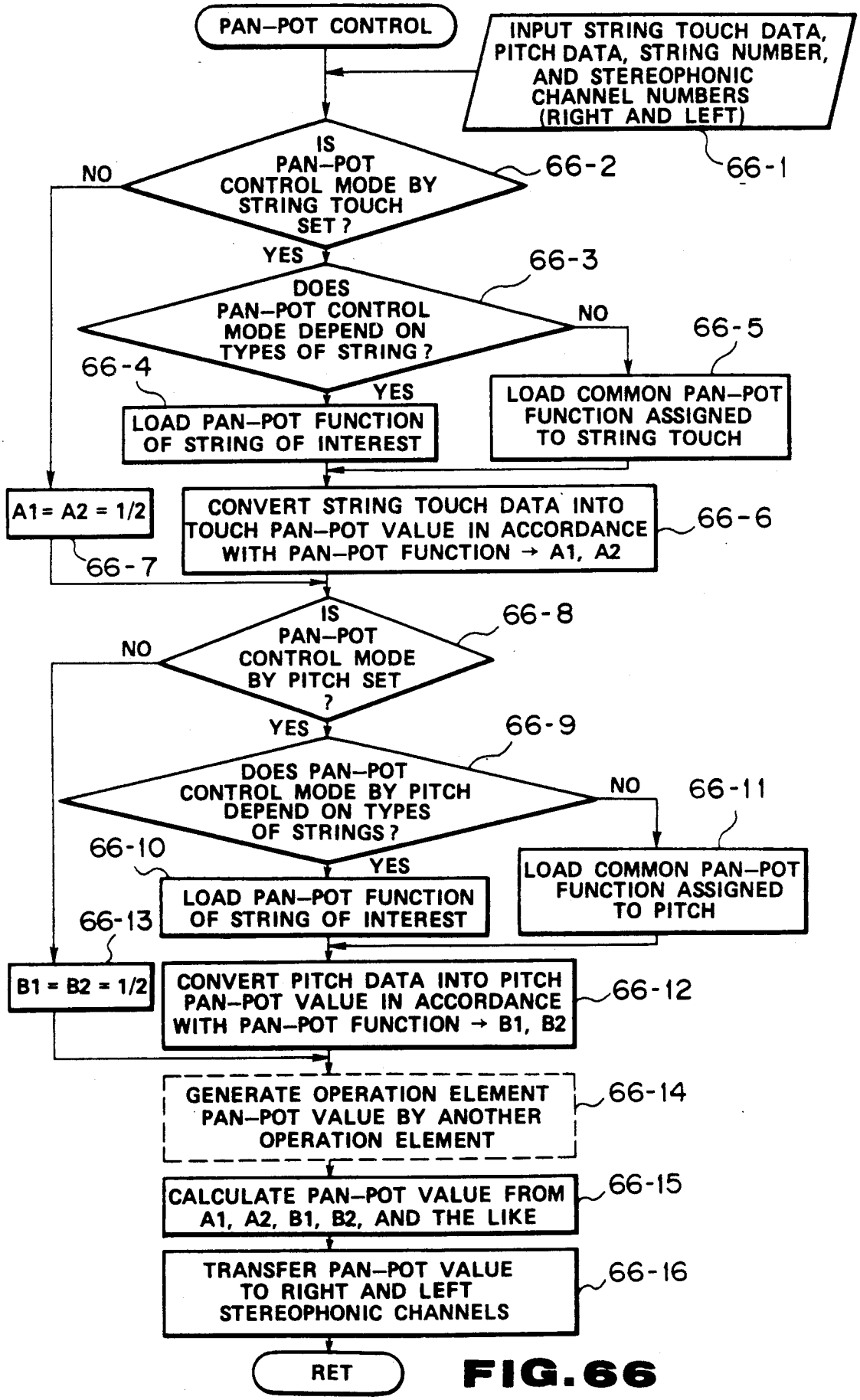
FIG. 66 is a flow chart of pan-pot control.

FIG. 66 shows a pan-pot control routine executed by the CPU.

This routine is a subroutine called in the tone generation processing routine, and string touch data, pitch data, a string number, and stereophonic channel numbers (right and left stereophonic channels for producing musical tones of a string of interest) are initially input (66-1). In steps 66-2 to 66-7, a pan-pot value (weight coefficients of right and left musical tones) is generated based on string touch data. The condition in step 66-2 is established when selection is made to assign the plucking strength to a pan-pot control element. The condition in step 66-3 is established when item "string dependent" is selected in association with the plucking strength. In the case of "string dependent", string touch data is converted to left and right touch pan-pot values using a pan-pot function selected for a string of interest, and these values are respectively loaded to A1 and A2 registers (66-4 and 66-6). In the case of "string common", a common pan-pot function is used instead. When the pan-pot control mode based on string touch data is not selected, $A1=A2=\frac{1}{2}$ (66-7).

Similarly, pitch pan-pot data are generated based on the vibration period, and are loaded to B1 and B2 registers (66-8 to 66-13).

Step 66-14 is executed in a system capable of assigning a pan-pot control function to another operation element (tremolo arm).

The final pan-pot values are calculated in accordance with data A1, A2, B1, and B2, and are transferred to left and right stereophonic channels (66-15 and 66-16). In this case, only one multiplier is arranged for each of the left and right stereophonic channels.

The embodiment has been described. Various changes and modifications may be made within the spirit and scope of the invention.

Therefore, the scope of the invention should be limited by only the appended claims.

What is claimed is:

1. An electronic stringed instrument, comprising:

a fingerboard;

at least one extended string;

string-vibration detection means for detecting that said string is vibrated;

string-vibration strength measuring means for measuring a string-vibration strength of said string;

operation position detection means for detecting an operation position on said fingerboard;

sound source means for generating a musical tone for said string;

effect addition means connected with said sound source means for adding an effect to the musical tone supplied from said sound source means; and tone control means including tone generation start instruction means for, when said string-vibration detection means detects that said string is vibrated, instructing said sound source means to start generation of a musical tone corresponding the vibrated string, and pitch instruction means for instructing said sound source means to cause a pitch of the musical tone generated by said sound source means to correspond to the operation position on said fingerboard detected by said operation position detection means, wherein said instrument further comprises effect control means for controlling operation of said effect addition means in accordance with the string-vibration strength measured by said string-vibration strength measuring means.

2. An electronic stringed instrument, comprising:

a fingerboard;

at least one string kept taut along said fingerboard;

string-vibration detection means for detecting that said string is vibrated;

string-vibration strength measuring means for measuring a string-vibration strength of said string;

period measuring means for measuring a fundamental period of a vibration of said string;

sound source means for generating a musical tone for said string;

effect addition means connected with said sound source means for generating a musical tone for said string, for adding an effect to the musical tone supplied from said sound source means; and tone control means including tone generation start instruction means for, when said string-vibration detecting means detects that said string is vibrated, instructing said sound source means to start generation of a musical tone corresponding the vibrated string; and pitch instruction means for instructing said sound source means to cause a pitch of the musical tone generated by said sound source means to correspond to the period measured by said period measuring means, wherein said instrument further comprises effect control means for controlling operation of said effect addition means in accordance with the string-vibration strength measured by said string-vibration strength measuring means.

3. An electronic stringed instrument, comprising:

a fingerboard;

at least one extended string;

string-vibration monitoring means for monitoring vibrating for said string;

string-vibration strength monitoring means for monitoring a string-vibration strength for said string;

operation position monitoring means for monitoring an operation position on said fingerboard;

sound source means for generating a musical tone for said string;

at least two audio circuit means for providing stereophonic sounds; and tone control means for sending a string-vibration monitoring result from said string-vibration monitoring means and an operation position monitoring result from said operation position monitoring means to said sound source means and for controlling characteristics of the musical tone in response to both the string-vibration monitoring result and the operation position monitoring result;

wherein said instrument further comprises pan-pot control means for controlling a relative magnitude of a musical tone signal for said string which is to be supplied from said sound source means to said audio circuit means in accordance with the string-vibration strength for said string measured by said string-vibration strength monitoring means.

4. An electronic stringed instrument, comprising:

a fingerboard;

at least one string kept taut along said fingerboard;

string-vibration monitoring means for monitoring a vibrating for said string;

string-vibration strength monitoring means for monitoring a string-vibrating strength for said string;

period monitoring means for monitoring a fundamental period of a vibration of said string;

sound source means for generating a musical tone for said string;

at least two audio circuit means for providing stereophonic sounds; and tone control means for sending a string-vibration monitoring result from said string-vibration monitoring means and a fundamental period monitoring result from said period monitoring means to said sound source means and for controlling characteristics of the musical tone in response to both the string-vibration monitoring result and the fundamental period monitoring result;

wherein said instrument further comprises pan-pot control means for controlling a relatively magnitude of a musical tone signal for said string which is to be supplied from said sound source means to said audio circuit means in accordance with the string-vibration strength for said string measured by said string-vibration strength monitoring means.

5. An electronic stringed instrument, comprising:

a fingerboard;

at least one extended string;

string-vibration monitoring means for monitoring a string-vibration for said string;

operation position monitoring means for monitoring an operation position on said fingerboard;

a manually operative performance operation element; and tone control means for sending a string-vibration monitoring result from said string-vibration monitoring means and an operation position monitoring result from said operation position monitoring means and for controlling characteristics of the musical tone in response to both the string-vibration monitoring result and the operation position monitoring result;

wherein said instrument further comprises pan-pot control means for controlling a pan-pot position of the musical tone which is to be produced in accordance with an operation state of said performance operation element.

6. An electronic stringed instrument, comprising:

a fingerboard;

at least one string kept taut along said fingerboard;

string-vibration monitoring means for monitoring a vibration for said string;

period monitoring means for monitoring a fundamental period of a vibration of said string;

a manually operative performance operation element; and tone control means for sending a string-vibration monitoring result from said string-vibration monitoring means and a fundamental period monitoring result from said period monitoring means and for controlling characteristics of the musical tone in response to both the string-vibration monitoring result and the fundamental period monitoring result, wherein said instrument further comprises pan-pot control means for controlling a pan-pot position of the musical tone which is to be produced in accordance with an operation state of said performance operation element.

7. An electronic stringed instrument, comprising:

a fingerboard;

at least one extended string;

string-vibration monitoring means for monitoring a vibration for said string;

string-vibration strength monitoring means for monitoring a string-vibration for said string;

operation position monitoring means for monitoring an operation position on said fingerboard;

wherein said instrument further comprises:

function assignment means for variably assigning a tone control function to the string-vibration strength; and tone control means for controlling characteristics of a musical tone in correspondence with the tone control function assigned to the string-vibration strength by said function assignment means in response to the monitoring result from said string-vibration strength monitoring means.

8. An electronic stringed instrument, comprising:

a fingerboard;

at least one string kept taught along said fingerboard;

string-vibration monitoring means for monitoring a vibration for said string;

string-vibration strength monitoring means for monitoring a string-vibration strength for said string; and period monitoring means for monitoring a fundamental period of a vibration of said string;

wherein said instrument further comprises:

function assignment means for variably assigning a tone control function to the string-vibration strength; and tone control means for controlling characteristics of a musical tone in correspondence with the tone control function assigned to the string-vibration strength by said function assignment means in response to the monitoring result from said string-vibration strength monitoring means.

9. An electronic stringed instrument, comprising:

a fingerboard;

at least one extended string;

string-vibration monitoring means for monitoring a vibration for said string;

operation position monitoring means for monitoring an operation position on said fingerboard; and string-bending monitoring means for monitoring a string-bending operation for said string;

wherein said instrument further comprises:

function assignment means for variably assigning a tone control function to the string-bending operation; and tone control means for controlling characteristics of a musical tone in correspondence with the tone control function assigned to the string-bending operation by said function assignment means in response to the monitoring result from said string-bending monitoring means.

10. An electronic stringed instrument, comprising:

a fingerboard;

at least one string kept taut along said fingerboard;

string-vibration monitoring means for monitoring a vibration for said string;

period monitoring means for monitoring a fundamental period of a vibration of said string; and string-bending monitoring means for monitoring a string-bending operation for said string;

wherein said instrument further comprises:

function assignment means for variably assigning a tone control function to the string-bending operation; and tone control means for controlling characteristics of a musical tone in correspondence with the tone control function assigned to the string-bending operation by said function assignment means in response to the monitoring result from said string-bending monitoring means.

11. An electronic stringed instrument, comprising:

a fingerboard;

a plurality of extended strings;

string-vibration detection means for detecting that each of said strings is vibrated;

string-bending sensing means for sensing a string-bending operation state for each of said strings;

operation position detection means for detecting an operation position on said fingerboard; and tone generation start instruction means for, when said string-vibration detection means detects that one of said strings is vibrated, instructing to start generation of a musical tone corresponding to the vibrated string; and pitch instruction means for instructing a pitch of the musical tone to be generated to correspond to the operation position on said fingerboard detected by said operation position detection means, wherein said instrument further comprises:

sound source means for producing a first musical tone having a first tone color, and a second musical tone having a second tone color;

tone mixing means for mixing the first musical tone and the second musical tone; and tone mixing ratio control means for controlling a mixing ratio of the first musical tone and the second musical tone in said tone mixing means in accordance with the sensed string-bending operation state for said string-bending sensing means.

12. An electronic stringed instrument, comprising:

a fingerboard;

a plurality of strings kept taut along said fingerboard;

string-vibration detection means for detecting that each of said strings is vibrated;

string-bending sensing means for sensing a string-bending operation state for each of said strings;

period measuring means for measuring a fundamental period of a fundamental of each of said strings;

tone generation start instruction means for, when said string-vibration detection means detects that one of said strings is vibrated, instructing to start generation of a musical tone corresponding to the vibrated string; and pitch instruction means for instructing the pitch of the musical tone to be generated to correspond to the period measured by said period measuring means;

wherein said instrument further comprises:

sound source means for producing first musical tone having a first tone color, and a second musical tone having a second tone color;

tone mixing means for mixing the first musical tone and the second musical tone; and tone mixing ratio control means for controlling a mixing ratio of the first musical tone and the second musical tone in said tone mixing means in accordance with the sensed string-bending operation state for said string-bending sensing means.

13. An electronic stringed instrument, comprising:

a fingerboard;

at least one extended string;

string-vibration detection means for detecting that said string is vibrated;

sound source means for generating a musical tone for said string;

operation position detection means for detecting an operation position on said fingerboard; and tone control means including tone generation start instruction means for, when said string-vibration detection means detects that said string is vibrated, instructing said sound source means for generating a musical tone of said string to start generation of a musical tone corresponding to the vibrated string, wherein said instrument further comprises:

pitch data generating means, connected with said operation position detection means, for generating pitch data in correspondence with the operation position on said fingerboard with respect to said string detected by said operation position detection means;

pitch data correcting means for correcting the pitch data generated by said pitch data generating mean to be another tuned pitch data; and pitch control means for controlling a pitch of a musical tone for said string from said sound source means using the pitch data corrected by said pitch data correcting means.

14. An electronic stringed instrument, comprising:

a fingerboard;

at least one string kept taut along said fingerboard;

string-vibration detection means for detecting that said string is vibrated;

said source means for generating a musical tone for said string;

period measuring means for measuring a fundamental period of a vibration of said string; and tone control means including tone generation start instruction means for, when said string-vibration detection means detects that said string is vibrated, instructing said sound source means for generating a musical tone of said string to start generation of a musical tone corresponding to the vibrated string, wherein said instrument further comprises:

pitch data generating means, connected with said period measuring means, for generating pitch data in correspondence with the fundamental period of said string measured by said period measuring means;

pitch data correcting means for correcting the pitch data generated by said pitch data generating means to be another tuned pitch data; and pitch control means for controlling a pitch of a musical tone for said string from said sound source means using the pitch data corrected by said pitch data correcting means.

15. An electronic stringed instrument, comprising:

a fingerboard;

a plurality of extended strings;

string-vibration detection means for detecting that each of said strings is vibrated;

operation position detection means for detecting an operation position on said fingerboard against which each of said strings is urged; and tone generation start instruction means for, when said string-vibration detection means detects that one of said strings is vibrated, instructing to start generation of a musical tone corresponding to the vibrated string, and pitch instruction means for instructing a pitch of the musical tone to be generated to correspond to the operation position on said fingerboard detected by said operation position detection means, wherein said instrument further comprises:

an operation means for outputting an operation level signal;

modulation depth setting means for setting a modulation depth of the pitch uniformly or independently for each of the plurality of strings; and pitch modulation means for executing a pitch modulation for each of the strings in accordance with the operation level signal output from the operation means and the depth of the pitch modulation being determined uniformly or independently for each of the strings set by said modulation depth setting means.

16. An electronic stringed instrument, comprising:

a fingerboard;

a plurality of strings kept taut along said fingerboard;

string-vibration detection means for detecting that each of said strings is vibrated;

period measuring means for measuring a fundamental period of a vibration of each of said strings;

tone generation start instruction means for, when said string-vibration detection means detects that one of said strings is vibrated, instructing to start generation of a musical tone corresponding to the vibrated string, and pitch instruction means for instructing the pitch of the musical tone to be generated to correspond to the period measured by said period measuring means, wherein said instrument further comprises:

an operation means for outputting an operation level signal;

modulation depth setting means for setting a modulation depth of the pitch uniformly or independently for each of the plurality of strings; and pitch modulation means for executing a pitch modulation for each of the strings in accordance with the operation level signal output from the operation means and the depth of the pitch modulation being determined uniformly or independently for each of the strings set by said modulation depth setting means.

17. An electronic stringed instrument, comprising:

a fingerboard;

a plurality of extended strings;
string-vibration detection means for detecting that each of said strings is vibrated;
operation element sensing means for sensing an operation state for a manually operative performance operation element;
operation position detection means for detecting an operation position on said fingerboard; and
tone generation start instruction means for, when said string-vibration detection means detects that one of said strings is vibrated, instructing to start generation of a musical tone corresponding to the vibrated string; and
pitch instruction means for instructing a pitch of the musical tone to be generated to correspond to the operation position on said fingerboard detected by said operation position detection means;
wherein said instrument further comprises:
sound source means for producing a first musical tone having a first tone color and a second musical tone having a second tone color;
tone mixing means for mixing the first musical tone and the second musical tone; and
tone mixing ratio control means for controlling a mixing ratio of the first musical tone and the second musical tone in said tone mixing means in accordance with the sensed operation state for said performance operation element.

18. An electronic stringed instrument, comprising:
a fingerboard;
a plurality of strings kept taut along said fingerboard;
string-vibration detection means for detecting that each of said strings is vibrated;
operation element sensing means for sensing an operation state for a performance operation element;
period measuring means for measuring a fundamental period of a vibration of each of said strings;
tone generation start instruction means for, when said string-vibration detection means detects that one of said strings is vibrated, instructing to start generation of a musical tone corresponding to the vibrated string; and
pitch instruction means for instructing a pitch of the musical tone to be generated to correspond to the period measured by said period measuring means;
wherein said instrument further comprises:
sound source means for producing a first musical tone having a first tone color and a second musical tone having a second tone color;
tone mixing means for mixing the first musical tone and the second musical tone; and
tone mixing ratio control means for controlling a mixing ratio of the first musical tone and the second musical tone in said tone mixing means in accordance with the sensed operation state for said performance operation element.

19. An electronic stringed instrument, comprising:
a fingerboard;
a plurality of extended strings:
string-vibration detection means for detecting that each of said strings is vibrated;
string-vibration strength measuring means for measuring a vibrating strength for each of said strings;
operation position detection means for detecting an operation position on said fingerboard; and
tone generation start instruction means for, when said string-vibration detection means detects that one of said strings is vibrated, instructing to start generation of a musical tone corresponding to the vibrated string; and
pitch instruction means for instructing a pitch of the musical tone to be generated to correspond to the operation position on said fingerboard detected by said operation position detection means;
wherein said instrument further comprises:
sound source means for producing a first musical tone having a first tone color and a second musical tone having a second tone color;
tone mixing means for mixing the first musical tone and the second musical tone; and
tone mixing ratio control means for controlling a mixing ratio of the first musical tone and the second musical tone in said tone mixing means in accordance with the measured string-vibration strength.

20. An electronic stringed instrument, comprising:
a fingerboard;
a plurality of strings kept taut along said fingerboard;
string-vibration detection means for detecting that each of said strings is vibrated;
string-vibration strength measuring means for measuring a vibrating strength of each of said strings;
period measuring means for measuring a fundamental period of a vibration of each of said strings;
tone generation start instruction means for, when said string-vibration detection means detects that one of said strings is vibrated, instructing to start generation of a musical tone corresponding to the vibrated string; and
pitch instruction means for instructing a pitch of the musical tone to be generated to correspond to the period measured by said period measuring means;
wherein said instrument further comprises;
sound source means for producing a first musical tone having a first tone color and a second musical tone having a second tone color;
tone mixing means for mixing the first musical tone and the second musical tone; and
tone mixing ratio control means for controlling a mixing ratio of the first musical tone and the second musical tone in said tone mixing means in accordance with the measured vibrating strength.

21. An electronic stringed instrument, comprising:
a fingerboard;
a plurality of extended strings;
string-vibration detection means for detecting that each of said strings is vibrated;
operation position detection means for detecting an operation position on said fingerboard; and
tone generation start instruction means for, when said string-vibration detection means detects that one of said strings is vibrated, instructing to start generation of a musical tone corresponding to the vibrated string; and
pitch instruction means for instructing a pitch of the musical tone to be generated to correspond to the operation position on said fingerboard detected by said operation position detection means;
wherein said instrument further comprises:
sound source means for producing a first musical tone having a first tone color and a second musical tone having a second tone color;
tone mixing means for mixing the first musical tone and the second musical tone; and
tone mixing ratio control means for controlling a mixing ratio of the first musical tone and the second musical tone in said tone mixing means in accordance with the detected operation position on said fingerboard.

22. An electronic stringed instrument, comprising:
a fingerboard;
a plurality of strings kept taut along said fingerboard;
string-vibration detection means for detecting that each of said strings is vibrated;
period measuring means for measuring a fundamental period of a vibration of each of said strings;
tone generation start instruction means for, when said string-vibration detection means detects that one of said strings is vibrated, instructing to start generation of a musical tone corresponding to the vibrated string; and
pitch instruction means for instructing a pitch of the musical tone to be generated to correspond to the fundamental period measured by said period measuring means;
wherein said instrument further comprises:
sound source means for producing a first musical tone having a first tone color and a second musical tone having a second tone color;
tone mixing means for mixing the first musical tone and the second musical tone; and
tone mixing ratio control means for controlling a mixing ratio of the first musical tone and the second musical tone in said tone mixing means in accordance with the measured fundamental period.

23. An electronic stringed instrument, comprising:
a fingerboard;
a plurality of extended strings;
string-vibration detection means for detecting that each of said strings is vibrated;
string detection means for detecting a string which is operated among said plurality of strings;
operation position detection means for detecting an operation position on said fingerboard; and
tone generation start instruction means for, when said string-vibration detection means detects that one of said strings is vibrated, instructing to start generation of a musical tone corresponding to the vibrated string; and
pitch instruction means for instructing a pitch of the musical tone to be generated to correspond to the operation position on said fingerboard detected by said operation position detection means;
wherein said instrument further comprises:
sound source means for producing a first musical tone having a first tone color and a second musical tone having a second tone color;
tone mixing means for mixing the first musical tone and the second musical tone; and
tone mixing ratio control means for controlling a mixing ratio of the first musical tone and the second musical tone in said tone mixing means in accordance with the string detected by said string detection means.

24. An electronic stringed instrument, comprising:
a fingerboard;
a plurality of strings kept taut along said fingerboard;
string-vibration detection means for detecting that each of said strings is vibrated;
string detection means for detecting a string which is operated among said plurality of strings;
period measuring means for measuring a fundamental period of a vibration of each of said strings;
tone generation start instruction means for, when said string-vibration detection means detects that one of said strings is vibrated, instructing to start generation of a musical tone corresponding to the vibrated string; and
pitch instruction means for instructing a pitch of the musical tone to be generated to correspond to the period measured by said period measuring means;
wherein said instrument further comprises:
sound source means for producing a first musical tone having a first tone color and a second musical tone having a second tone color;
tone mixing means for mixing the first musical tone and the second musical tone; and
tone mixing ratio control means for controlling a mixing ratio of the first musical tone and the second musical tone in said tone mixing means in accordance with the string detected by said string detection means.

25. An electronic stringed instrument, comprising:
a fingerboard;
at least one extended string;
string-vibration monitoring means for monitoring a vibration for said string;
string-vibration strength monitoring means for monitoring a string-vibration strength for said string;
operation position monitoring means for monitoring an operation position on said fingerboard; and
tone control means for sending a string-vibration monitoring result from said string-vibration monitoring means and an operation position monitoring result from said operation position measuring means and for controlling characteristics of the musical tone in response to both the string-vibration monitoring result and the operation position monitoring result,
wherein said instrument further comprises pan-pot control means for controlling a pan-pot position of a musical tone which is to be produced in accordance with the string-vibration strength for said string measured by said string-vibration strength monitoring means.

26. An electronic stringed instrument, comprising:
a fingerboard;
at least one string kept taut along said fingerboard;
string-vibration strength monitoring means for monitoring a string-vibration strength for said string;
period monitoring means for monitoring a fundamental period of a vibration of said string; and
tone control means for sending a string-vibration monitoring result from said string-vibration monitoring means and a fundamental period monitoring result from said period monitoring means and for controlling characteristics of the musical tone in response to both the string-vibration monitoring result and the fundamental period monitoring result;
wherein said instrument further comprises pan-pot control means for controlling a pan-pot position of a musical tone which is to be produced in accordance with the string-vibration strength for said string measured by said string-vibration strength monitoring means.

* * * * *